US010083561B2

(12) United States Patent
Sundaresan

(10) Patent No.: US 10,083,561 B2
(45) **Date of Patent: *Sep. 25, 2018**

(54) METHODS, APPARATUS AND SYSTEMS FOR ACCEPTING, RETURNING OR EXCHANGING PARCELS AND DELIVERIES

(71) Applicant: Kumar Sundaresan, Fremont, CA (US)

(72) Inventor: Kumar Sundaresan, Fremont, CA (US)

( * ) Notice: Subject to any disclaimer, the term of this patent is extended or adjusted under 35 U.S.C. 154(b) by 89 days.

This patent is subject to a terminal disclaimer.

(21) Appl. No.: 15/294,254

(22) Filed: Oct. 14, 2016

(65) Prior Publication Data

US 2017/0055751 A1 Mar. 2, 2017

Related U.S. Application Data

(63) Continuation-in-part of application No. PCT/US2015/025194, filed on Apr. 9, 2015.

(60) Provisional application No. 61/980,644, filed on Apr. 17, 2014, provisional application No. 62/342,980, filed on May 29, 2016.

(51) Int. Cl.
*G07C 9/00* (2006.01)
*A47G 29/20* (2006.01)
(Continued)

(52) U.S. Cl.
CPC ..... *G07C 9/00896* (2013.01); *A47G 29/141* (2013.01); *A47G 29/20* (2013.01);
(Continued)

(58) Field of Classification Search
CPC .... A47G 29/141; A47G 29/124; A47G 29/20; A47G 29/1225; A47G 29/1214;
(Continued)

(56) References Cited

U.S. PATENT DOCUMENTS 651,256 A 6/1900 May
665,942 A 1/1901 Tabler
(Continued)

FOREIGN PATENT DOCUMENTS

GB 2424919 A 10/2006
GB 2462284 A 2/2010
WO 2000009841 A1 2/2000

*Primary Examiner* — William L Miller
(74) *Attorney, Agent, or Firm* — Dowell & Dowell, P.C.

(57) ABSTRACT

This invention involves a novel method, device, system and apparatus to receive, return or exchange parcels securely. The invention involves a novel security apparatus and one or more parcel receptacles. The novel security apparatus can be securely connected to an object such as a door knob or door handle or door knockers or door or any object to which my security apparatus can be securely connected. The parcel receptacles can be of many types. The locking mechanism in the security apparatus and on the parcel receptacle can be of technological in nature using the latest advancements in wireless technology, or alternatively, involve simple physical lock and key mechanisms. The apparatus allows access to parcels to authenticated users only, and involve many safety features including an audible alarm and other tamper-proof mechanisms to ensure safety of parcels.

25 Claims, 43 Drawing Sheets

(51) Int. Cl.

| | |
|---|---|
| ***E05B 73/00*** | (2006.01) |
| ***E05B 45/00*** | (2006.01) |
| ***E05B 47/00*** | (2006.01) |
| ***A47G 29/14*** | (2006.01) |

(52) U.S. Cl.
CPC ..... *E05B 45/005* (2013.01); *E05B 47/0001* (2013.01); *E05B 73/0005* (2013.01); *E05B 73/0011* (2013.01); *A47G 2029/144* (2013.01); *A47G 2029/147* (2013.01); *A47G 2029/149* (2013.01); *E05B 2047/0067* (2013.01); *E05B 2047/0094* (2013.01); *E05B 2047/0095* (2013.01); *G07C 9/00912* (2013.01); *G07C 2009/0092* (2013.01); *G07C 2009/00769* (2013.01)

(58) Field of Classification Search
CPC ..... A47G 2029/1226; A47G 2029/144; A47G 2029/147; A47G 2029/149; E05B 73/0005; E05B 73/0011; E05B 67/003; E05B 45/005; E05B 47/0001; E05B 1/00; E05B 2047/0067; E05B 2047/0072; E05B 2047/0094; E05B 2047/0095; Y10T 70/5031; Y10T 70/5035
USPC .... 232/19, 34–36, 45; 340/568.1, 569, 5.73; 70/63, 64
See application file for complete search history.

(56) References Cited

U.S. PATENT DOCUMENTS

| | | | | | |
|---|---|---|---|---|---|
| 1,847,969 | A * | 3/1932 | Marks | A47G 29/20 | 232/42 |
| 2,159,279 | A * | 5/1939 | Lipowsky | A47G 29/14 | 383/102 |
| 4,785,960 | A | 11/1988 | Belisle | | |
| 5,624,071 | A * | 4/1997 | Sosan | A47G 29/20 | 232/1 B |
| 5,774,053 | A * | 6/1998 | Porter | A47G 29/141 | 232/19 |
| 6,155,715 | A * | 12/2000 | Lake | A47G 29/20 | 150/102 |
| 6,204,763 | B1 * | 3/2001 | Sone | A47G 29/141 | 221/2 |
| 6,375,070 | B1 | 4/2002 | Snoke | | |
| 6,426,699 | B1 * | 7/2002 | Porter | A47F 10/00 | 221/2 |
| 6,588,656 | B2 | 7/2003 | Cox et al. | | |
| 6,604,390 | B1 | 8/2003 | Nooner | | |
| 6,967,575 | B1 * | 11/2005 | Dohrmann | A47G 29/141 | 220/592.01 |
| 7,191,932 | B2 * | 3/2007 | Fobbe | A47G 29/141 | 232/19 |
| 7,305,858 | B1 | 12/2007 | Wu | | |
| 7,815,112 | B2 * | 10/2010 | Volpe | A47G 29/141 | 235/375 |
| 8,358,195 | B2 | 1/2013 | Giles | | |
| 8,358,199 | B2 | 1/2013 | Nesling | | |
| 8,573,473 | B1 | 11/2013 | Farentinos et al. | | |
| 8,661,862 | B2 | 3/2014 | Mikolajczyk et al. | | |
| 9,364,112 | B2 | 6/2016 | Sundaresan | | |
| 9,596,952 | B2 * | 3/2017 | Mencel | A47G 29/20 | |
| 2001/0027525 | A1 * | 10/2001 | Gamlin | A47G 29/141 | 726/27 |
| 2008/0067227 | A1 * | 3/2008 | Poss | A47G 29/22 | 232/17 |
| 2012/0269461 | A1 | 10/2012 | Proctor et al. | | |
| 2013/0077896 | A1 | 3/2013 | Wiley et al. | | |
| 2014/0000322 | A1 | 1/2014 | Williams | | |
| 2015/0359372 | A1 * | 12/2015 | Cho | A47G 29/1245 | 232/18 |

* cited by examiner

Figure 1a - Examples of Circular Doorknobs
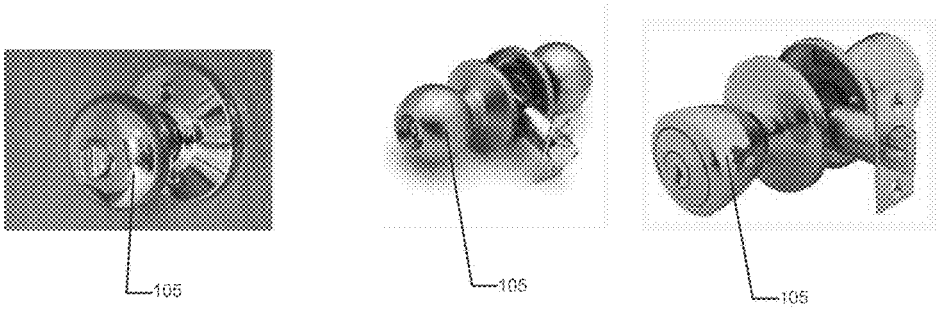
Figure 1b - Examples of Straight-Shaped Doorknobs
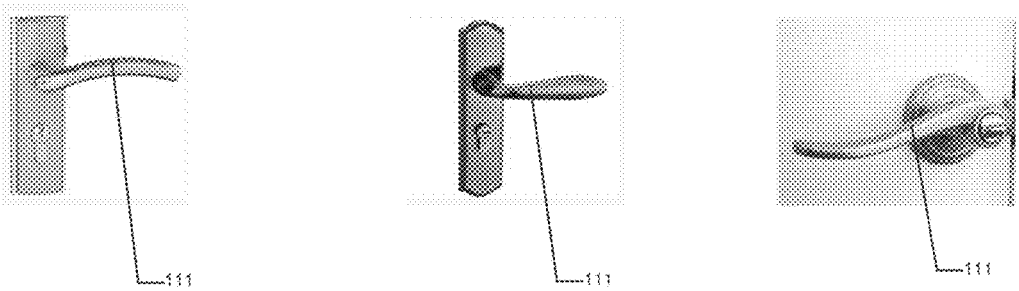
Figure 1c - Examples of Door Handles
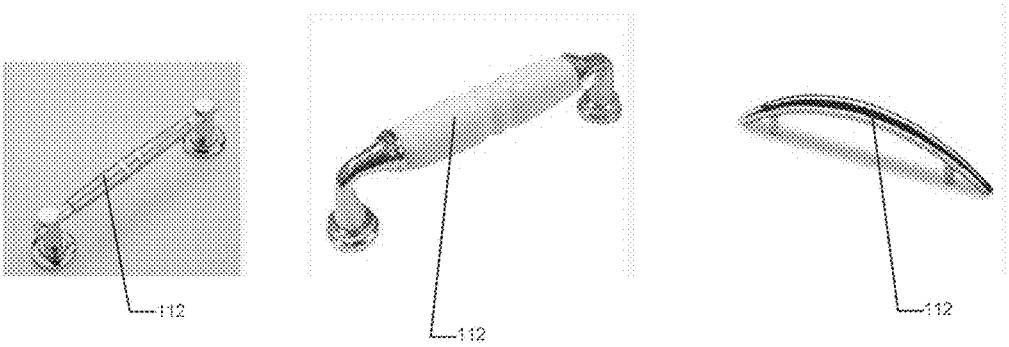

Figure 1d – Examples of Door Knockers
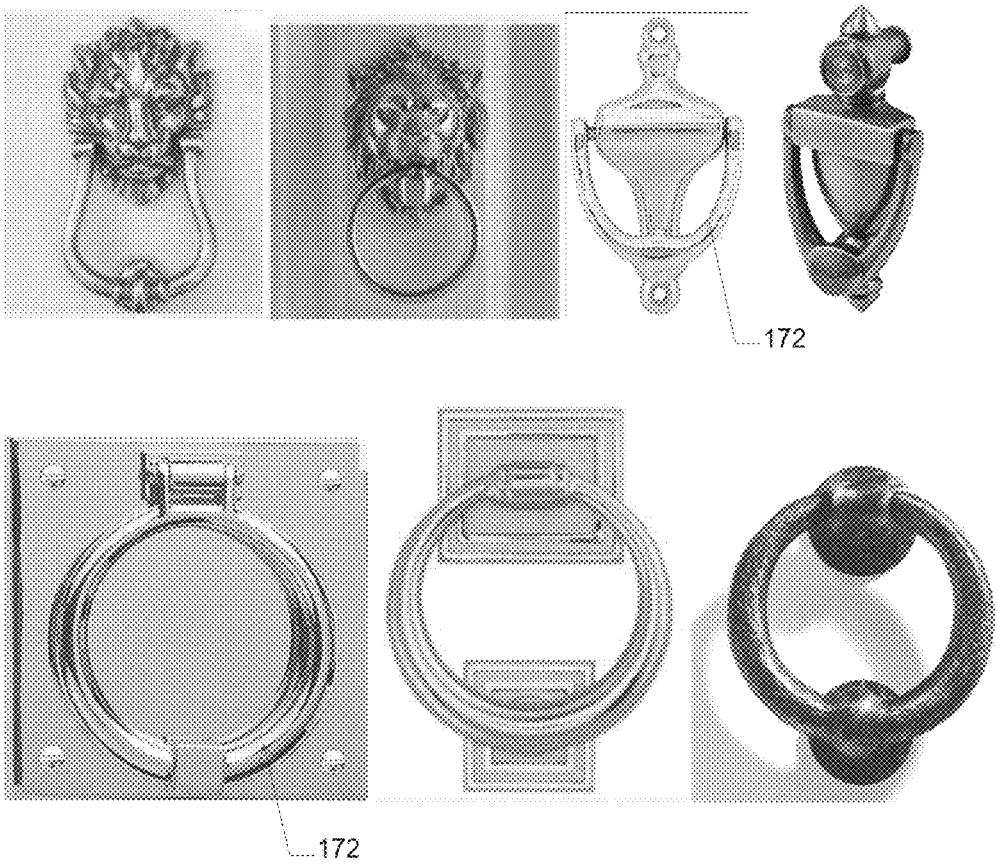

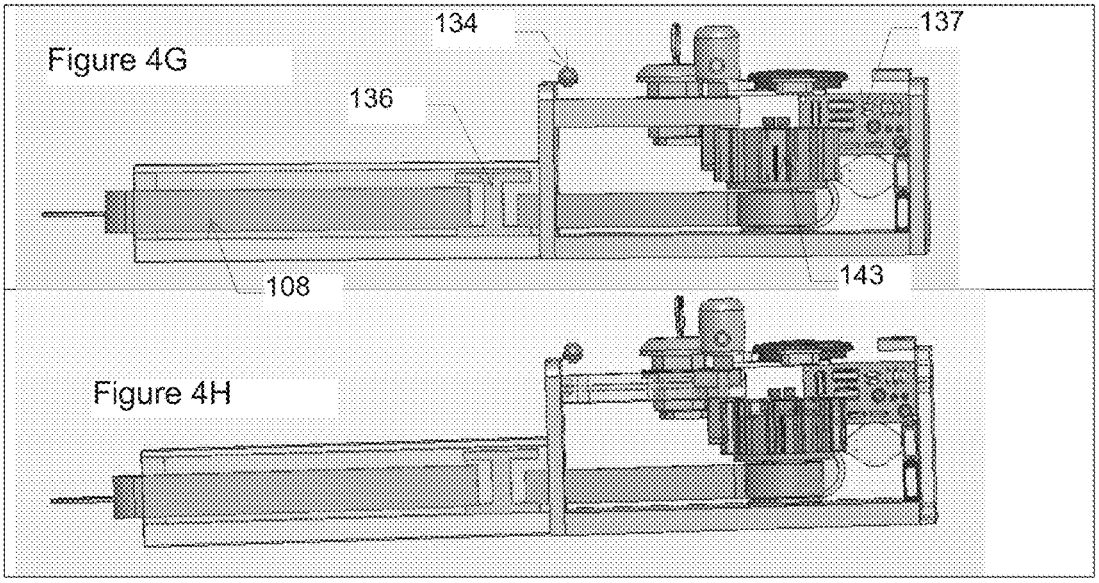
Figure 4G
134
137
136
108
143
Figure 4H
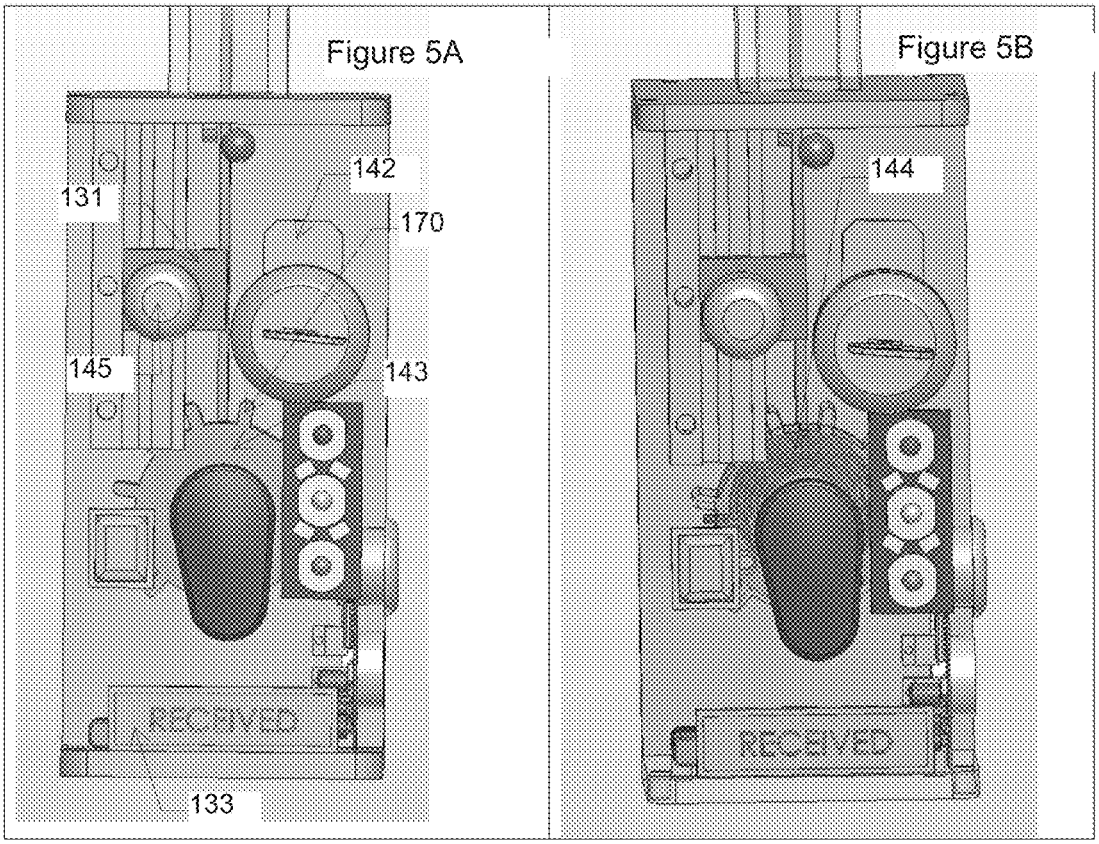
Figure 5A
142
131
170
145
143
133
Figure 5B
144

Figure 5E
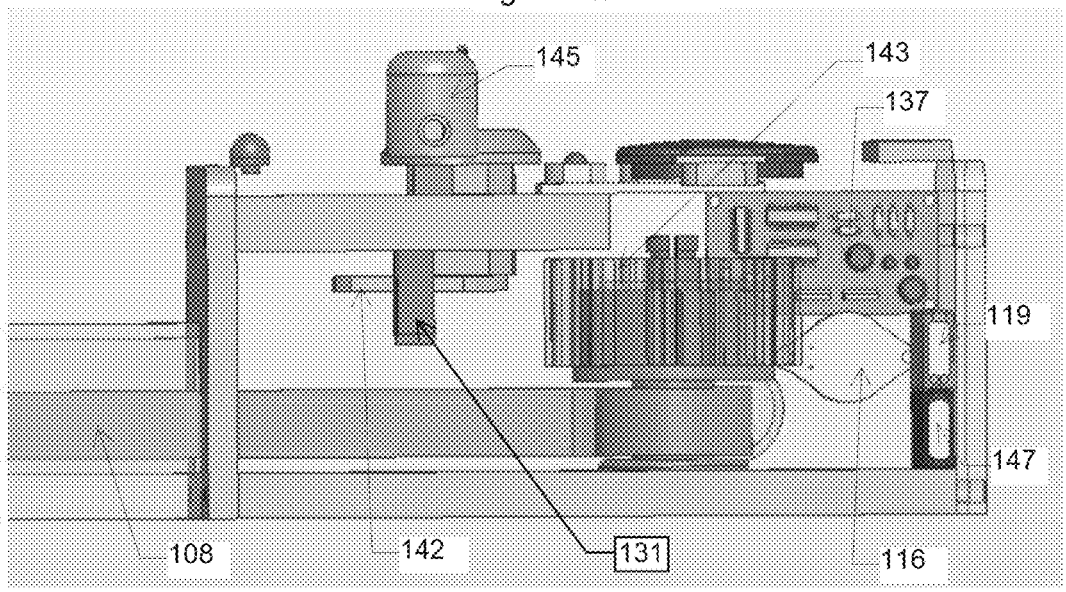
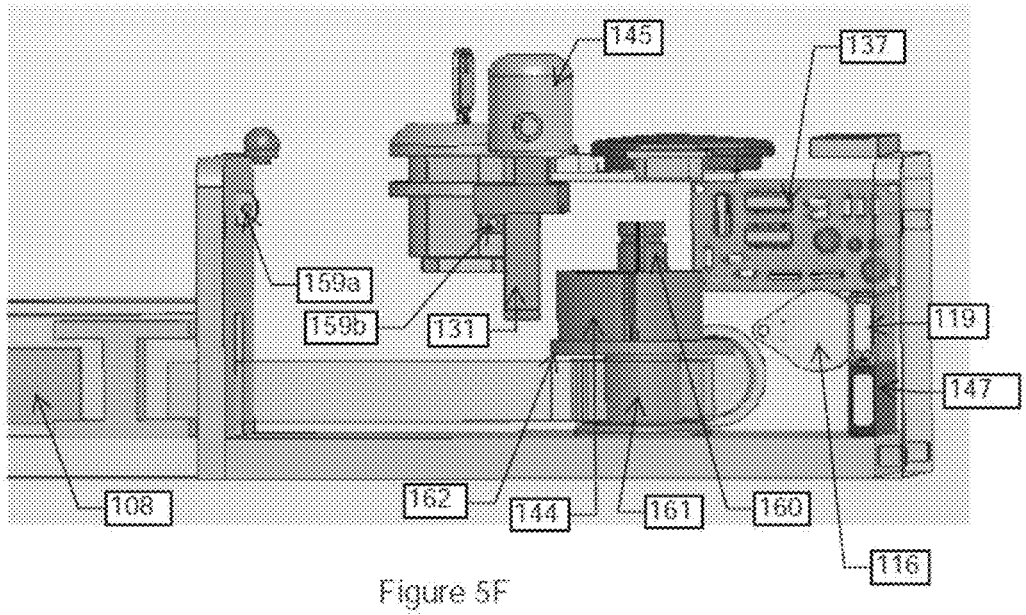
Figure 5F 141
136
108

159b
145
108
159a
131
170

131
142
170
108

Figure 8L
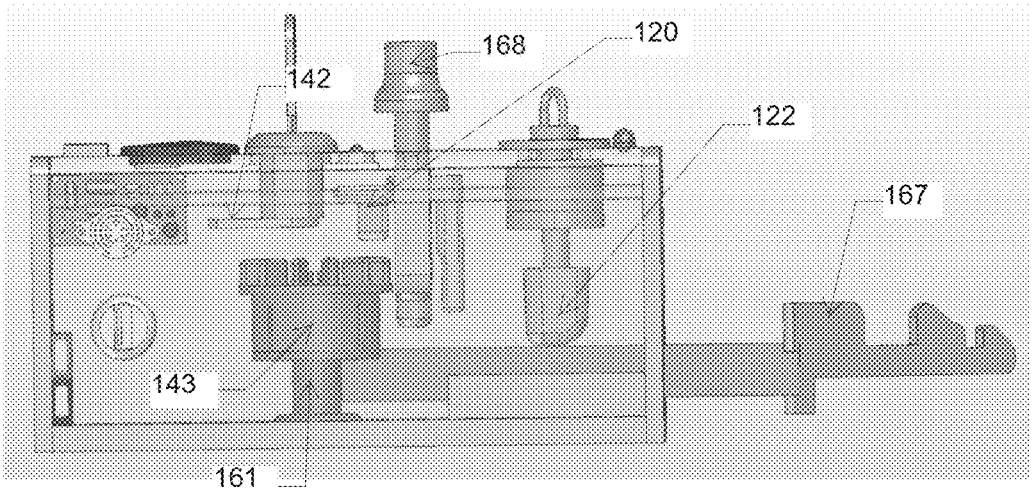
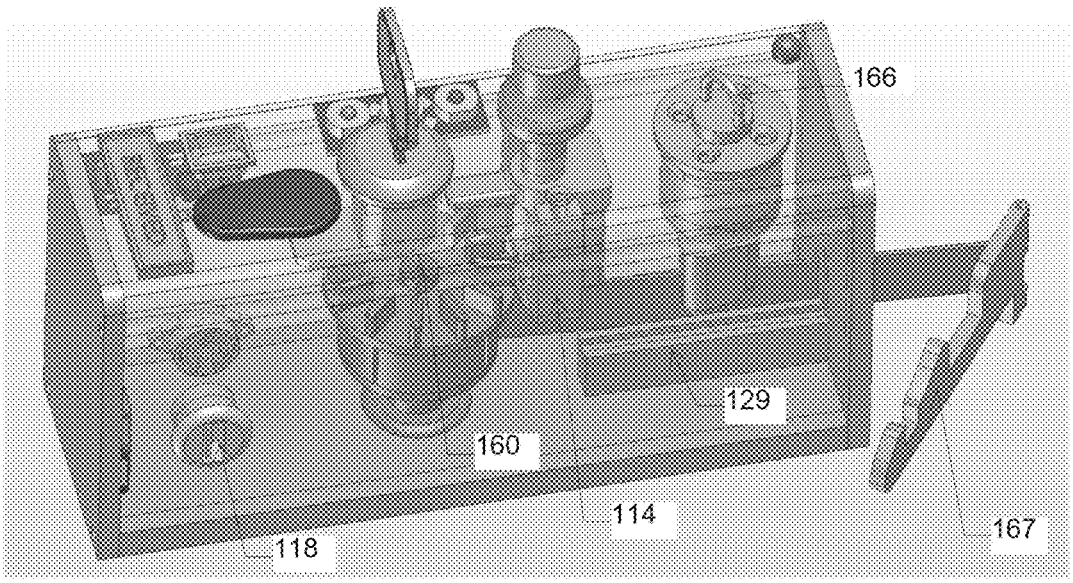
Figure 8M

Figure 9A
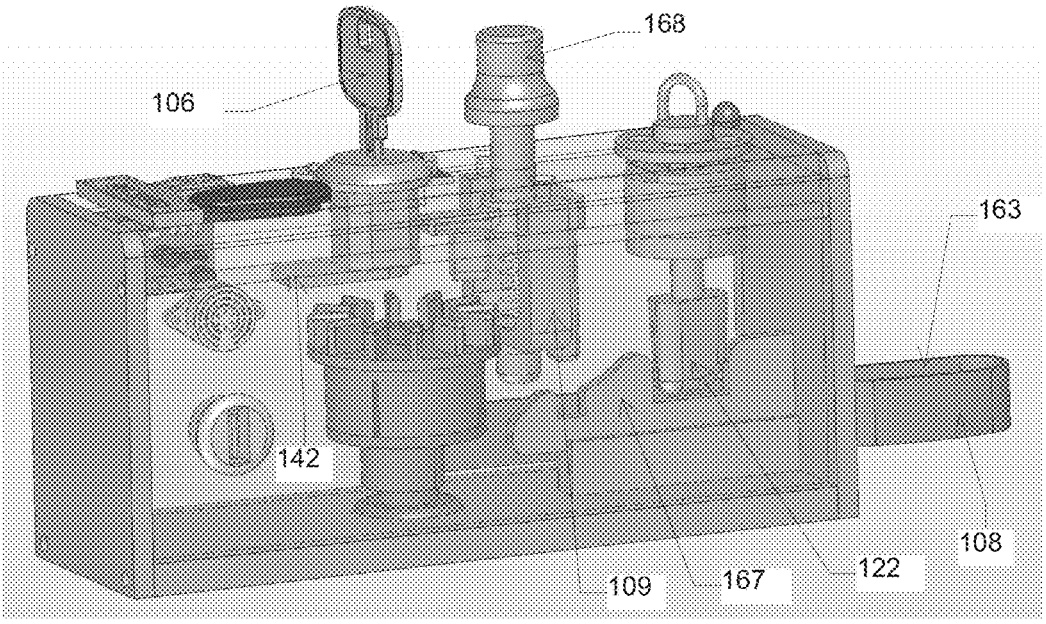
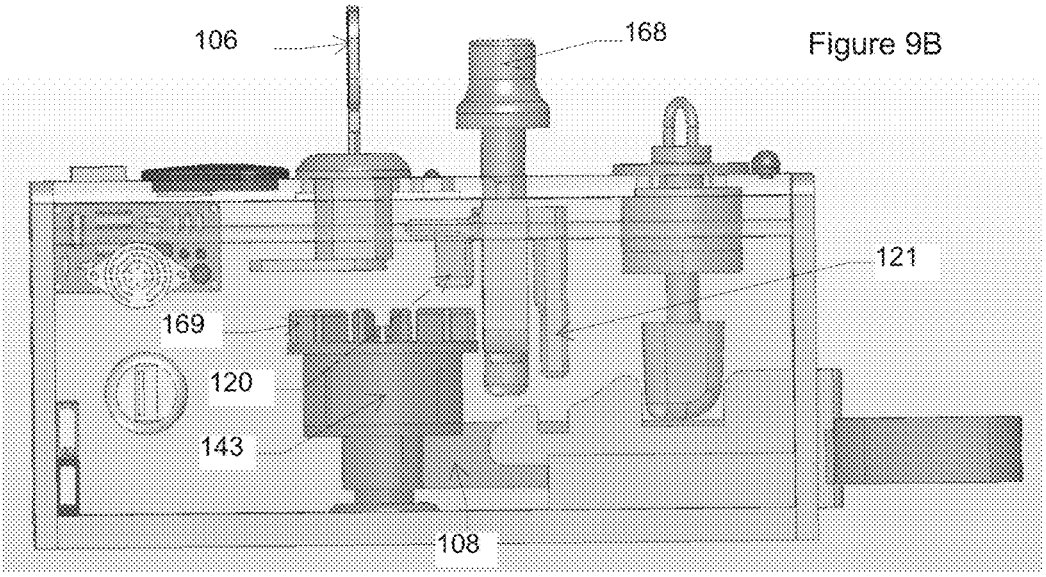
Figure 9B

Figure 9C
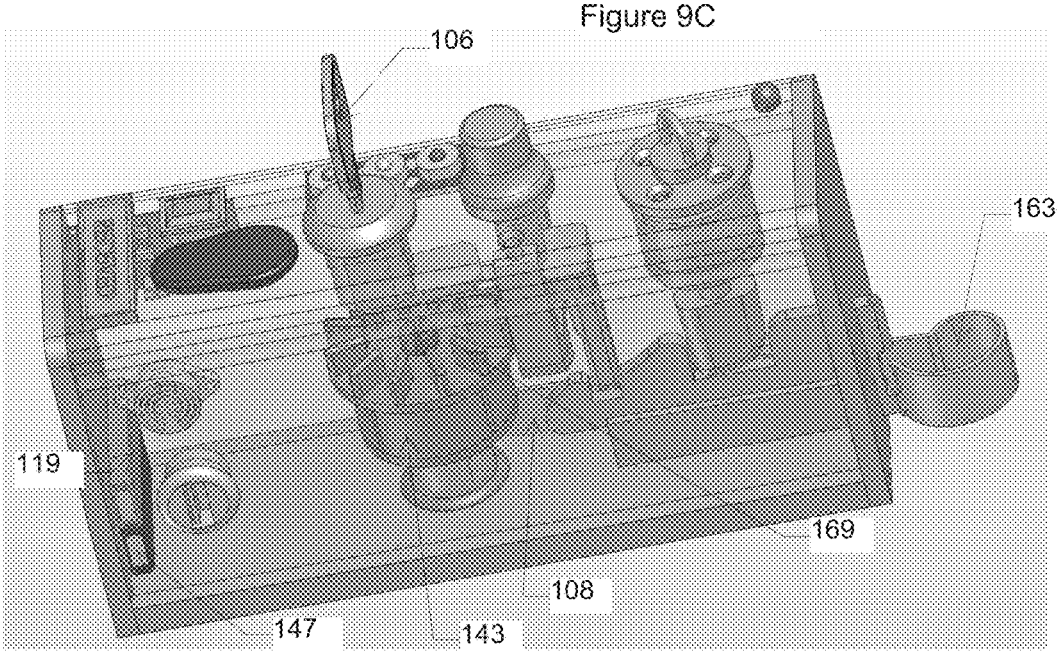
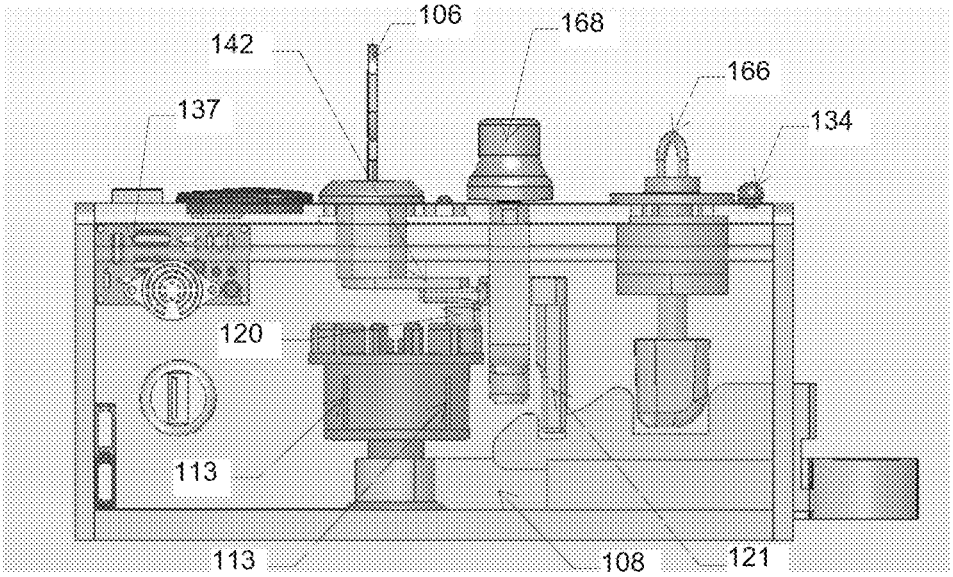
Figure 9D

Figure 10
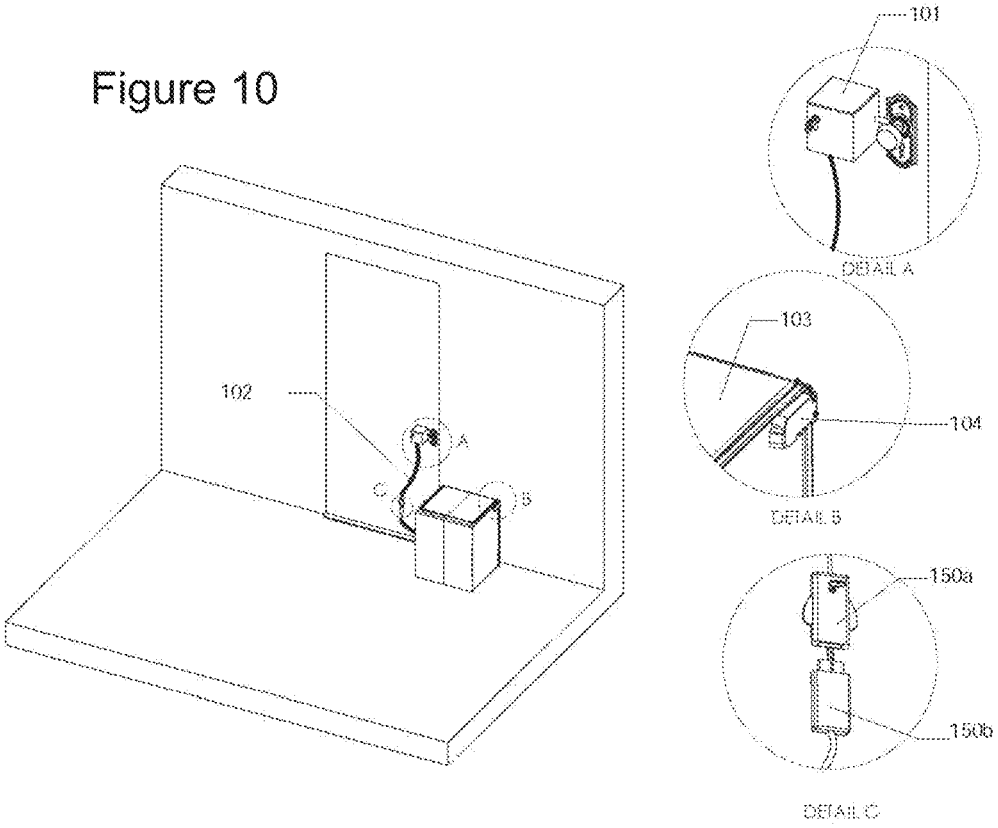
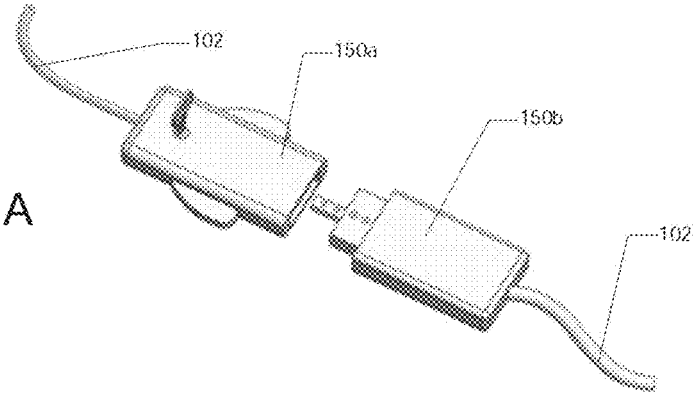
Figure 11A
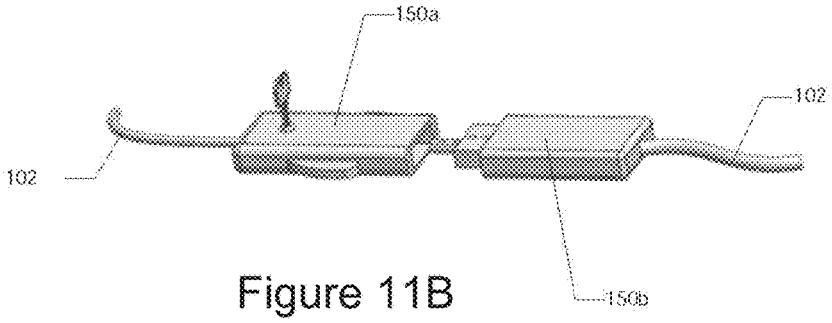
Figure 11B

Figure 12D
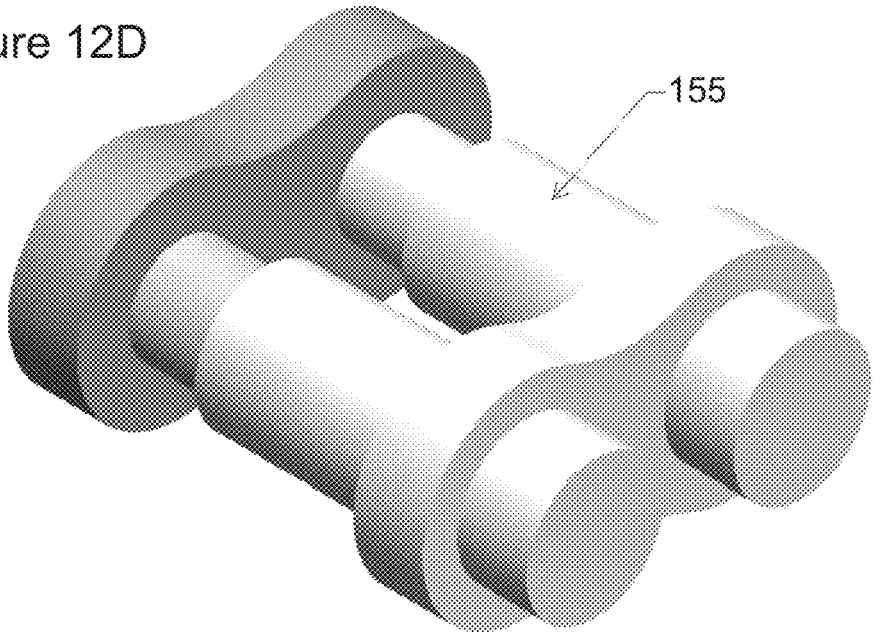
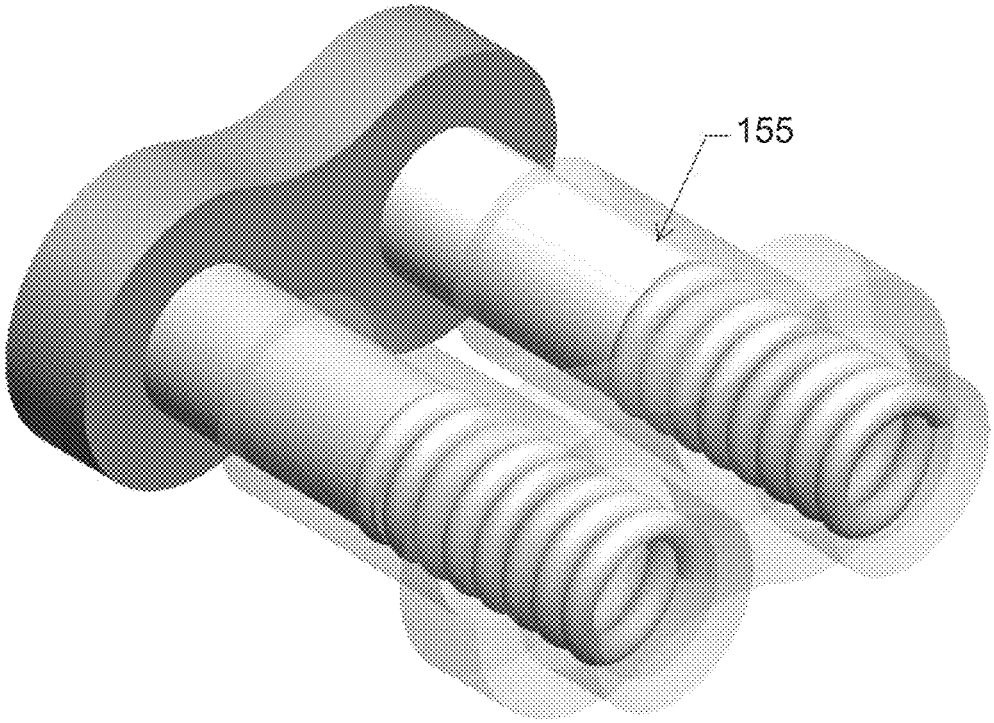
Figure 12E

METHODS, APPARATUS AND SYSTEMS FOR ACCEPTING, RETURNING OR EXCHANGING PARCELS AND DELIVERIES

CROSS-REFERENCE TO RELATED APPLICATIONS

This application claims priority under 35 USC § 119(e) to the following applications which are incorporated by reference for all purposes: PCT Application number PCT/US 15/25194, filed on Apr. 9, 2015, which claims benefit to U.S. Provisional Patent Application Ser. No. 61/980,644, filed on Apr. 17, 2014, and U.S. Provisional Patent Application Ser. No. 62/342,980, filed on May 29, 2016.

BACKGROUND

In the internet age, more and more consumers of the world rely on companies such as Amazon.com in the US, and many other online retailers in other parts of the World to shop, and to receive, return or exchange their parcels when they are away. They also depend on large carriers such as UPS, Fedex, DHL, Ontrac, etc. in the US, and similar popular carriers in other parts of the world. When the value of parcel increases and when the recipient is away, the delivery person often either chooses to leave a note at the front-door asking the recipient to collect the parcel at a later time from a nearby pick-up locations of the carrier, or attempts to re-deliver at a later point. Both these options cause tremendous time delays and inconvenience, and defeat the original objective of shopping online in a very time-efficient manner. Past attempts to solve the problem of receiving deliveries while the recipient is away at work or outside their temporary or permanent residences or place of their businesses have been unsatisfactory.

Additionally, many luxury apartment complexes, hotels and other places of stay do not allow their residents to permanently alter or do anything outside their front door to help the resident(s) to securely receive, return or exchange parcels delivered by UPS, FedEx, DHL, onTrac or any other mail carrier. In fact, many luxury apartments, in the hope of offering their elite residents a clutter-free appearance in the hallway and/or exquisite living experience in their property, have very strict rules, and impose many restrictions for living. Residents are not allowed to leave anything outside their front-door for any extended periods of time, and property managers frown upon and even impose fines on residents or occupants who violate any of their strict rules.

SUMMARY OF THE INVENTION

There is no invention that I am aware of, other than the invention of my own as patented in U.S. Pat. No. 9,364,112 issued on Jun. 14, 2016, to address the growing need to securely receive, return or exchange parcels in a practical manner. None of the existing inventions in my opinion adequately addresses all of the limitations and constraints for practical implementations. In addition, none of them include many of the features of my invention. The various embodiments of the present invention utilize objects such as doorknobs or door handles or door knockers or door or any kind of object that exist near the front door of a residence or business or any place of stay. The entire assembly or apparatus, which includes a novel security apparatus, can be quickly and easily, attached or detached to fulfill its intended function. A locking mechanism in a parcel receptacle allows the delivery personnel to deliver the package so that only the intended recipient is able to have access to the parcel. In cases where a customer or owner of the system/apparatus described in this invention wants to return a parcel, only an authorized agent or authorized personnel can access the parcel in the parcel receptacle by utilizing one or more of secure unlocking mechanisms described elsewhere in this invention. An audible alarm with a speaker can sound to deter any attempted unauthorized tampering to retrieve contents of parcel receptacle. The invention, in embodiments where appropriate, uses a tamper-proof cable, rope or chain to secure the entire assembly. The various embodiments use flexible or rigid or semi-rigid parcel receptacle of varying sizes to accommodate receipt of most common sizes of packages to suit typical shopping needs. Additionally, the parcel receptacle may be fixed in size, or may optionally have or employ an extension mechanism wherein the size and volume of the parcel receptacle can be increased or decreased to accommodate various sizes and needs of parcels. Additionally, to enable multiple deliveries or returns of parcels in a given day by multiple delivery personnel or carriers, multiple parcel receptacles can be configured to be connected securely so as to fulfill the intended objectives.

DESCRIPTION OF THE DRAWINGS

The invention can be better explained and illustrated by reference to several Figures included herein. For ease of understanding, visualization and explanation, significant number of parts and components are numbered and referenced in many of the included Figures. These numbered parts and components are described and explained in great detail in Table 1 in a sequential fashion for ease of reference. In addition, the numbered parts and components are explained where appropriate in other relevant sections of this application also.

FIG. 1A shows examples of typical circular doorknobs. FIG. 1B shows examples of typical straight-shaped doorknobs. FIG. 1C shows examples of various typical door handles. FIG. 1D shows examples of typical door knockers. The various embodiments described in this invention, can be installed on any of these doorknobs or door handles or door or any object that exhibits properties and characteristics similar to these objects so as to be utilized to receive, return or exchange a parcel securely.

FIG. 2A shows how a security apparatus (101), a tamper-proof cable (102) and a parcel receptacle (103) can all be configured and connected together to securely receive, return or exchange a parcel. A parcel receptacle locking mechanism (104) is also shown to describe how a parcel can be secured in a simplistic way.

For the purposes of this invention, the word "cable" as used anywhere in this document denotes a generic component member made of metal or non-metal, of sufficient strength, flexibility and characteristics to suit the intended application. The word "cable" could refer to a rope or chain or cable, of any suitable material. And some portions of the cable can be rigid and some portions can be flexible, and non-rigid. The cable when used around a doorknob shall have flexibility, strength and characteristics so as to form a tight loop around the doorknob so that no unauthorized individual is able to tamper or remove.

Figure 4A:
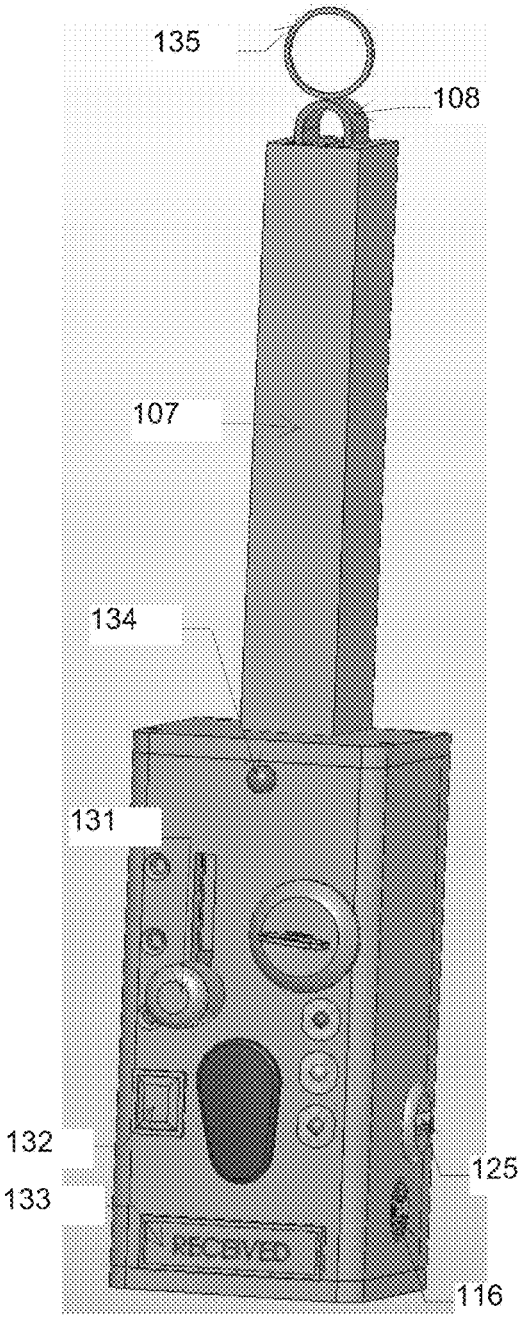
Figure 4B:
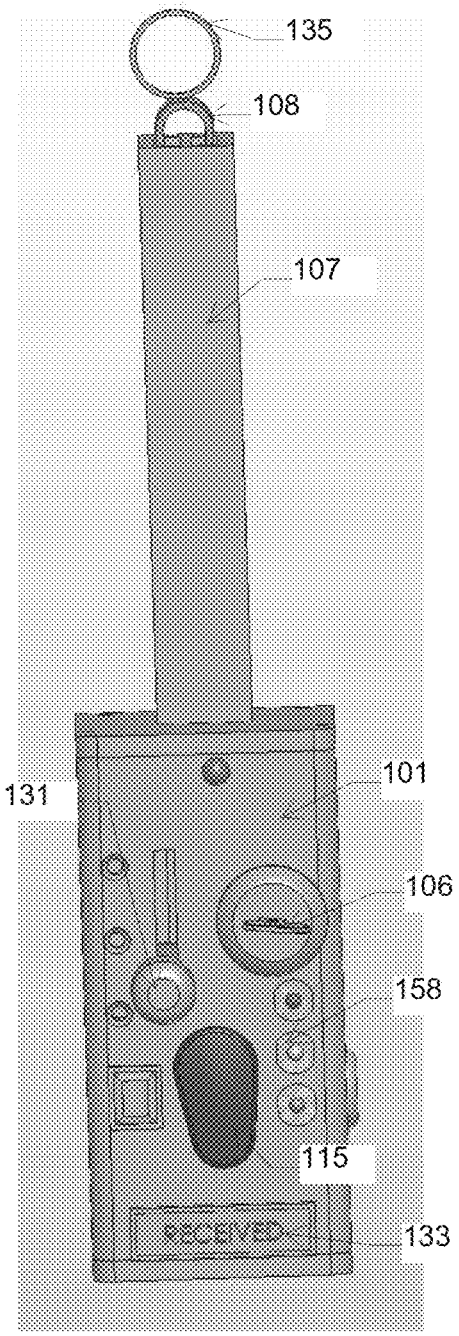

FIG. 4A and FIG. 4B show two views of the circular doorknob security apparatus from two slightly different angles when all surfaces are covered.

Figures 4C, 4D:
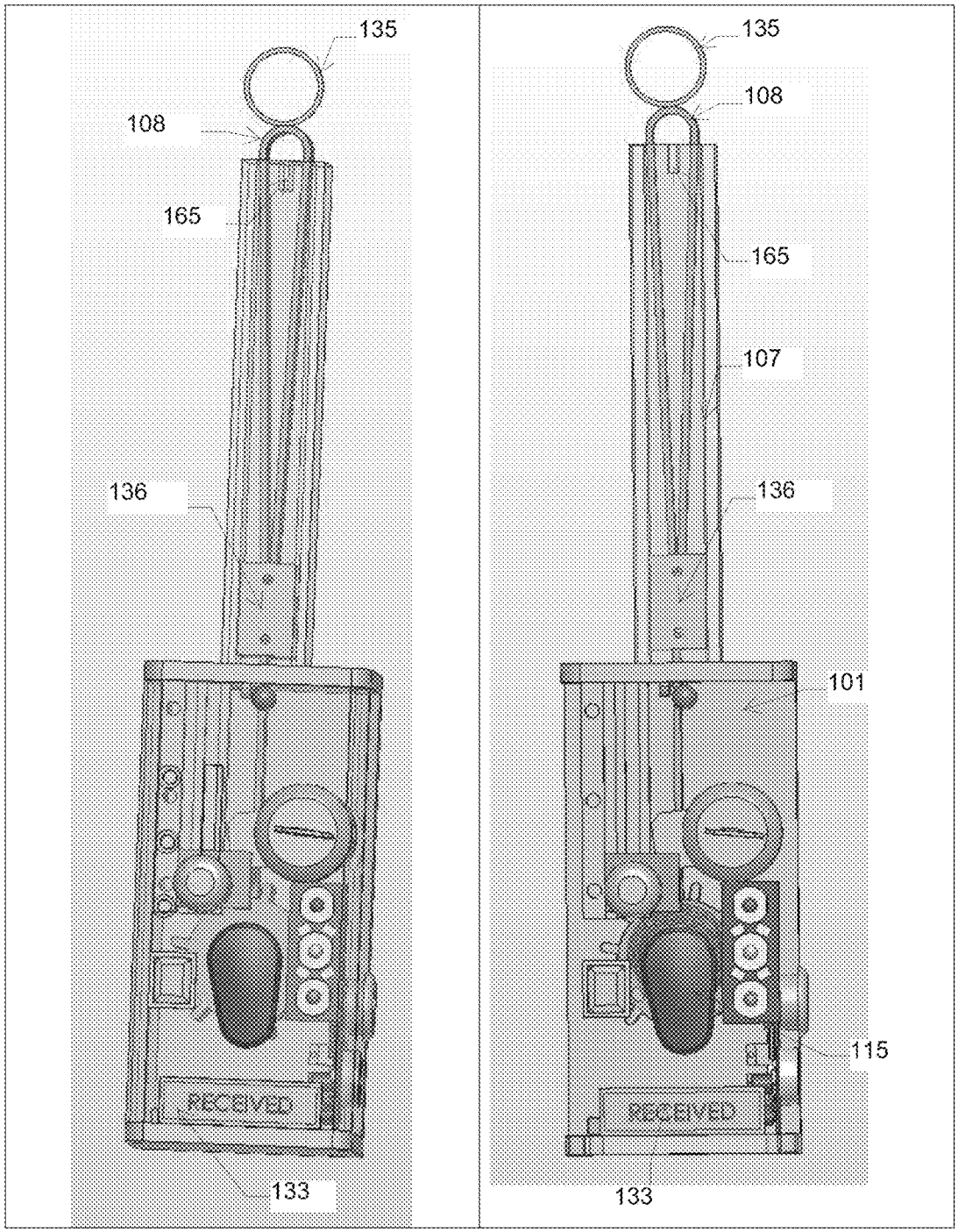

FIG. 4C and FIG. 4D show transparent views of the circular doorknob security apparatus from two slightly different angles. Because the external covered surface (101 and 107) are made transparent, most of the internal components are viewable in FIG. 4C and FIG. 4D.

Figure 4E:
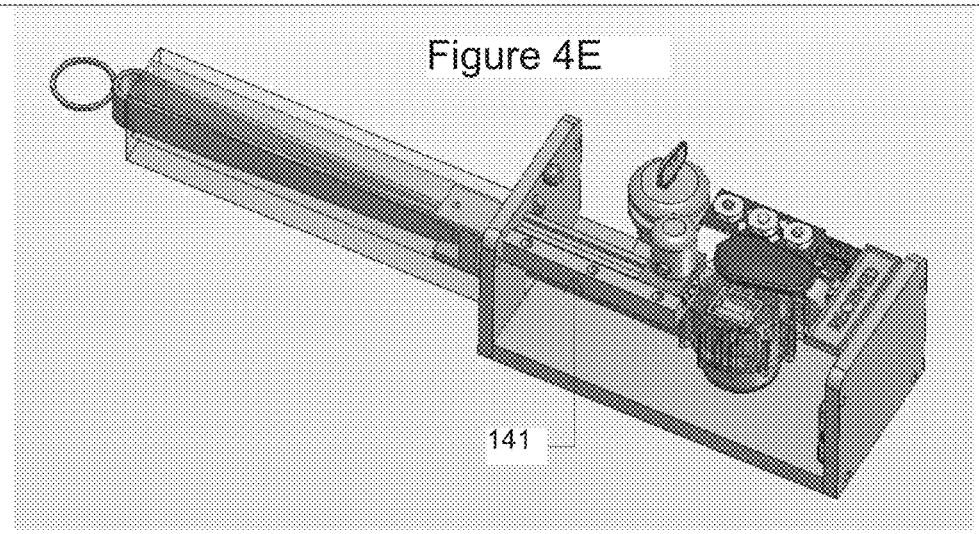
Figure 4F:
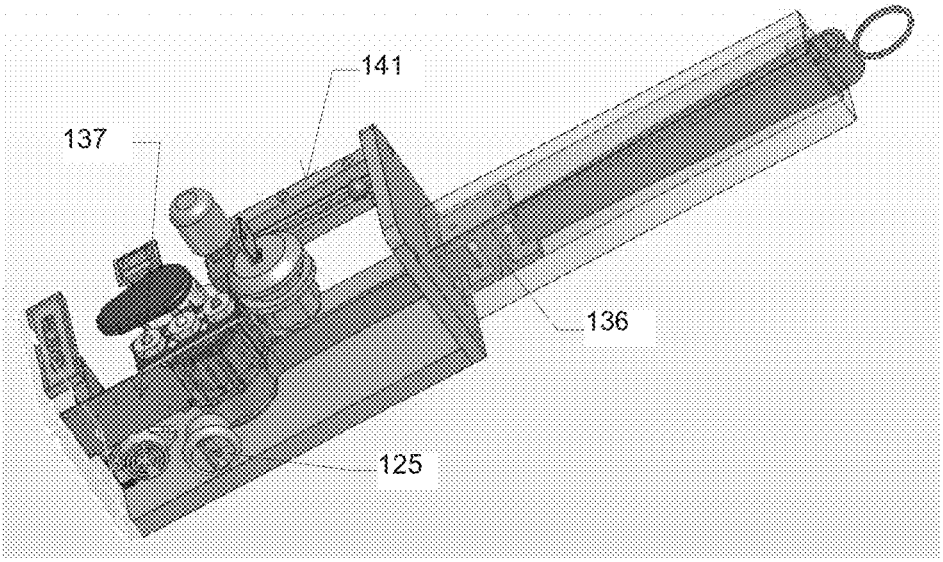

FIG. 4E and FIG. 4F show transparent views of circular doorknob security apparatus like FIG. 4C and FIG. 4D. In addition, to provide better clarity of parts inside, the cover (FIG. 4B, 101) of the bottom portion of the security apparatus is completely removed to provide a better visualization and a better understanding of internal parts. In this application, when a part number is referenced as (FIG. 4B, 101), it shall be interpreted that part number 101 can be seen in FIG. 4B.

FIG. 4G and FIG. 4H show horizontal views of the circular doorknob security apparatus, and in addition, to provide better clarity of internal parts, the cover (FIG. 4B, 101) of the bottom portion of the security apparatus is removed to provide a better visualization and to provide a better understanding of internal parts. Specifically, FIG. 4H shows an horizontal view of the coil spring (FIG. 5B, 144) inside by showing a transparent view of coil spring containing case (FIG. 4G, 143).

FIG. 5A and FIG. 5B show close-up views of the circular doorknob security apparatus. Specifically, FIG. 5B shows the coil spring (144) inside the coil spring containing case (FIG. 5A, 143). FIG. 5A also shows vertically-mounted fins (170) which prevent rotation of the coil spring containing case (143) when coil spring rotation arresting lever (131) is moved against the case (143) to lock such rotation.

Figure 5C:
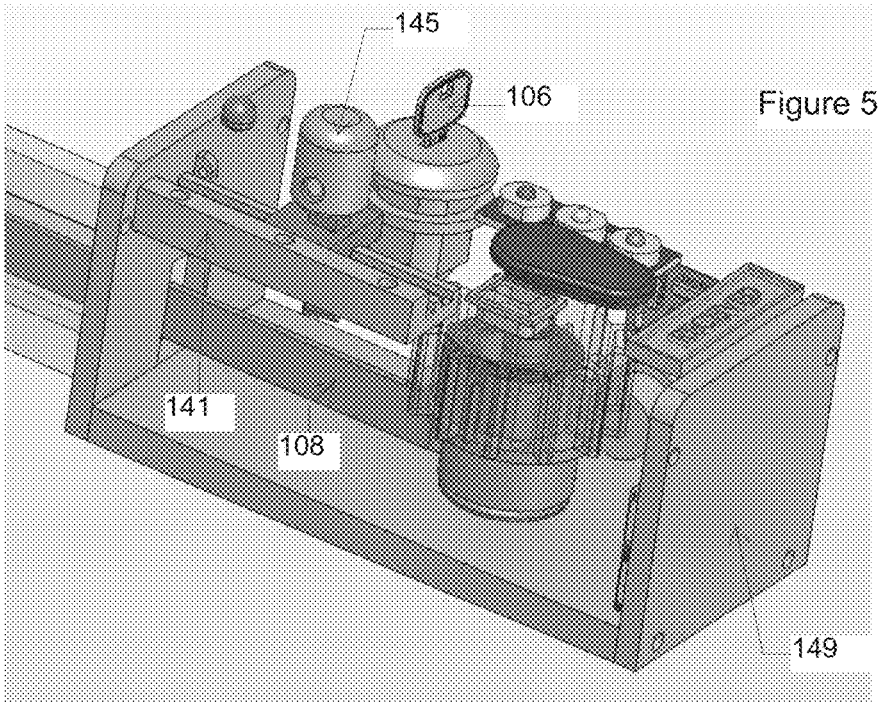
Figure 5D:
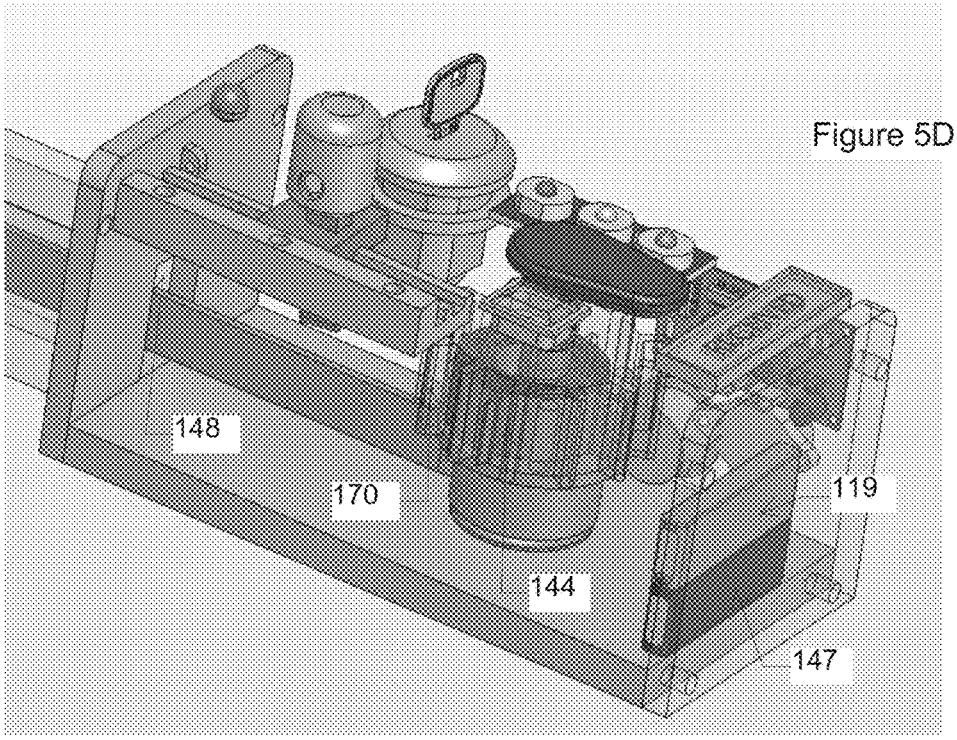

FIG. 5C and FIG. 5D show close-up views of the circular doorknob security apparatus from two different angles. Specifically, FIG. 5D shows the battery (119) and hard-drive (147) by making the bottom case (FIG. 5C, 149) transparent.

FIG. 5E and FIG. 5F show close-up horizontal views of the security apparatus from two slightly different angles. Specifically, FIG. 5E shows the coil spring containing case (143) transparently and FIG. 5F shows the circular coil (144) as it would appear when the coil containing case (FIG. 5E, 143) is completely removed to provide better visualization. In addition, FIG. 5E shows the circular doorknob security apparatus in open position as the coil spring rotation arresting lever (131) is far away from the coil containing case (143), and the locking pin (142) is turned away and wide open. However, in FIG. 5F, the locking pin (142) is turned by 90 degrees and is arresting the movement of coil spring rotation arresting lever (131), which arrests the rotation of coil containing case (143), thereby preventing the ability for the cable/chain/rope (108) to be pulled out.

Figure 6A:
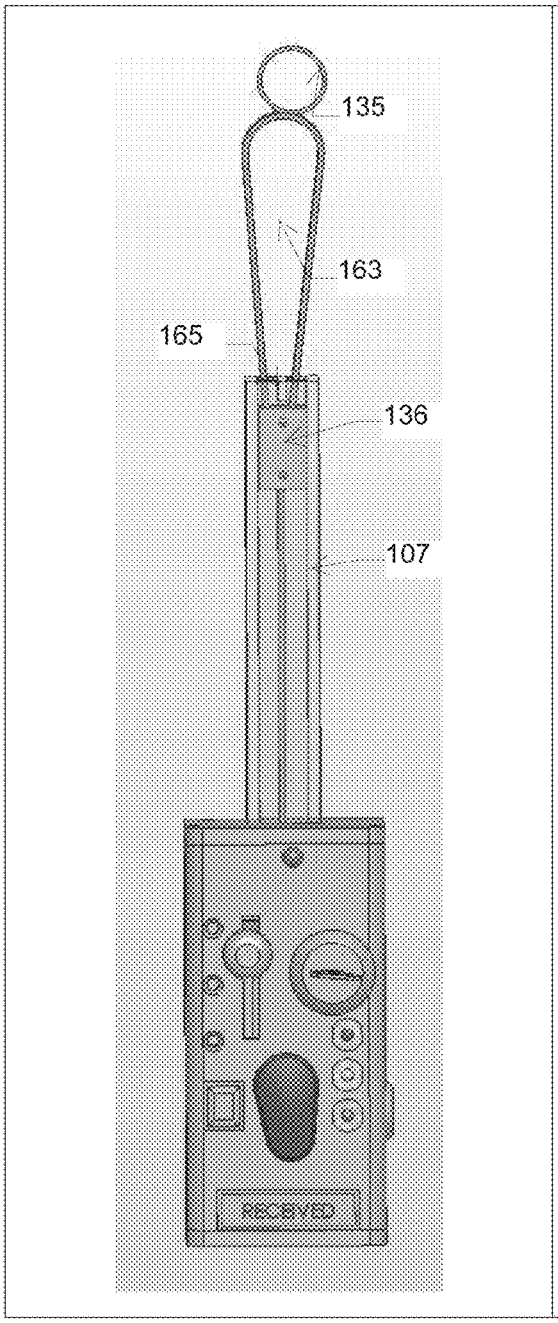
Figure 6B:
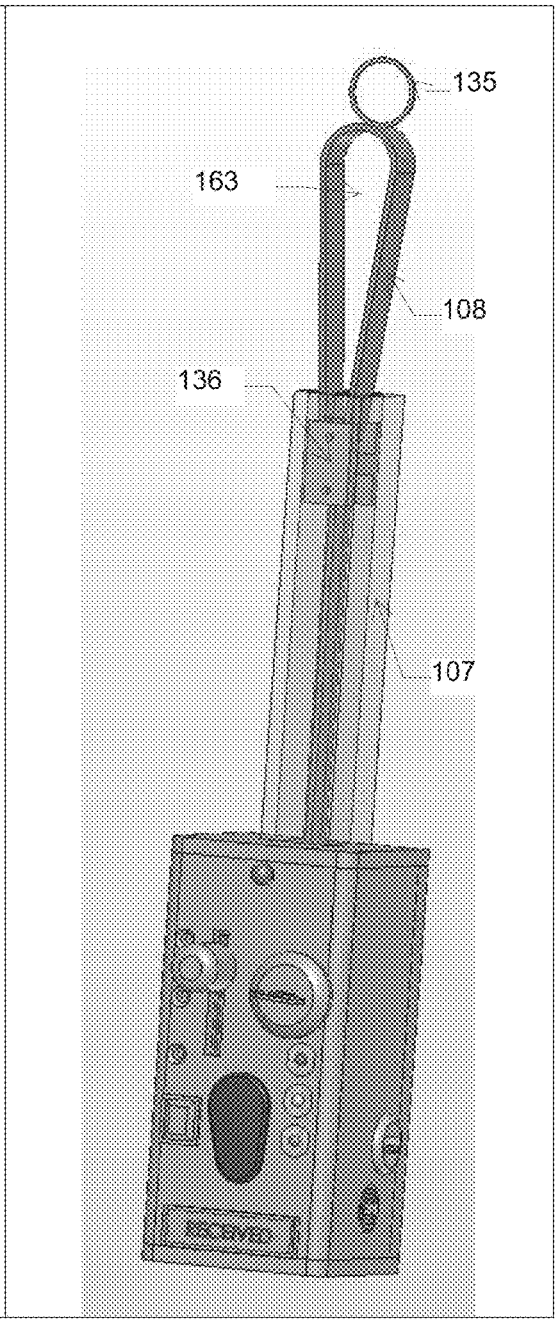

FIG. 6A and FIG. 6B shows from two slightly different angles the circular doorknob security apparatus when the cable/rope/chain is completely pulled out. As can be seen, the cable connector (136) is pulled all the way out and touches the cable stopper (165) which prevents further pulling of cable (108) by the chain handle (135).

Figure 6C:
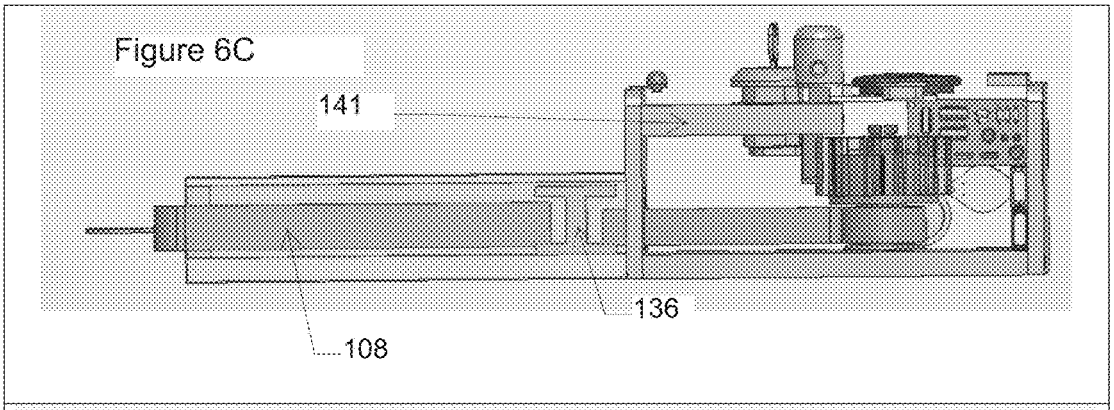
Figure 6D:
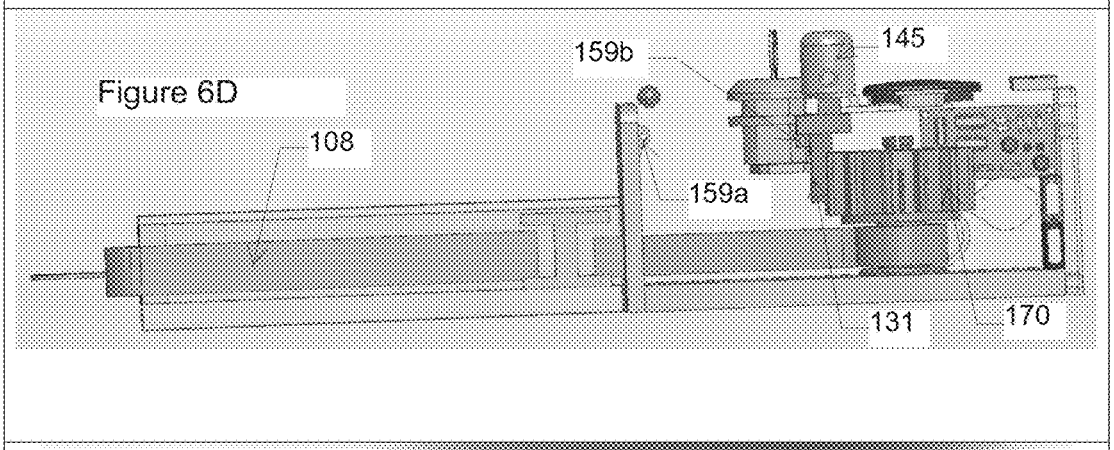
Figure 6E:
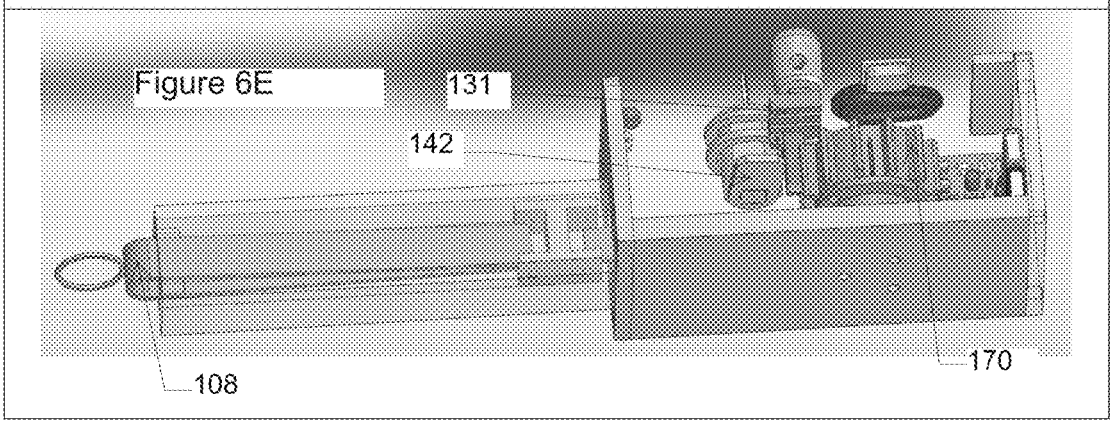

FIG. 6C, FIG. 6D and FIG. 6E shows when the cable/chain/rope (108) is retracted back and when the coil containing case (143) is in a locked position. In FIGS. 6C, 6D and 6E, the locking pin (142) is turned 90 degrees and is arresting the movement of the coil spring rotation arresting lever (131), which arrests the rotation of coil containing case (143), thereby preventing the ability for the cable/chain/rope (108) to be pulled out. Specifically, FIG. 6E shows a view from an angle from the bottom to show how the locking pin (142) and coil spring rotation arresting lever (131), arrests the rotation of vertically-mounted fins (170), thereby preventing the rotation of the coil containing case (143), which subsequently prevents the ability for the cable/chain/rope (108) to be pulled out.

Figure 7A:
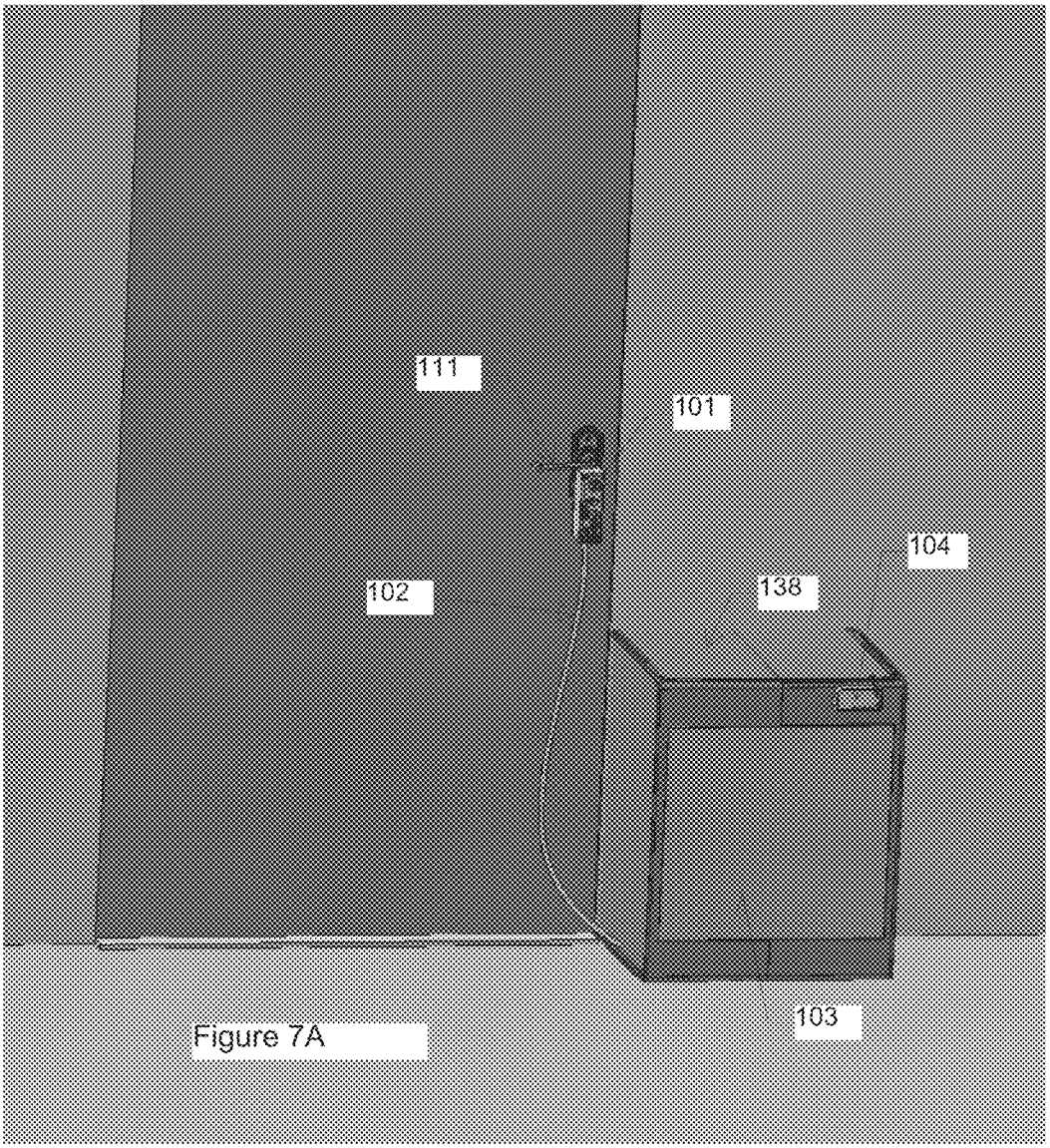
Figure 7B:
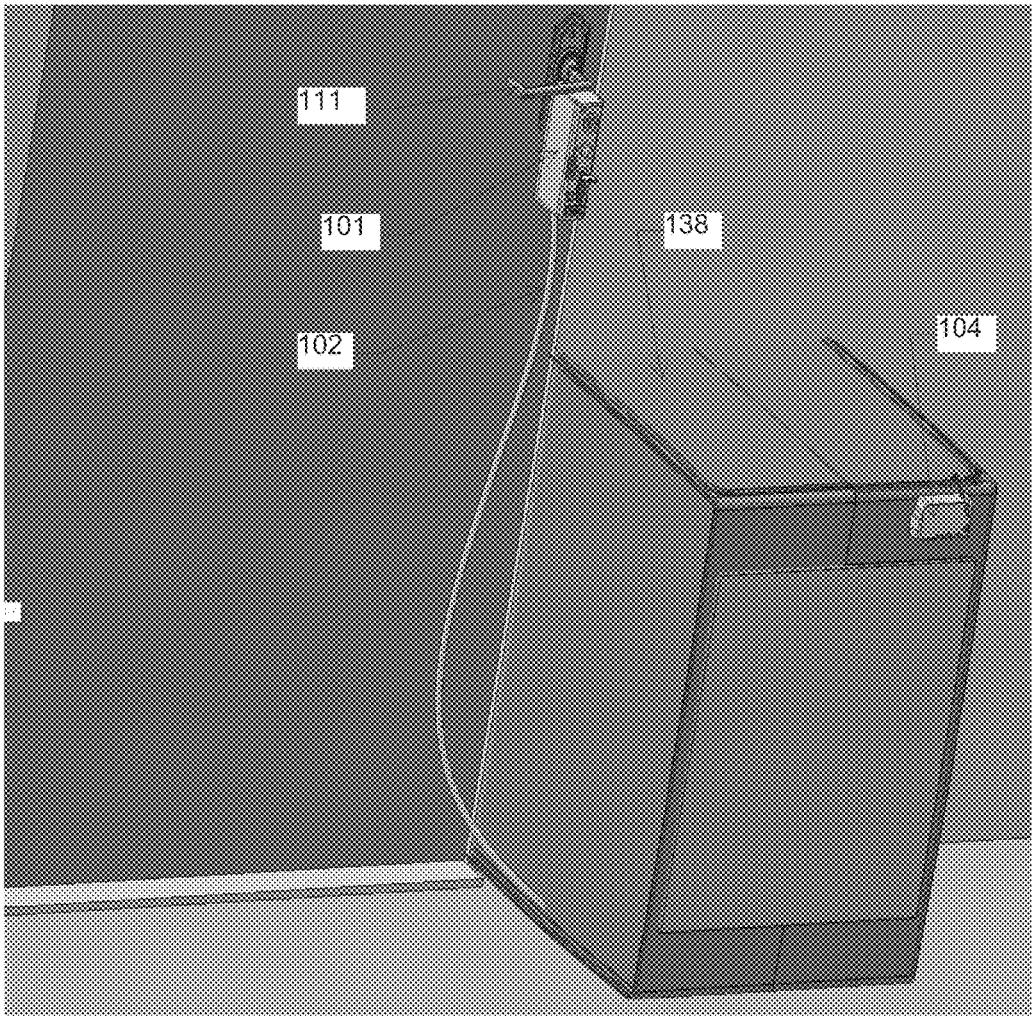

FIG. 7A illustrates the straight doorknob security apparatus and all key components that are typically connected to a straight doorknob during its operation. FIG. 7B shows an enlarged view of the straight doorknob security apparatus and all the associated components as it is connected to a straight doorknob.

Figure 8A:
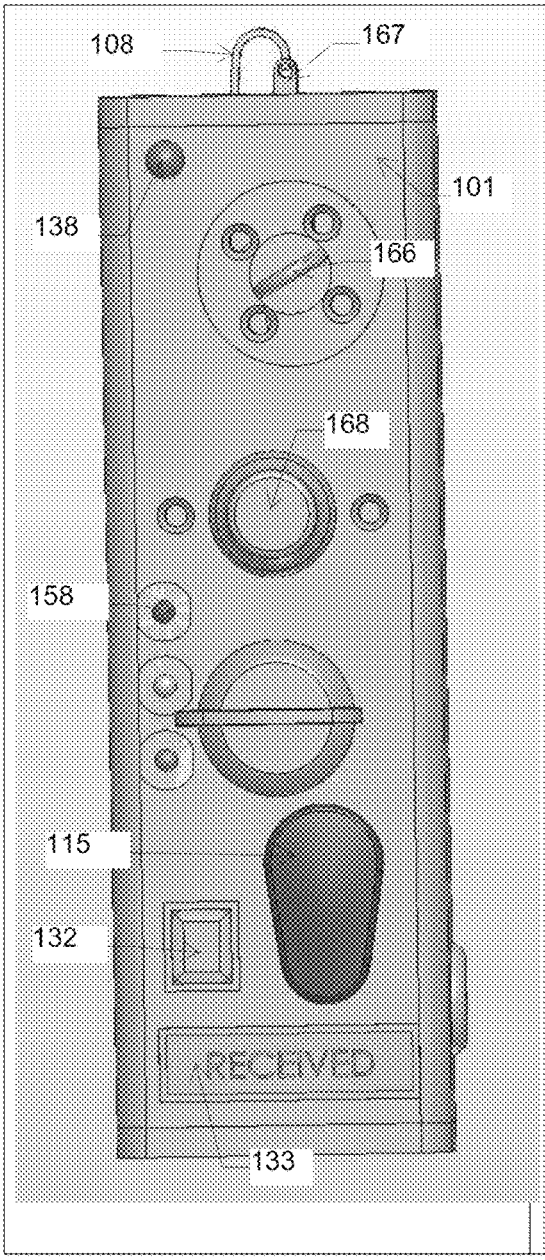
Figure 8B:
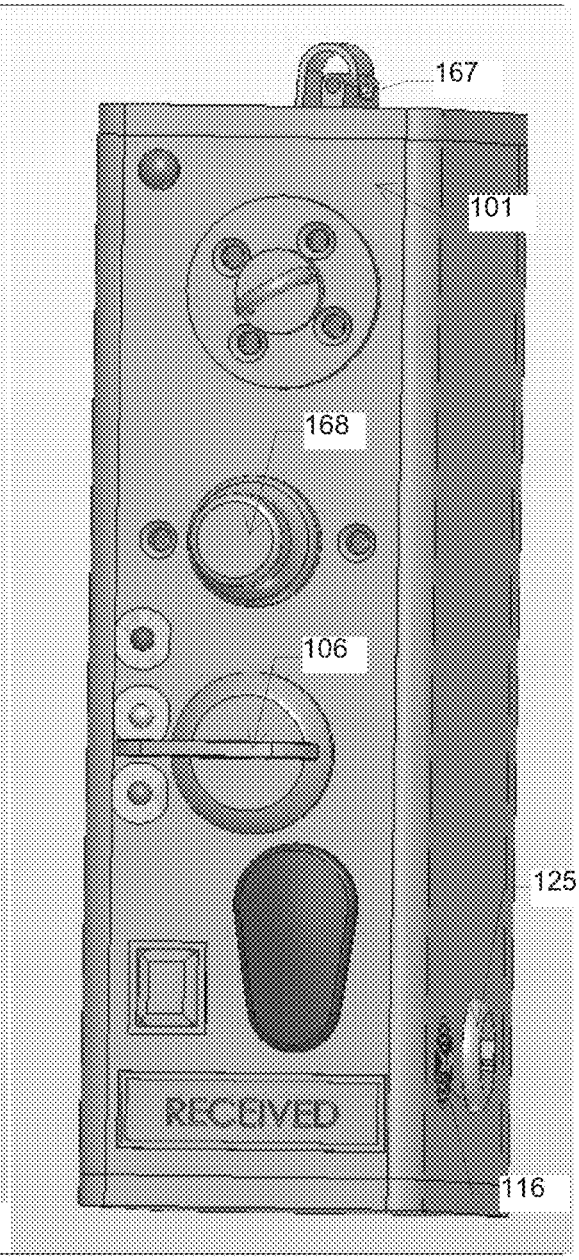
Figures 8C, 8D:
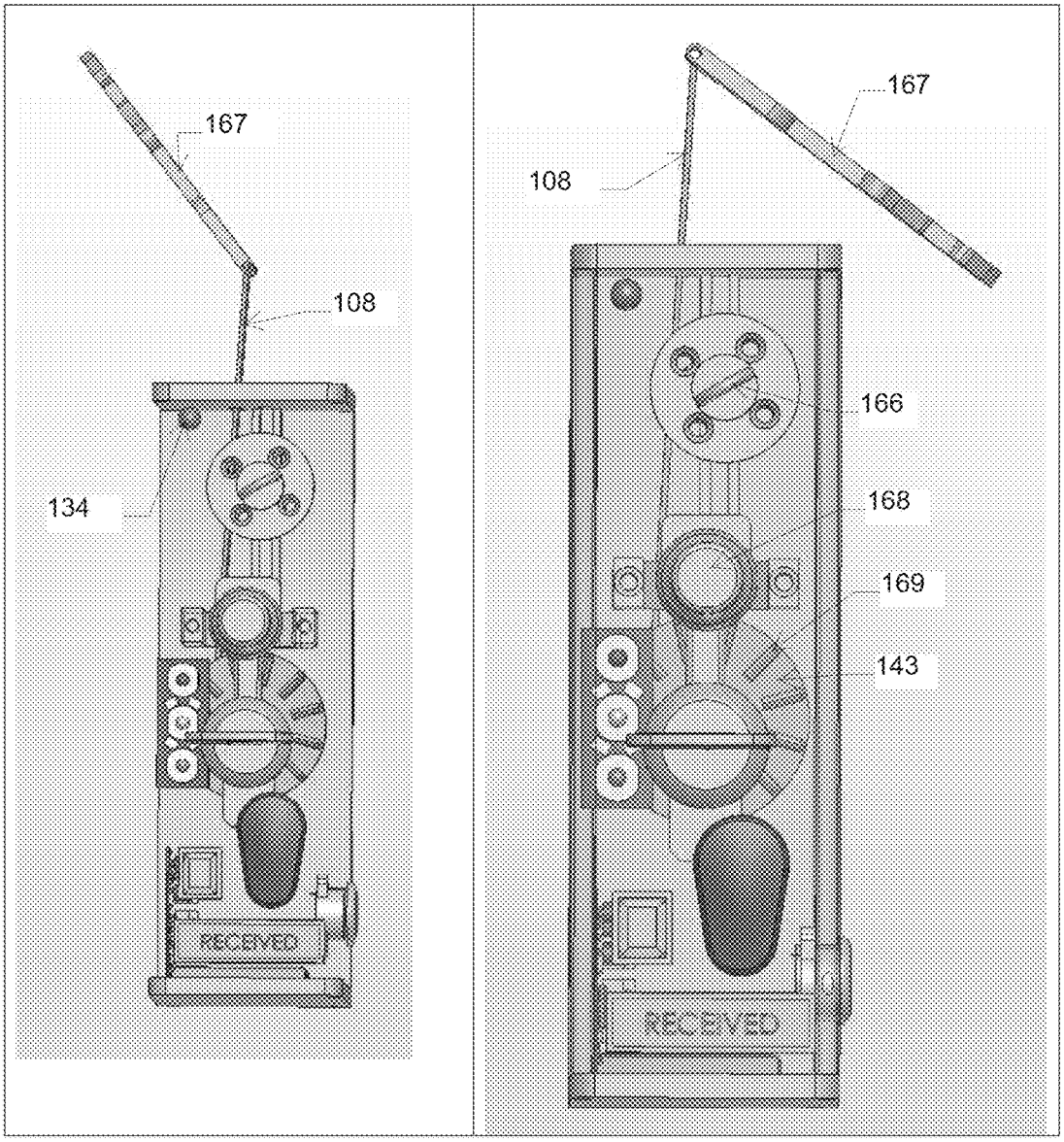

FIG. 8A and FIG. 8B show enlarged, close-up views of the straight doorknob security apparatus from two slightly different angles. FIG. 8C and FIG. 8D show close-up views of some of the internal parts and components of the straight doorknob security apparatus from two slightly different angles when the top cover (FIG. 8A, 101) is made transparent. Additionally, FIGS. 8C and 8D show the cable strap latch (167) in a loose position after it is pulled out of the housing and before it is ready to be wrapped around a straight doorknob tightly.

Figures 8E, 8F:
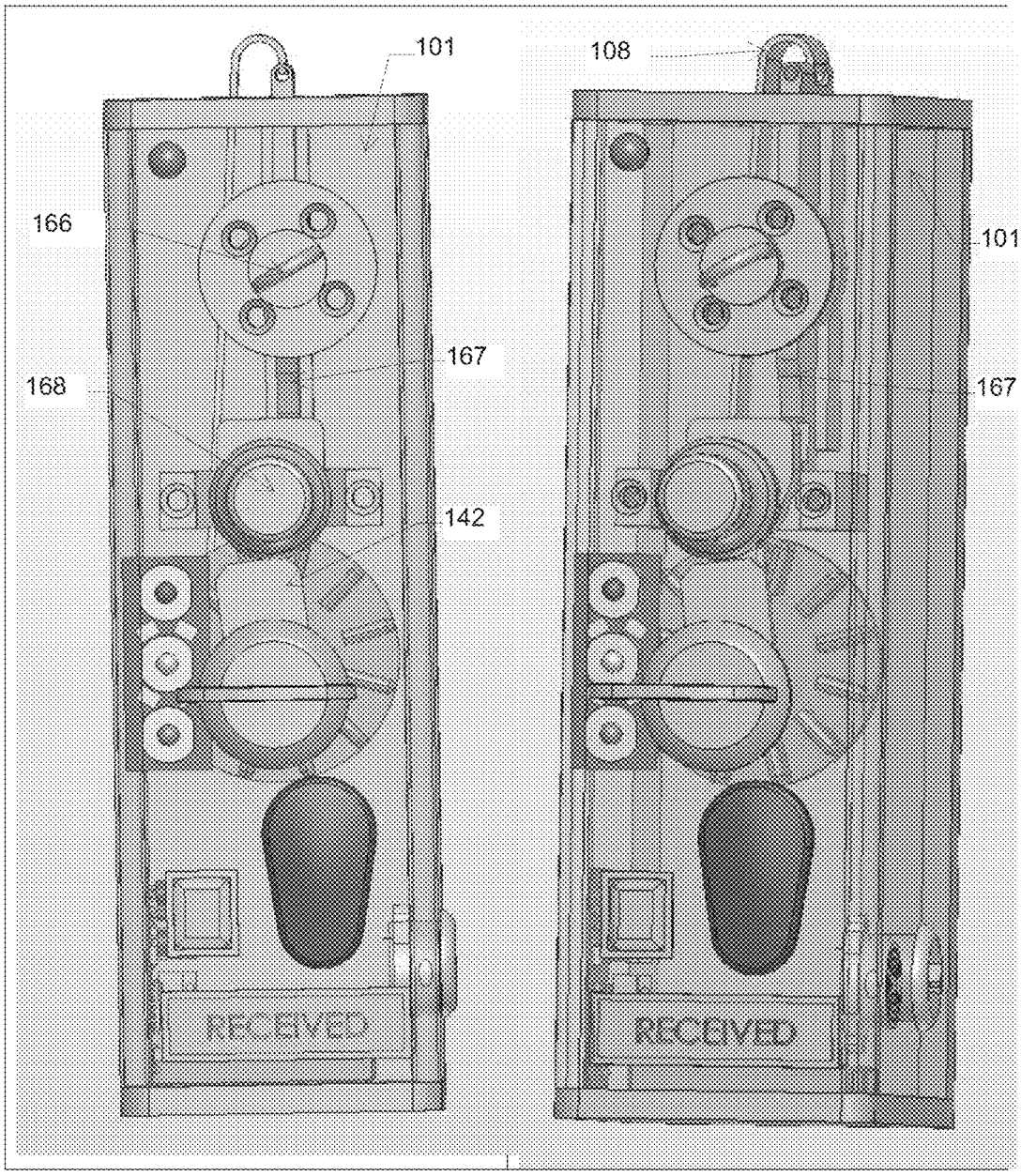

FIG. 8E and FIG. 8F show close-up views of some of the internal parts and components of the straight doorknob security apparatus from two slightly different angles when the top cover (101) of the straight doorknob security apparatus is made transparent. Specifically, in FIGS. 8E and 8F, the cable strap latch (167) is in a locked position tucked inside the security apparatus housing tightly.

Figure 8G:
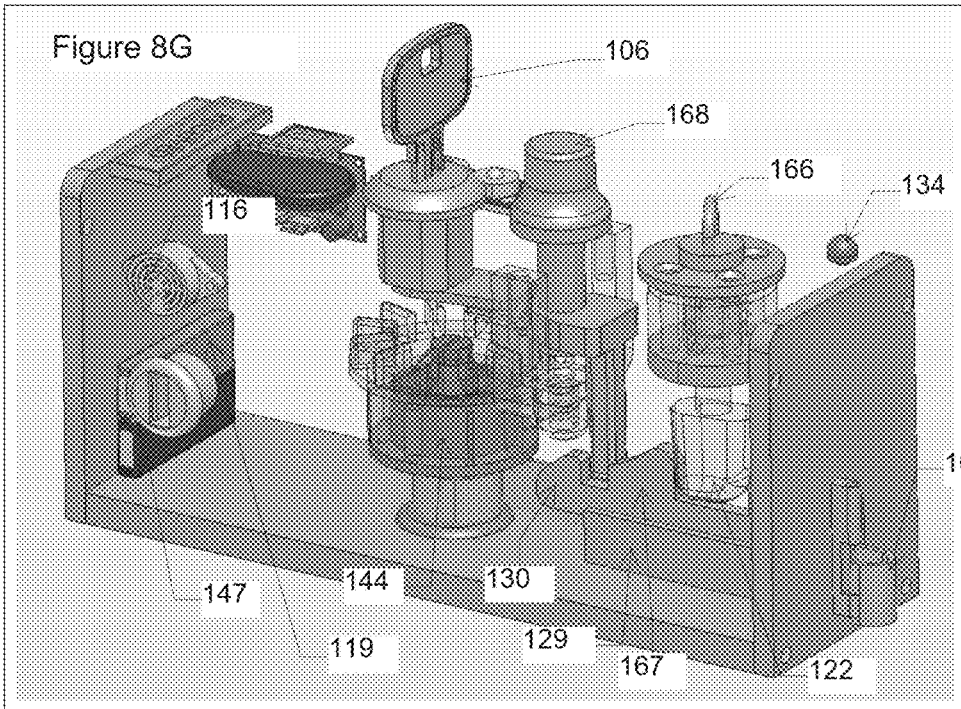
Figure 8H:
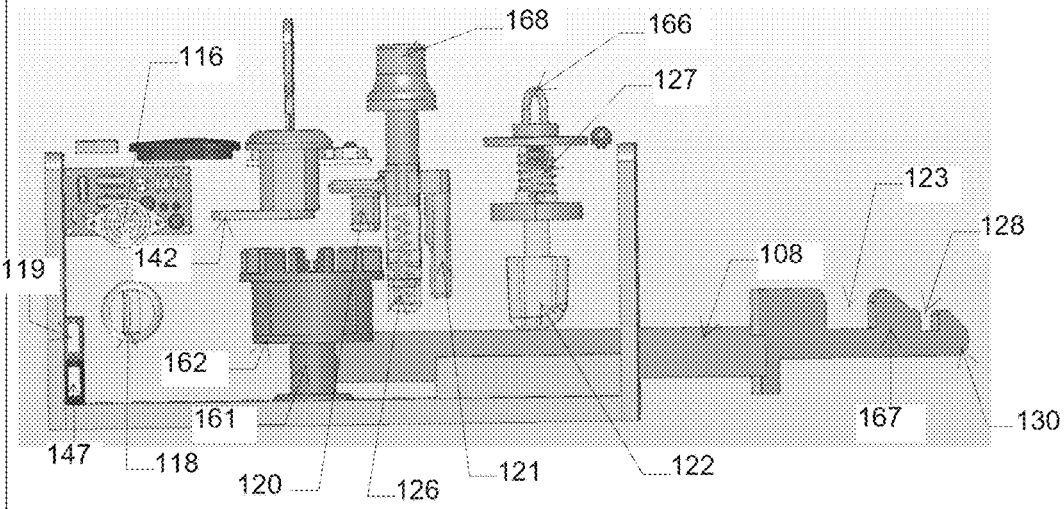

FIG. 8G shows an isometric view of the straight doorknob security apparatus. In this figure, the cable strap latch (167) is in a locked position. FIG. 8H shows a horizontal side view of the straight doorknob security apparatus. In FIG. 8H, the cable strap latch (167) is in an open, loose position. This figure also shows the pushable head (168), which is used to arrest rotation of coil spring case, in the up position. FIG. 8H also shows the locking pin (142), which is used to arrest the short lever (120) from rising up, in an open position away from the top tip of the short lever (120). FIG. 8H represents the configuration of short lever (120), locking pin (142) and tall lever (121), which allows pulling of the pulling lever (166) up, which subsequently pulls the slidable wedge (122) up, causing the wedge slot (123) to become unlocked and disengaged, thus allowing the cable strap latch (167) to be pulled out so as to enable it to wrap the cable/chain/rope (108) around a straight doorknob.

Figure 8I:
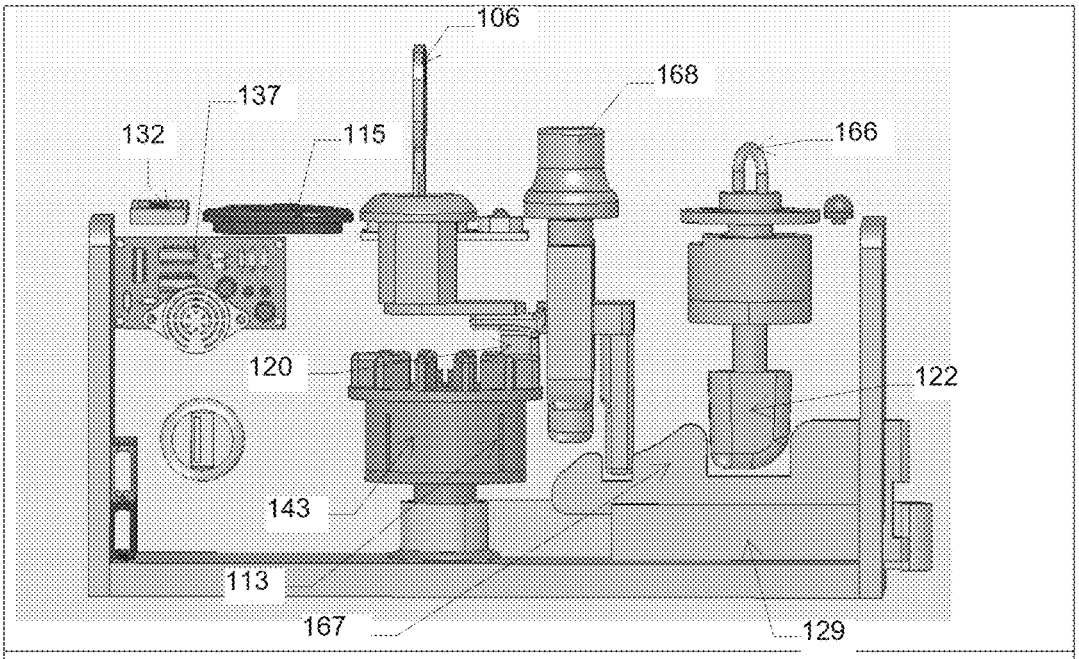
Figure 8J:
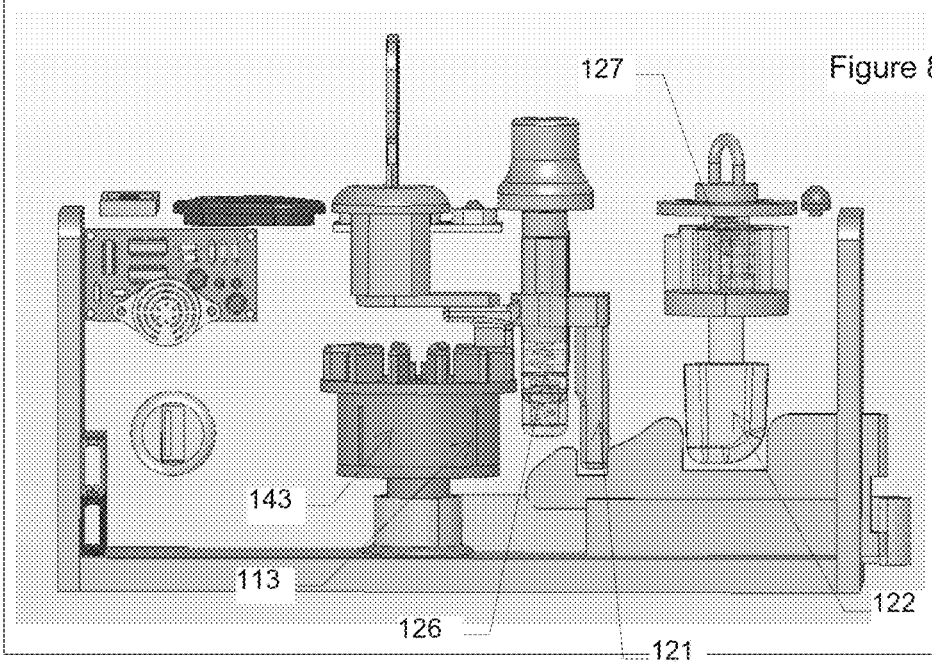

FIG. 8*i* shows a horizontal side view of the straight doorknob security apparatus. FIG. 8J shows a horizontal side view of the straight doorknob security apparatus and in addition shows transparent views so as to view the tall lever spring (126) and wedge spring (127) located inside their respective housing. FIG. 8J shows the tall lever spring (126) in a compressed state, and if the locking pin (142) is turned away, it would release and allow both the short lever (120) and the tall lever (121) to move up, thereby allowing rotation of coil spring containing case (143) and unlocking of cable strap latch (167), respectively.

Figure 8K:
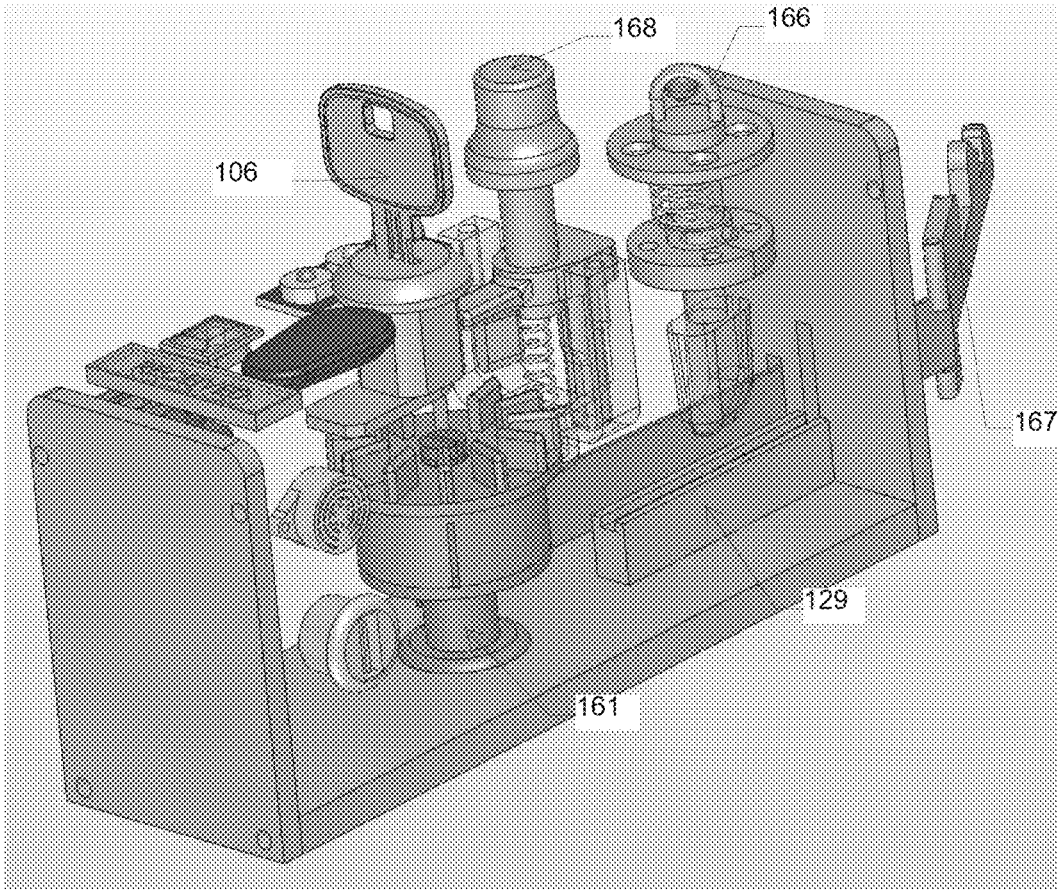

FIG. 8K shows an enlarged view of a straight doorknob security apparatus in an open position. FIG. 8L and FIG. 8M show the straight doorknob security apparatus from two different angles, wherein the cable strap latch (167) is loose, pullable, and in an open position.

FIG. 9A, FIG. 9B, FIG. 9C and FIG. 9D show views of the straight doorknob security apparatus from four different angles, wherein the cable strap latch (167) is in a locked position. The space (163) is where a typical straight doorknob goes in and gets wrapped around by the cable (108) and the cable strap latch (167). However, in these figures, the straight doorknob itself is not displayed for ease of viewing other parts and explanation. FIG. 9A and FIG. 9B shows the locking pin (142) turned away from the short lever (120) in an unlocked position, and short lever (120) and tall lever (121) in up positions which represent their respective unlocked positions. In FIG. 9B, when pushable head (168) is pressed down, the short lever (120) moves down and arrests the rotation of horizontal-fins (169), which subsequently arrests the rotation of coil spring containing case (143), which subsequently arrests movement of the cable (108). FIG. 9C and FIG. 9D show all of the locking pin (142), short lever (120) and tall lever (121) in locked positions.

FIG. 10 provides a high-level illustration of a circular doorknob security apparatus wherein several key components are shown. The main objective of this figure is to illustrate the functionality and purpose of a lock and key mechanism (150*a*, 150*b*) wherein individuals can purchase any size of parcel receptacle and can use it with one set of security apparatus by simply disconnecting one size of parcel receptacle and connecting another size of parcel receptacle to the security apparatus. FIG. 11A and FIG. 11B are two enlarged views of the lock and key mechanism (150*a*, 150*b*) from two different angles for better visualization.

Figure 12A:
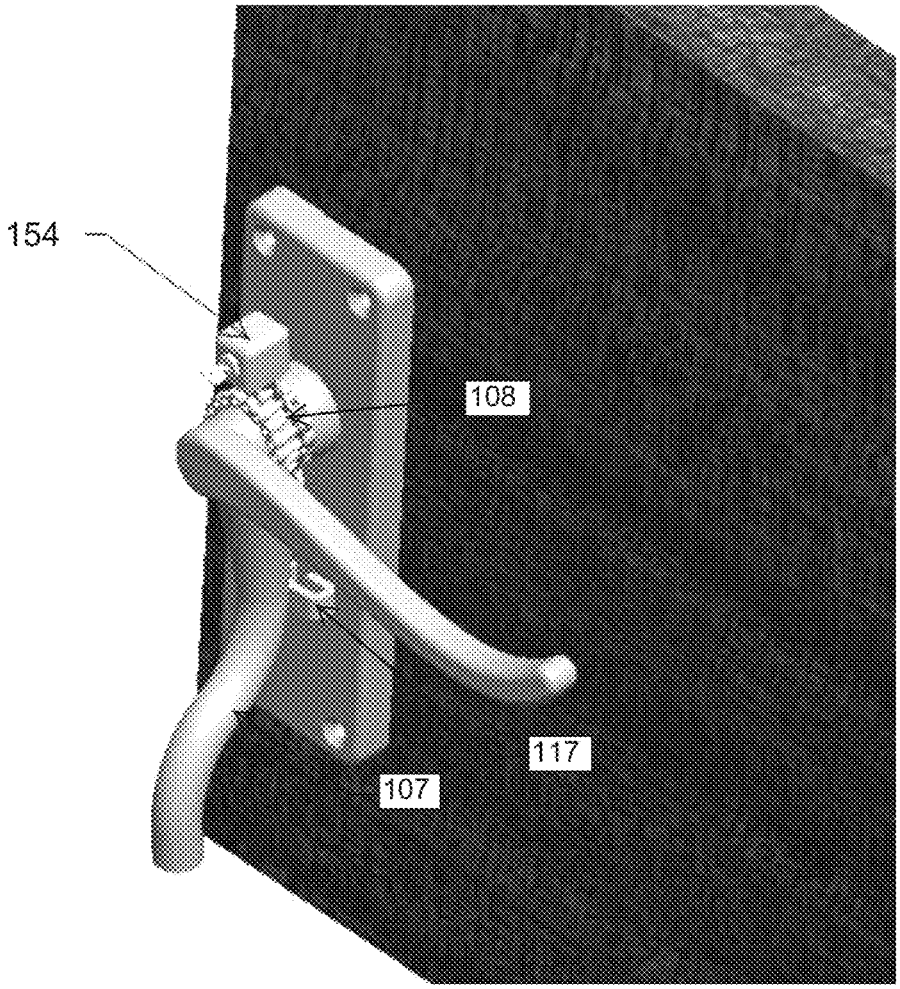

FIG. 12A shows a spring-based security apparatus (154) wherein the cable/chain/rope (108) is designed to contain an inner spring that expands to increase its width, thereby, making it difficult to remove the security apparatus when it is in locked position from the doorknob. In an ideal situation of the spring-laden design of a chain/cable/rope (108), the width of the chain will extend fully and completely between the surface of a door and the handle of the straight doorknob. In general, wider the chain, higher is the turning radius required to pull the chain out of a straight doorknob to release the chain from the straight doorknob when the straight doorknob security apparatus is in a locked position. When the width of the chain increases, and when the straight doorknob security apparatus is in a locked position, in general, it is more difficult for unauthorized individuals to turn or twist or rotate the cable/chain/rope (108) or the stem (107) in order to pull the cable/chain/rope (108) out of the doorknob. FIG. 12A shows how a spring-based security apparatus (154) can be locked with a simple key to arrest and prevent the compressible action of the spring, thereby, making it difficult to remove the security apparatus from a doorknob.

Figure 12B:
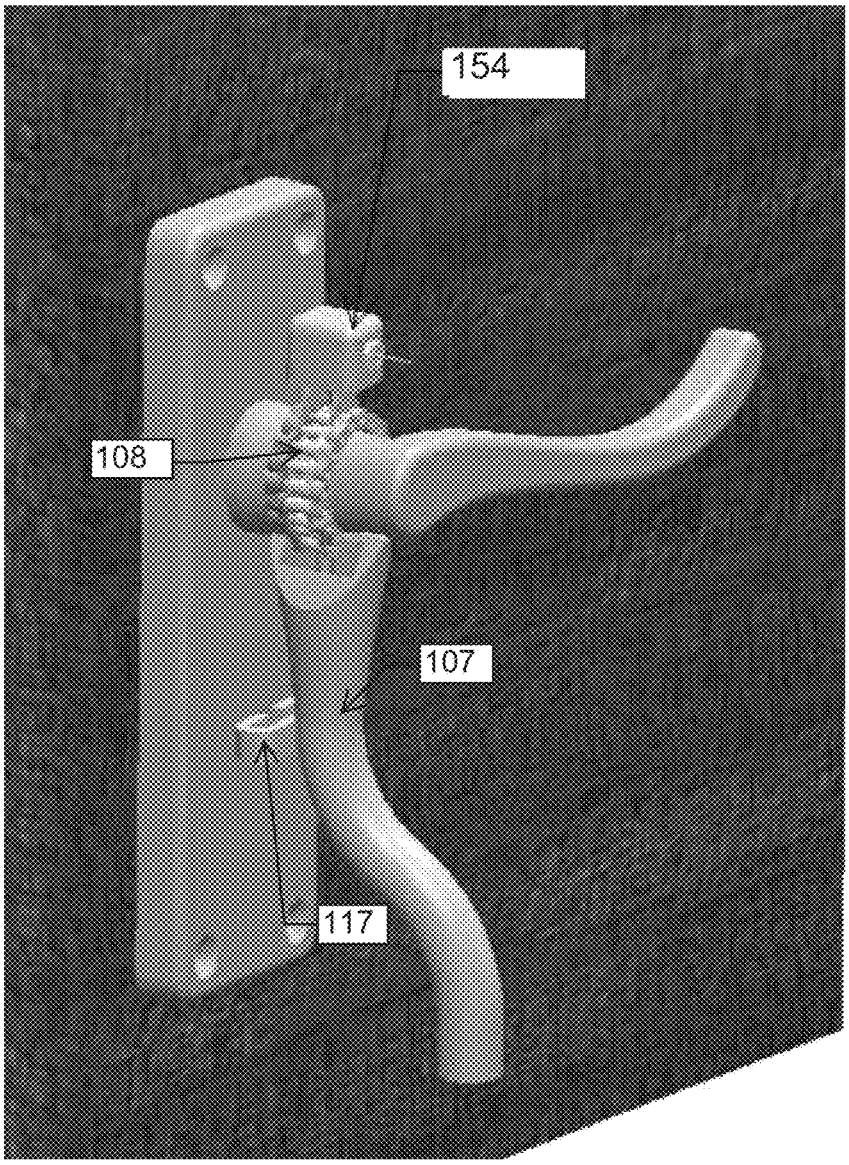
Figure 12C:
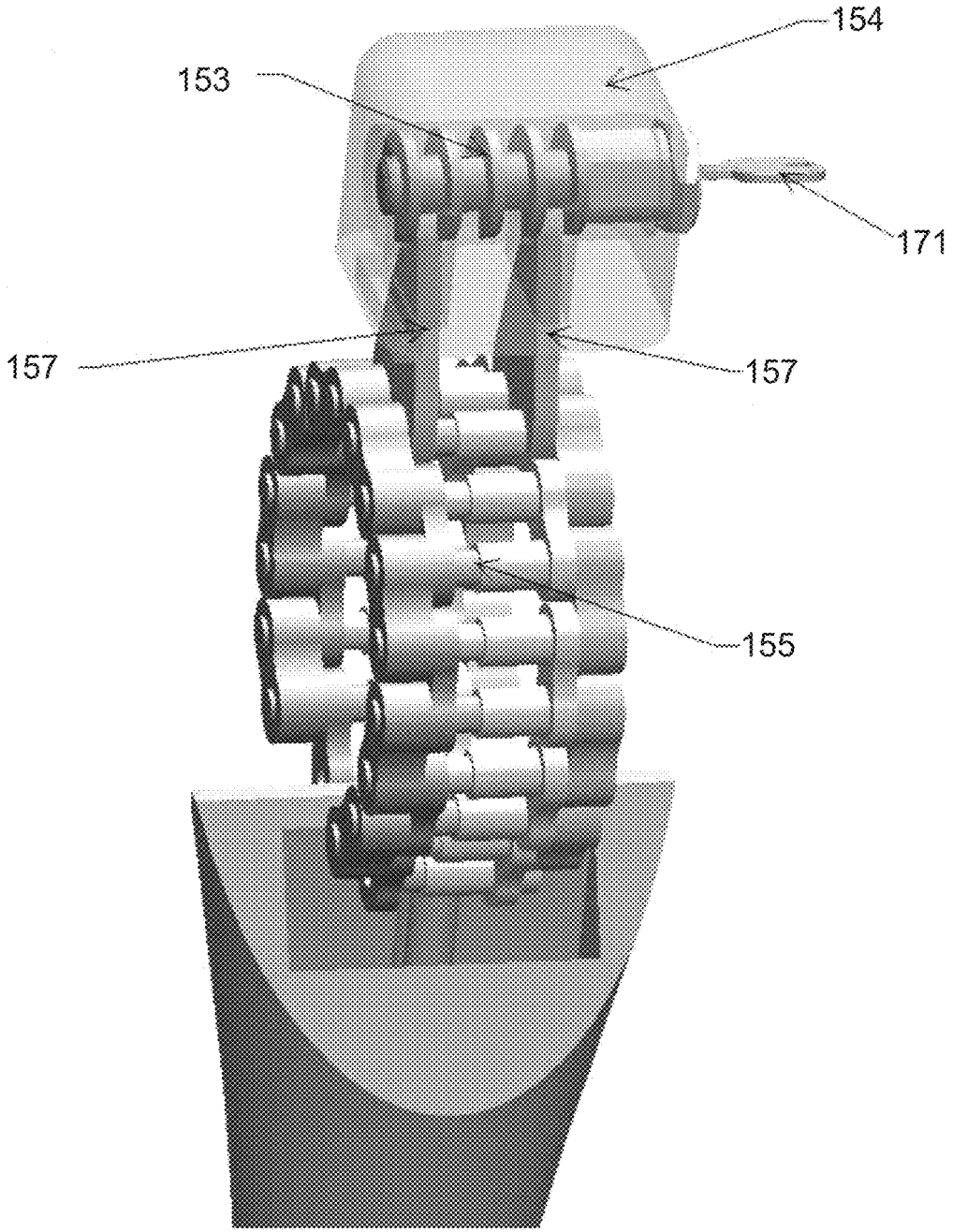

FIG. 12B shows another angle of the spring security apparatus (154) to enhance visualization and understanding of the design. FIG. 12C shows an enlarged picture of the spring-based chain security apparatus (154). FIG. 12C shows various individual components of the spring-based security apparatus (154), and shows the lockable lever (157), a typical design of a locking mechanism (153), a typical locking key (171), and a typical spring-based individual chain component (155). In FIG. 12C, a typical locking mechanism (153) could be in the form of a semi-circular disc or plate wherein, when the locking key (171) is in an unlocked position, could allow movement of the locking levers (157), and when the locking key (171) is in a locked position, because of the rotation of the semi-circular disc, could arrest the movement of the locking levers. When the locking levers are in an unlocked position, the springs inside the chain component (155) typically pushes the edges of the chain and increases the width of the chain.

Figure 12F:
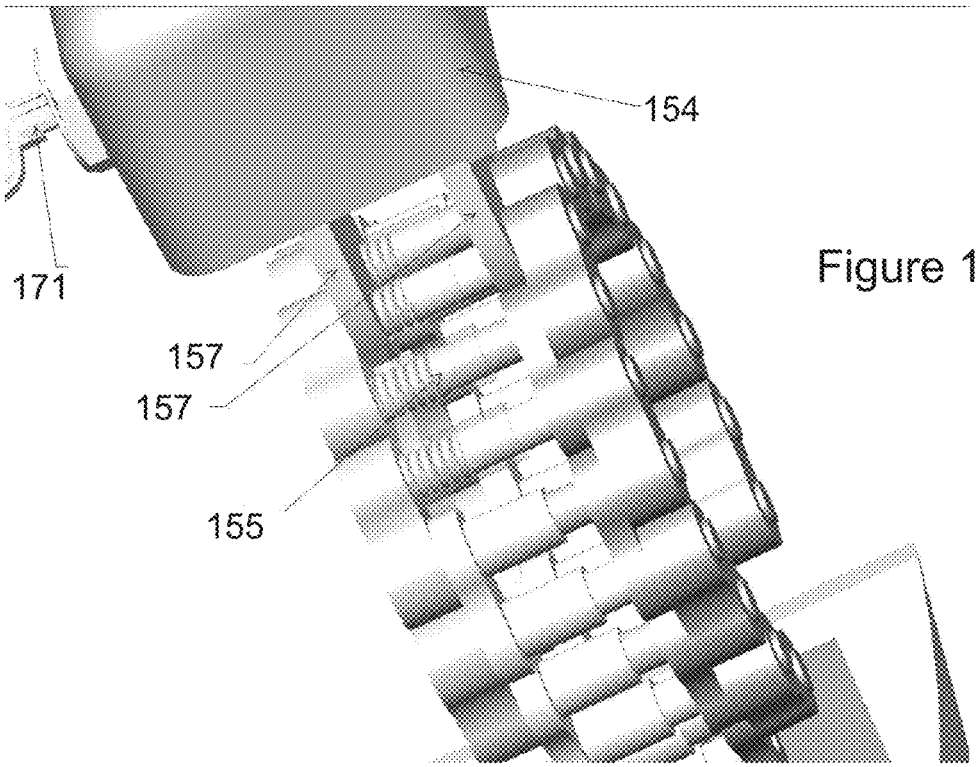
Figure 12G:
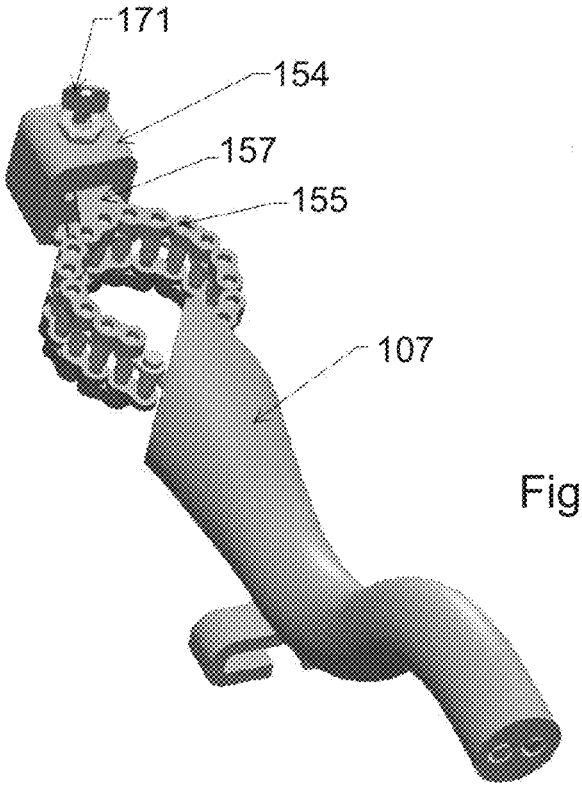

FIG. 12D shows an enlarged picture of one individual piece of the spring-based chain. FIG. 12E shows a close-up view of springs inside the chains by making the outer coverings transparent in order to enhance visualization. FIG. 12F and FIG. 12G show the spring-based chain security apparatus (154) from two different angles to enhance visualization. FIG. 12A through FIG. 12G of the spring-based chain security apparatus (154) uses a physical locking key, as a typical example, to show how a potential the compressible spring can be used to increase the width of a typical chain to increase its effectiveness to minimize or eliminate unauthorized removal of a security apparatus from a typical doorknob.

Figure 13A:
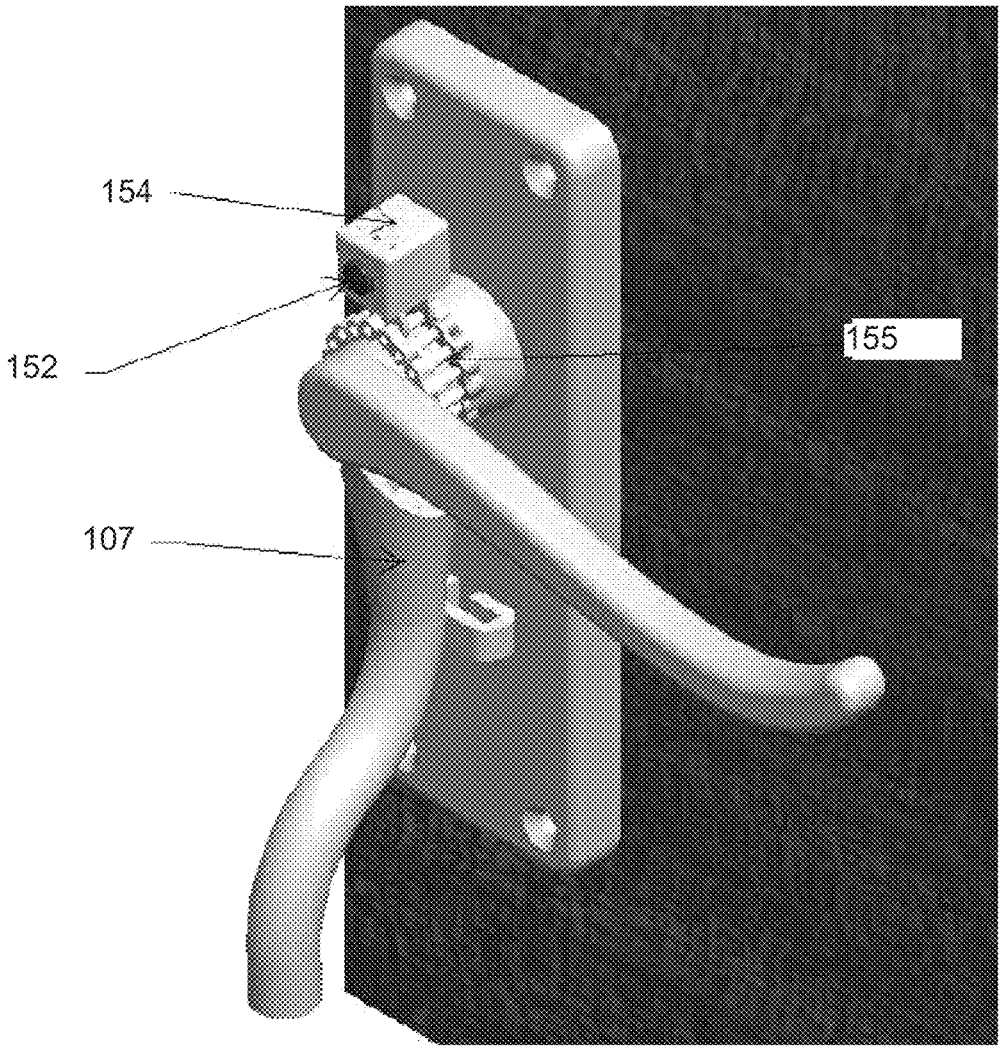
Figure 13B:
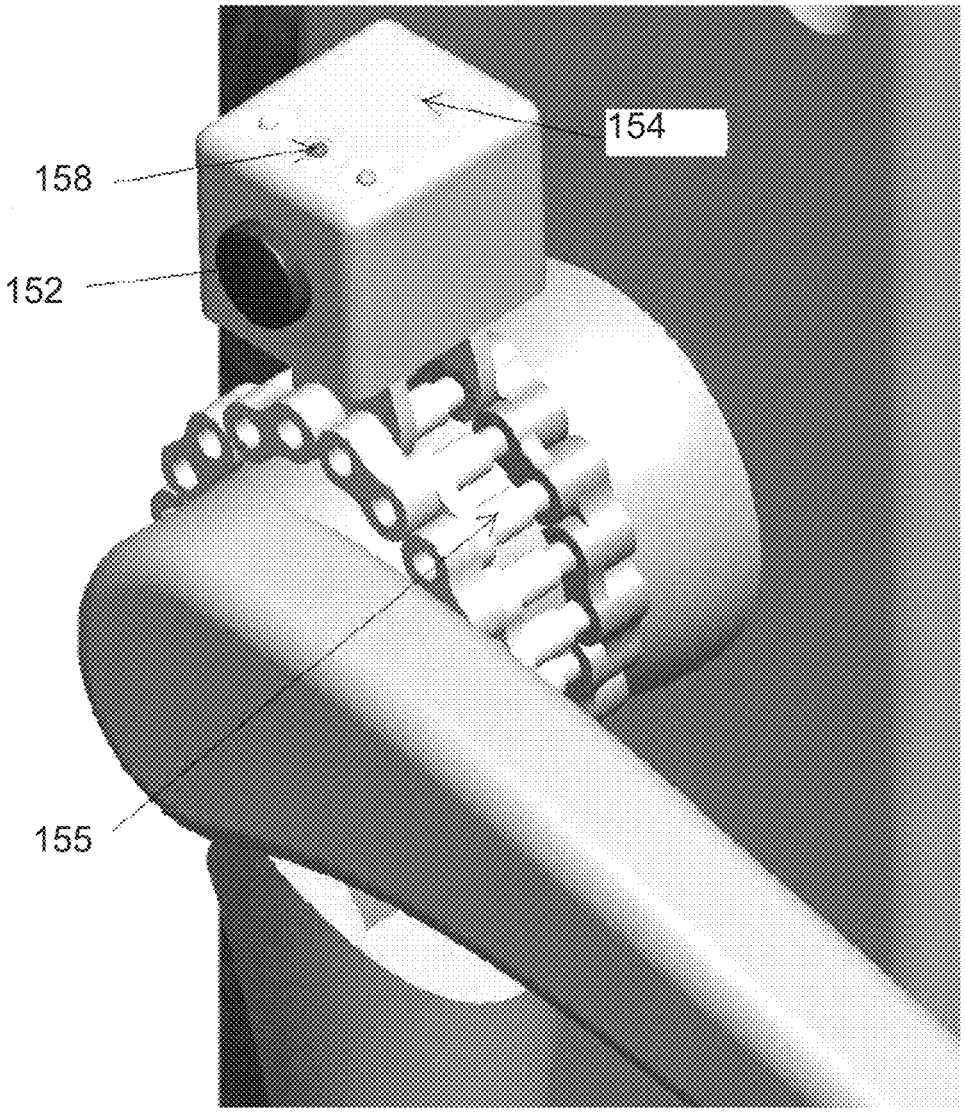
Figure 13C:
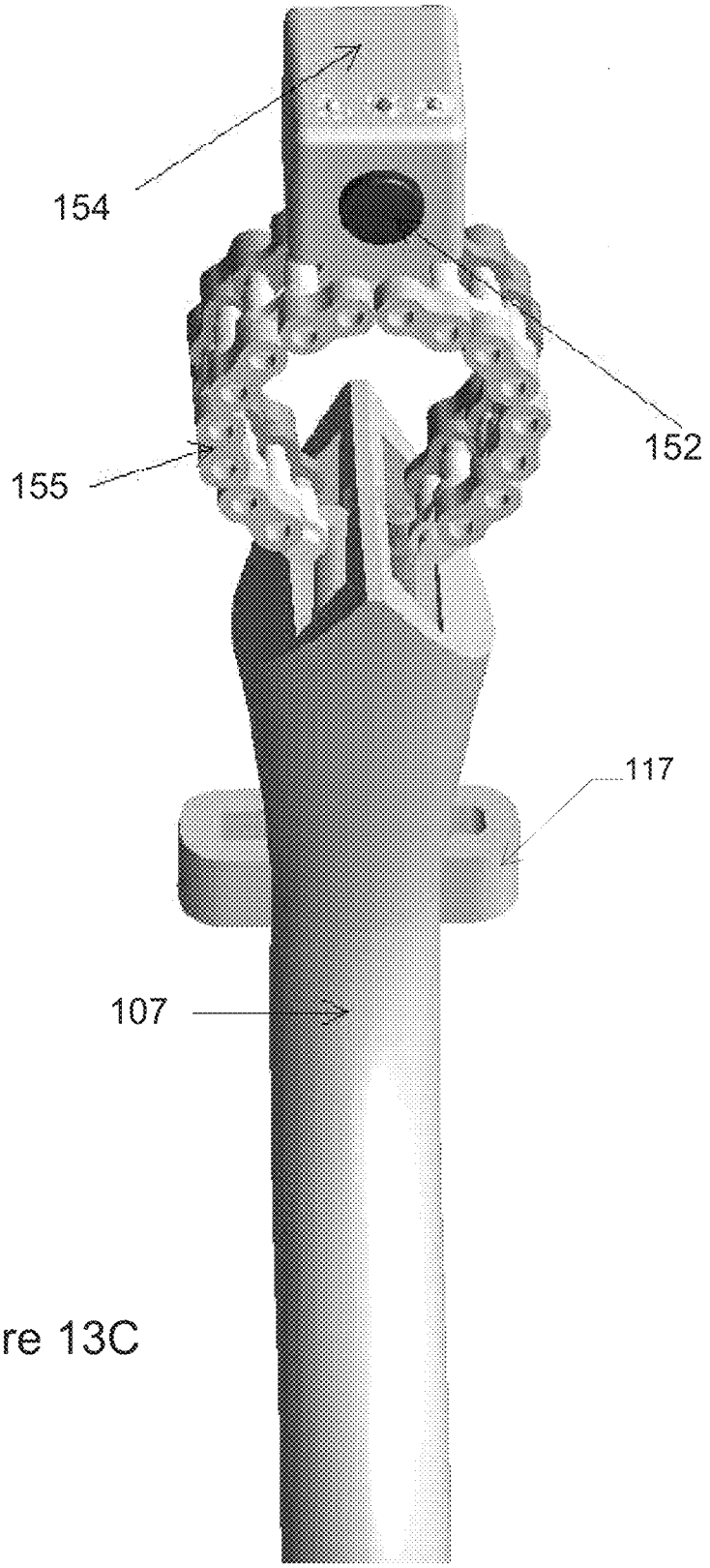
Figure 13D:
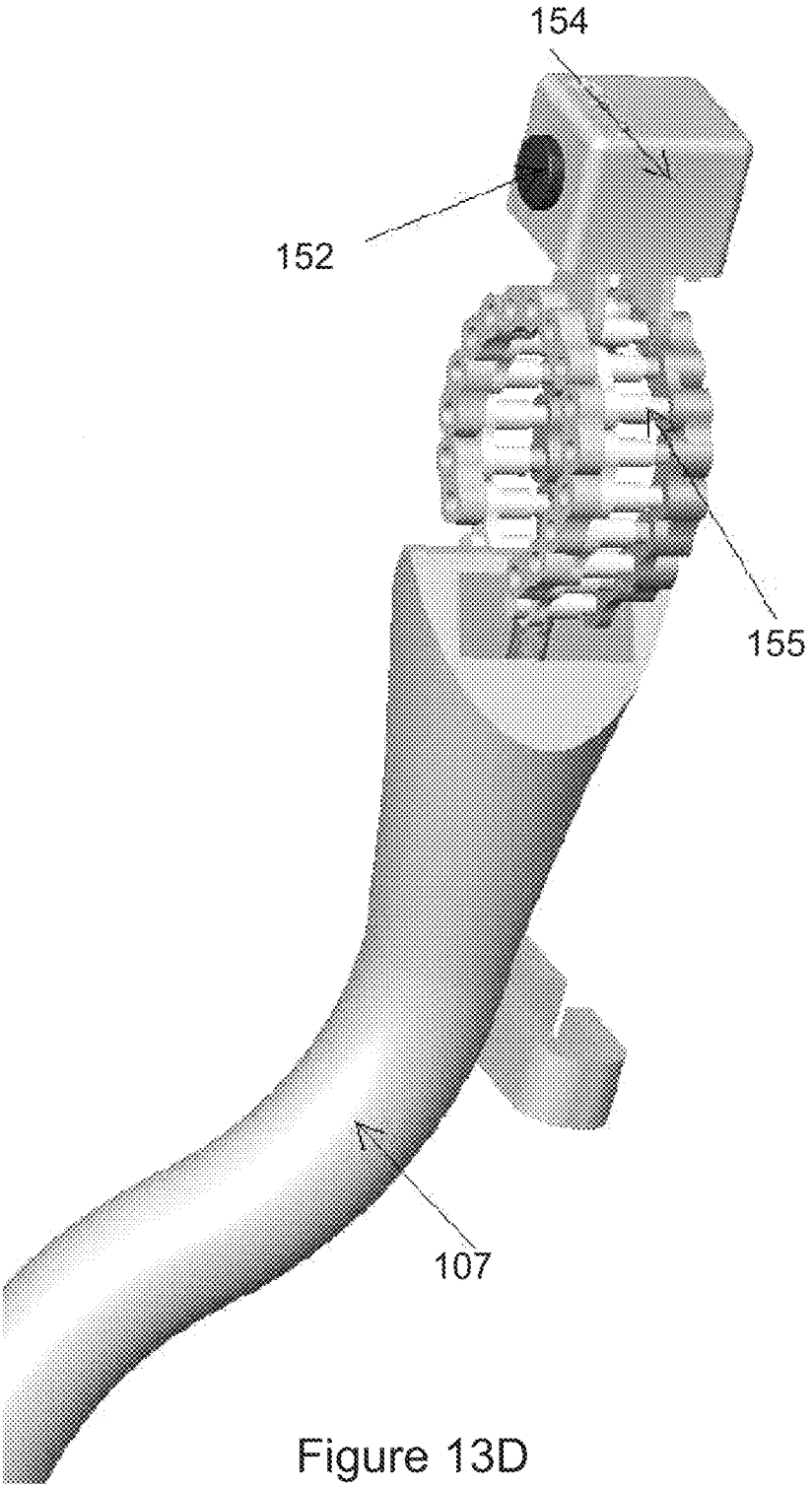
Figure 13E:
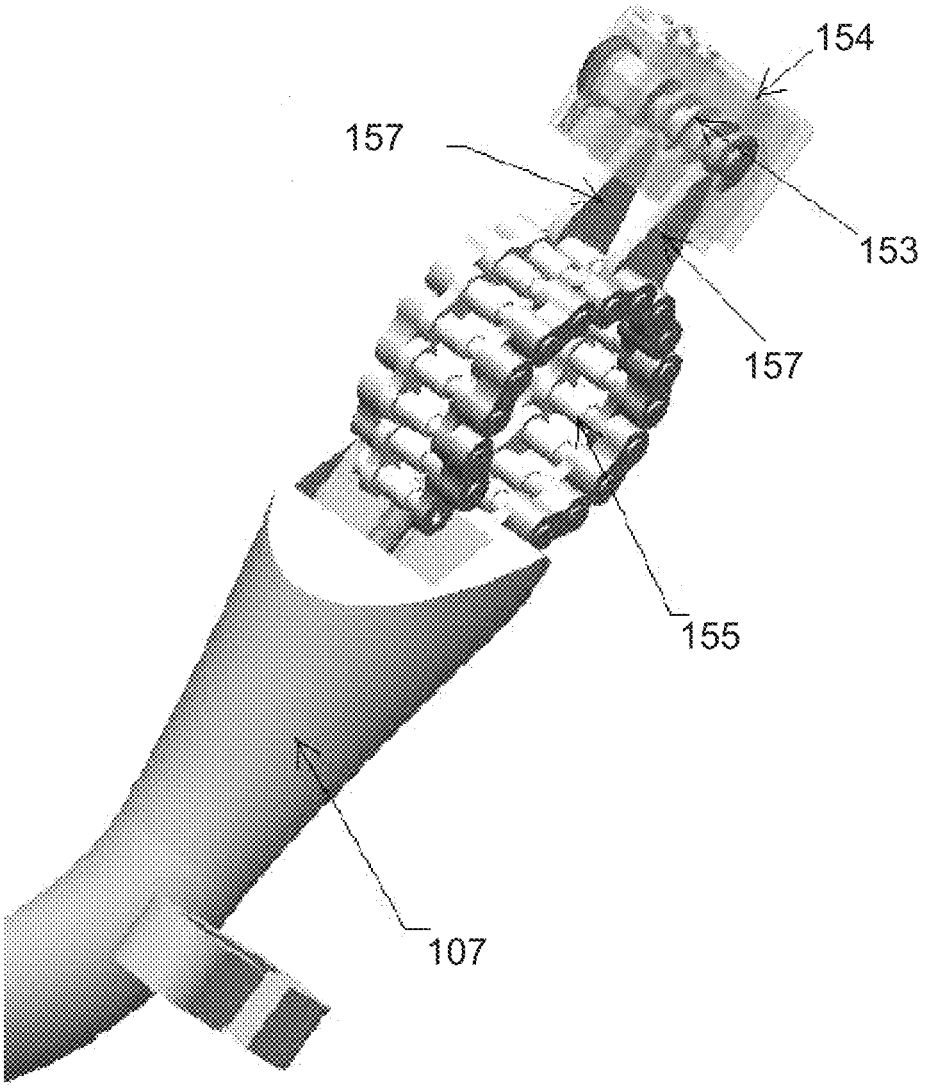
Figure 13F:
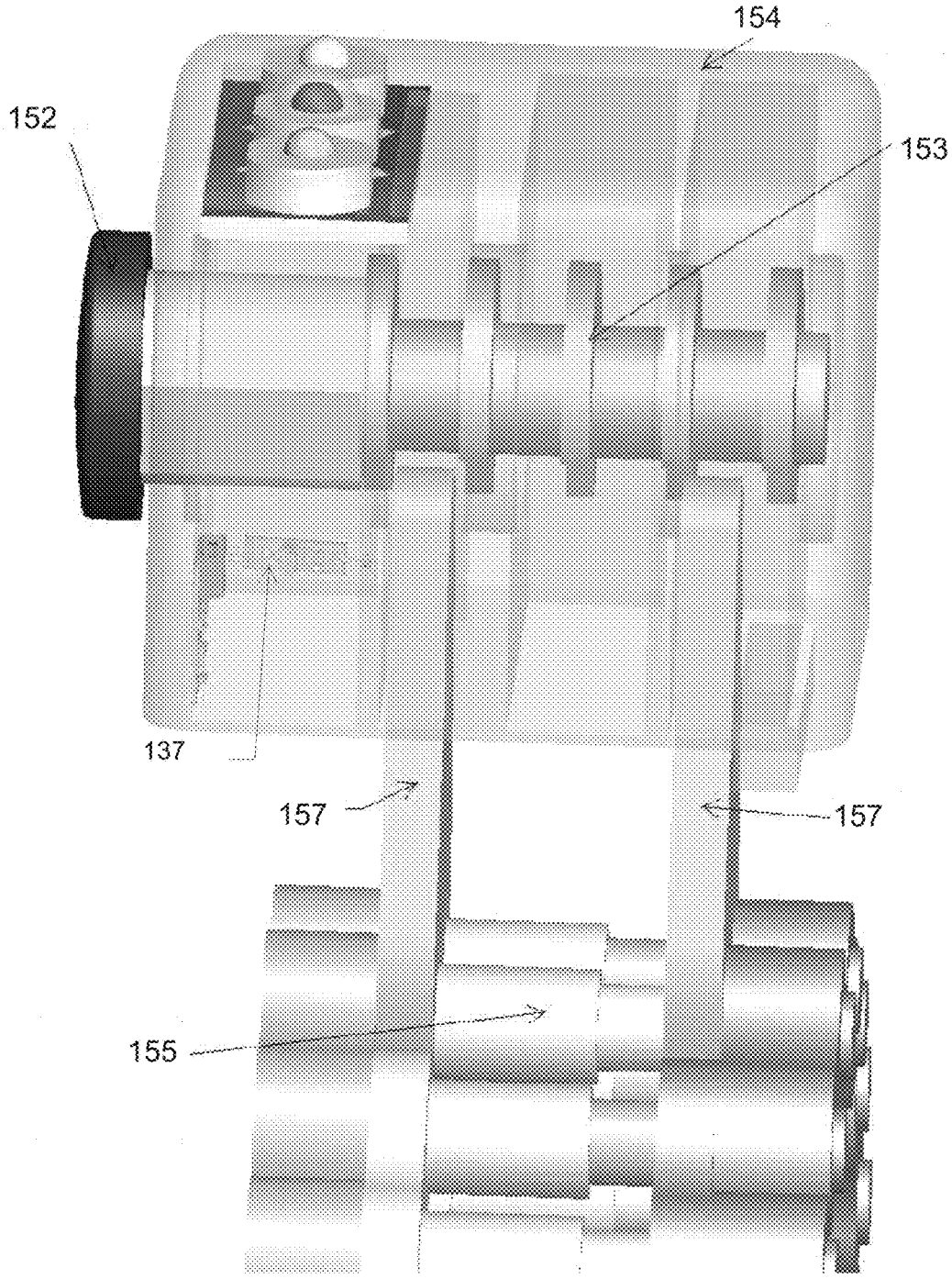
Figure 13G:
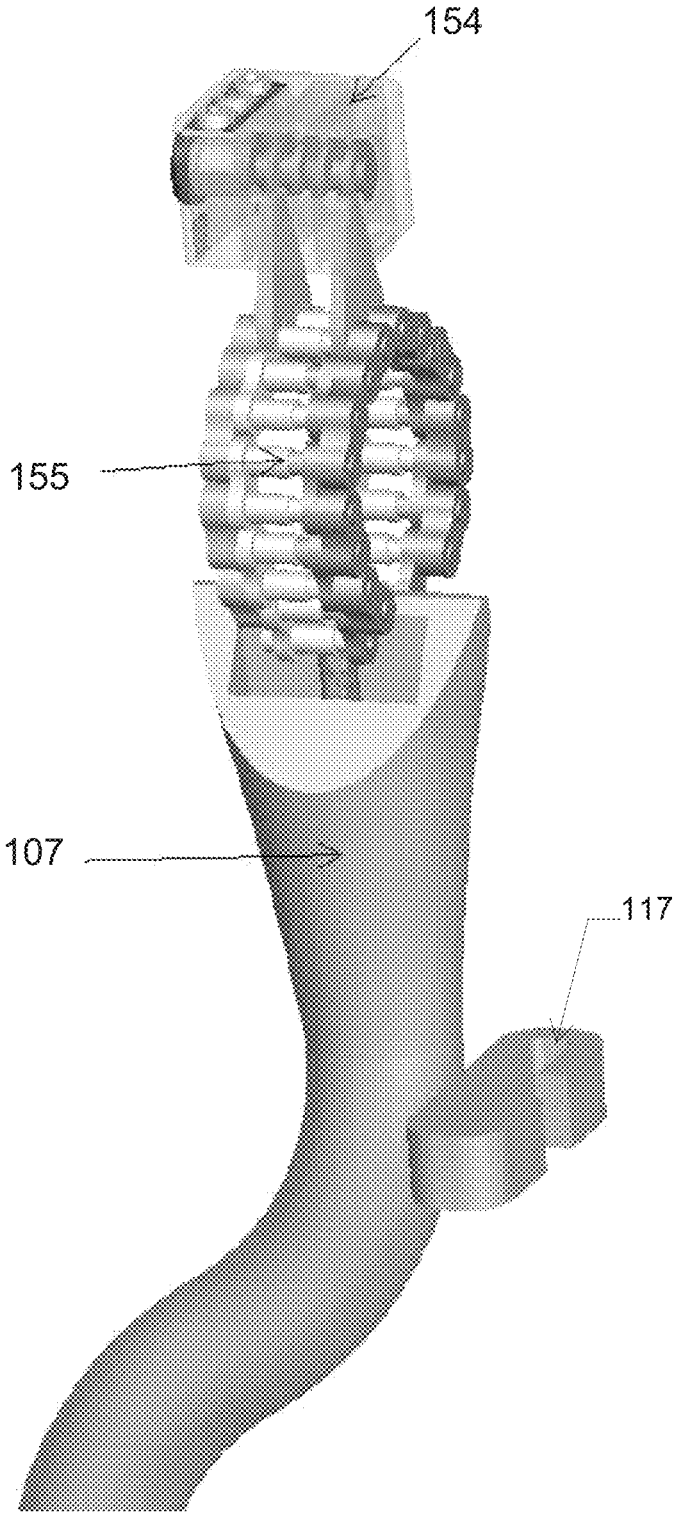

FIG. 13A through FIG. 13G is very similar in function to FIGS. 12A through 12G, except that FIG. 13A through FIG. 13G uses wireless mechanisms to fulfill the same purpose and functionality of the locking and unlocking mechanism to arrest the compressible and expandable action of the spring. There are many wireless techniques and mechanisms that can be employed to accomplish the locking function to lock the springs in its position so that the spring components are not compressed by unauthorized individuals. Wireless mechanism include, but not limited to, solutions based on RFID, Bluetooth, Mobile-phone based application, Near Field Communication (NFC) based solutions, Wi-Fi and can potentially utilize one or more printed-circuit board (PCB) based-driven solutions, among other technological solutions. As shown in FIG. 13B, this electronic solution can have display lights or signals (158) which could indicate various statuses of the spring-based security apparatus at any given point such as indicating battery levels or arm/disarm status among other features. As shown in FIG. 13B, this electronic solution can have any kind of wireless or electronic signal reader (152), and this is shown as a typical example and can be located in any part of the security apparatus, and not necessarily situated as shown. FIG. 13C shows a dangling arrestor (117) that basically connected to a stem to prevent dangling of the overall assembly. FIG. 13D shows a typical curved stem as an example, although the stem can be of straight shape or any other suitable geometry to form a tight loop around a typical doorknob. FIG. 13E shows another angle of this spring-based security apparatus and shows that spring-based chain can potentially be connected to other types of cable, which can go inside the stem, and those cables can be potentially of other shapes or geometry. FIG. 13F and FIG. 13G show a closer look of the spring-based chain security apparatus where potentially printed circuit boards (PCBs) can be housed to perform conceptually some of the technological functions in embodiments based on wireless technologies.

Figure 14A:
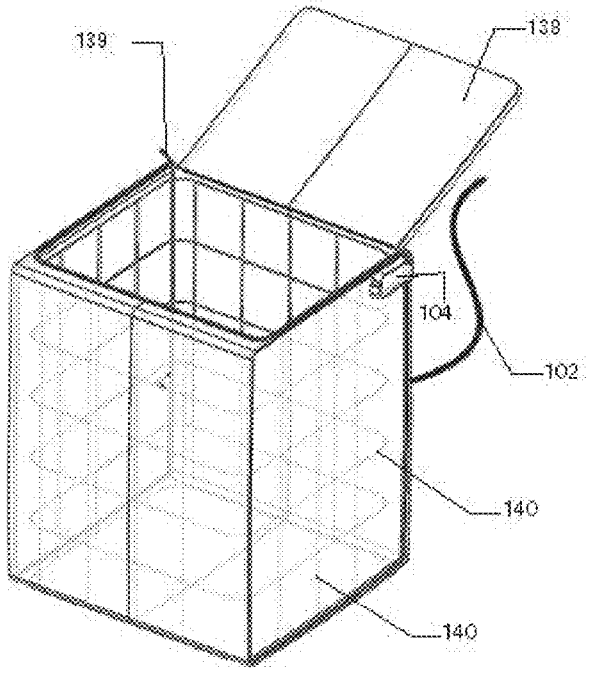
Figure 14B:
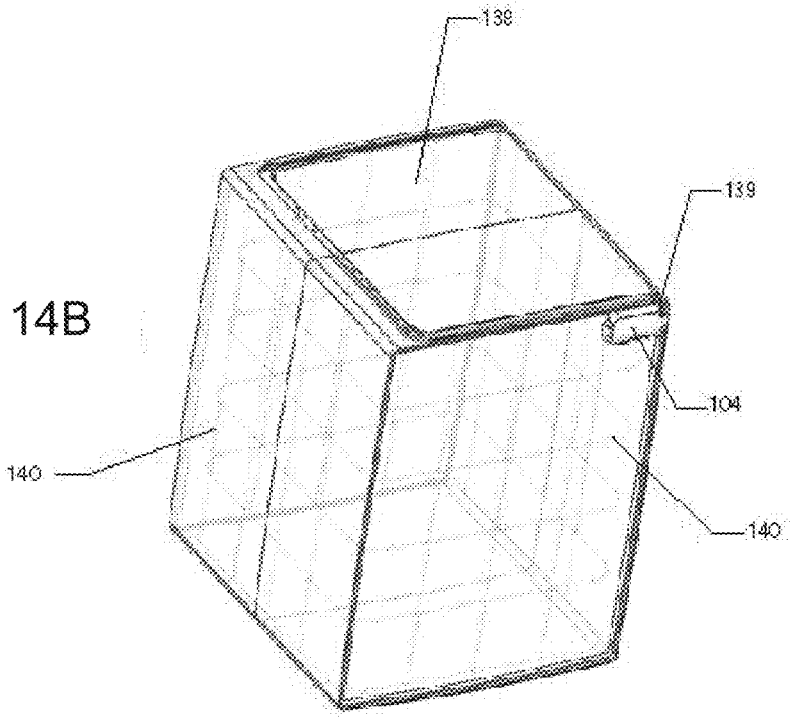
Figure 15A:
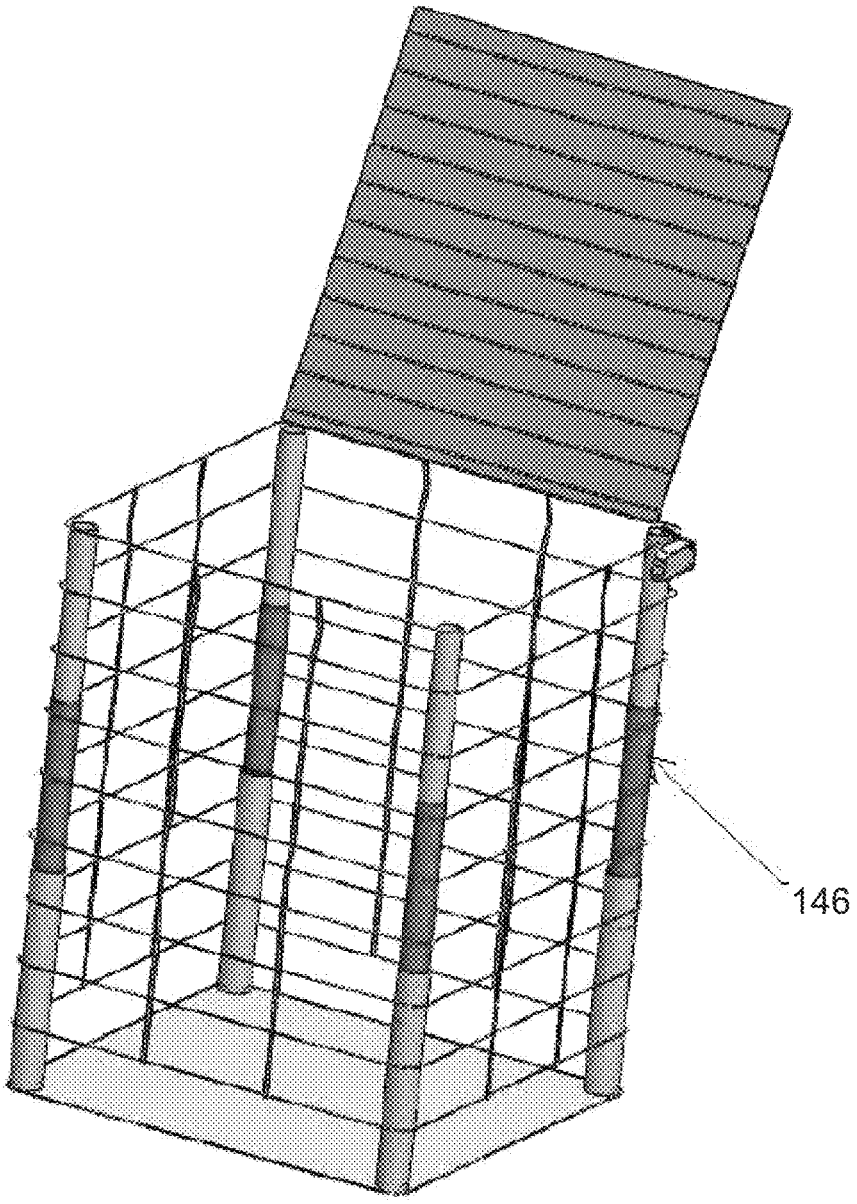
Figure 15B:
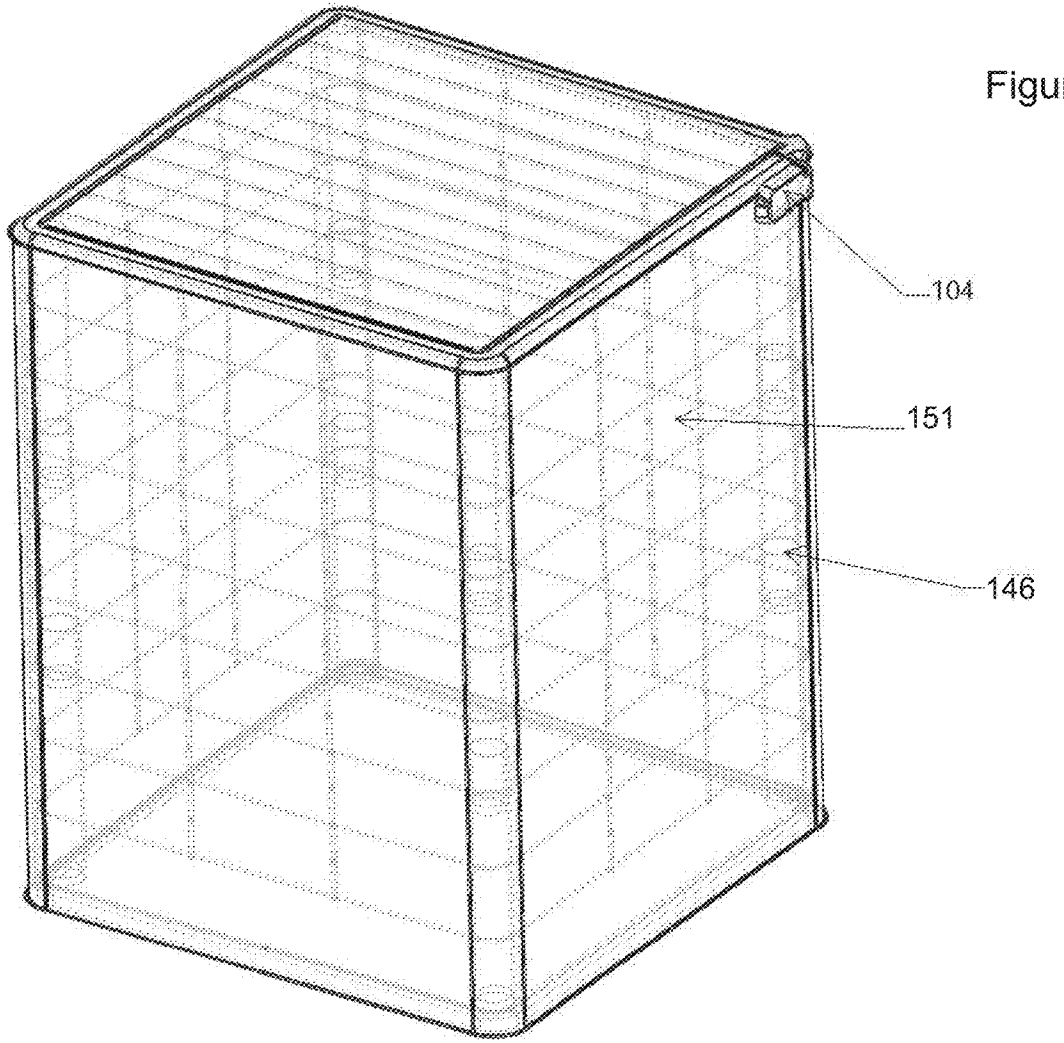
Figure 16:
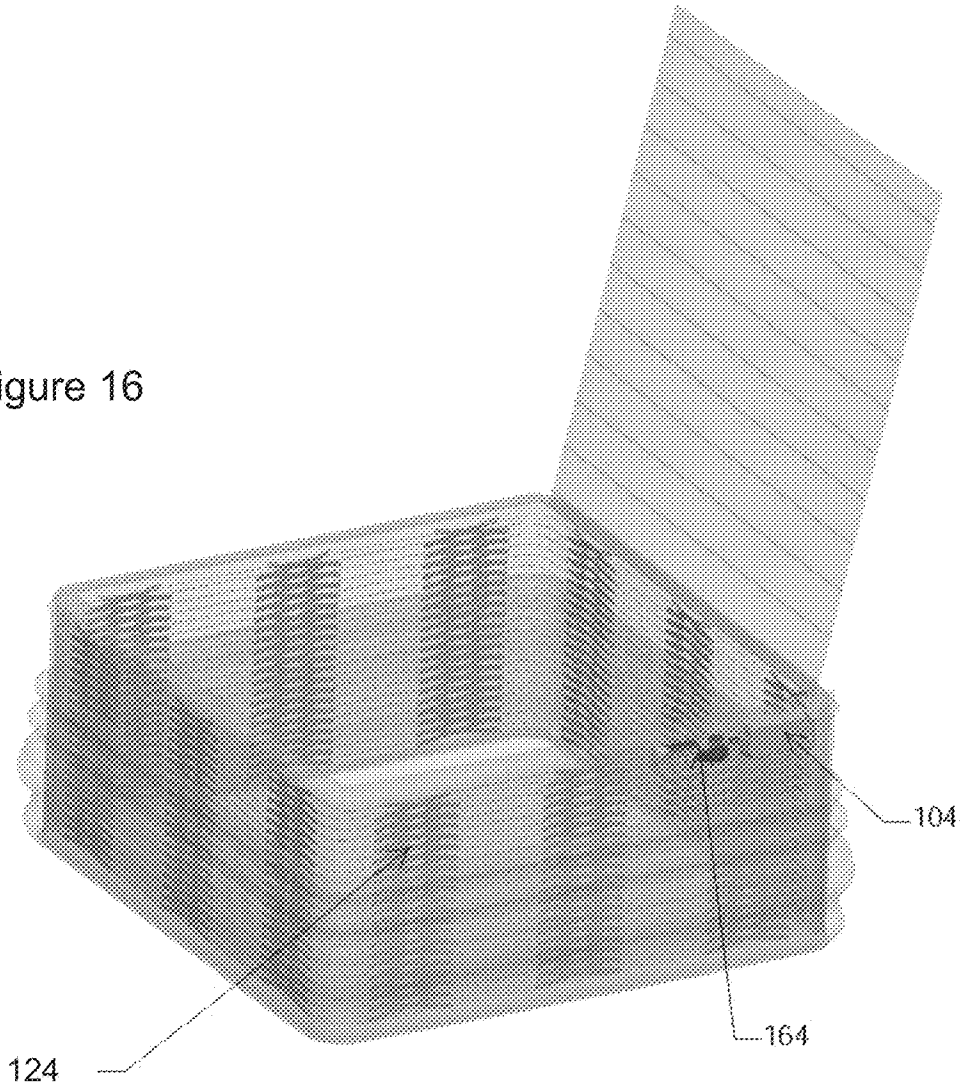

FIG. 14A and FIG. 14B show some typical examples of fixed-size parcel receptacles. FIG. 15A and FIG. 15B show some examples of height-adjustable, telescopic-type parcel receptacles. FIG. 16 shows an example of height-adjustable, scissor-type parcel receptacle design. FIG. 16 shows conceptually how the locking and unlocking of a parcel receptacle can be controlled by a typical wireless controller (164) by implementing a technology-based solution that can selected from a group consisting of RFID, bluetooth, mobile-phone based application, NFC (near field communication), Wi-Fi, or other wireless solutions.

Figure 17A:
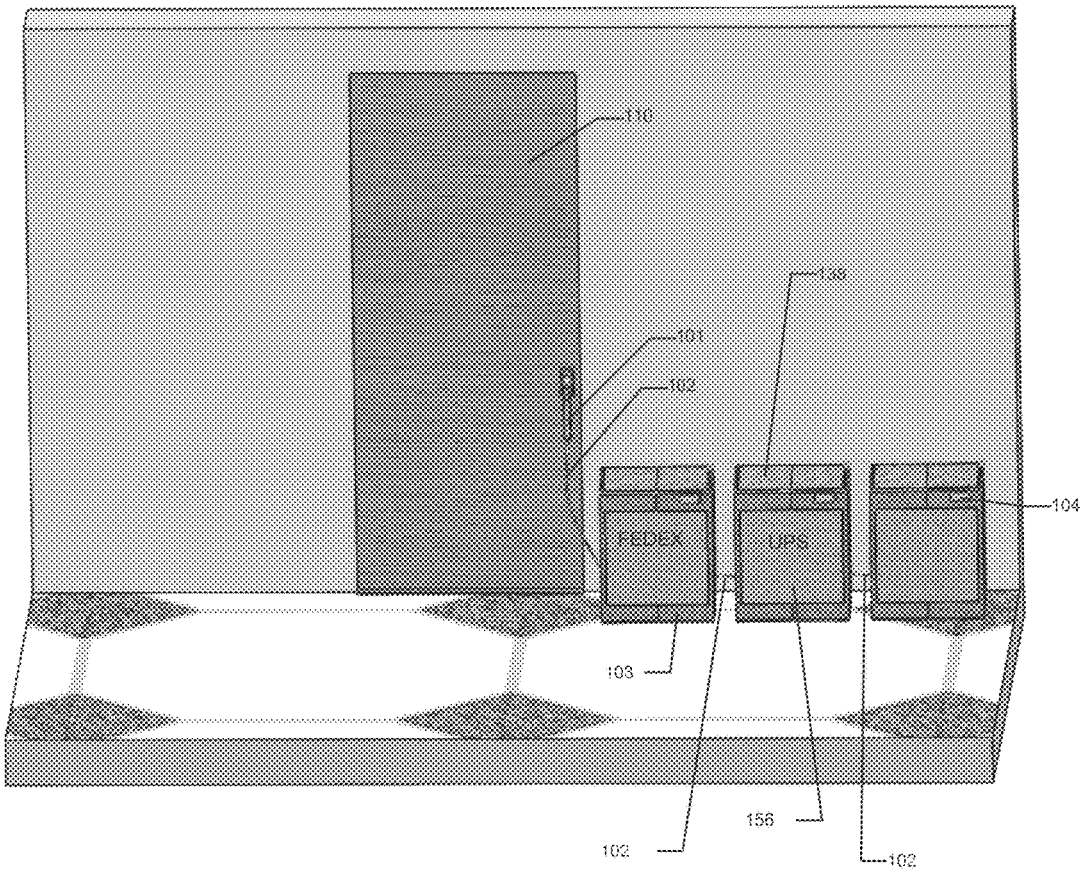
Figure 17B:
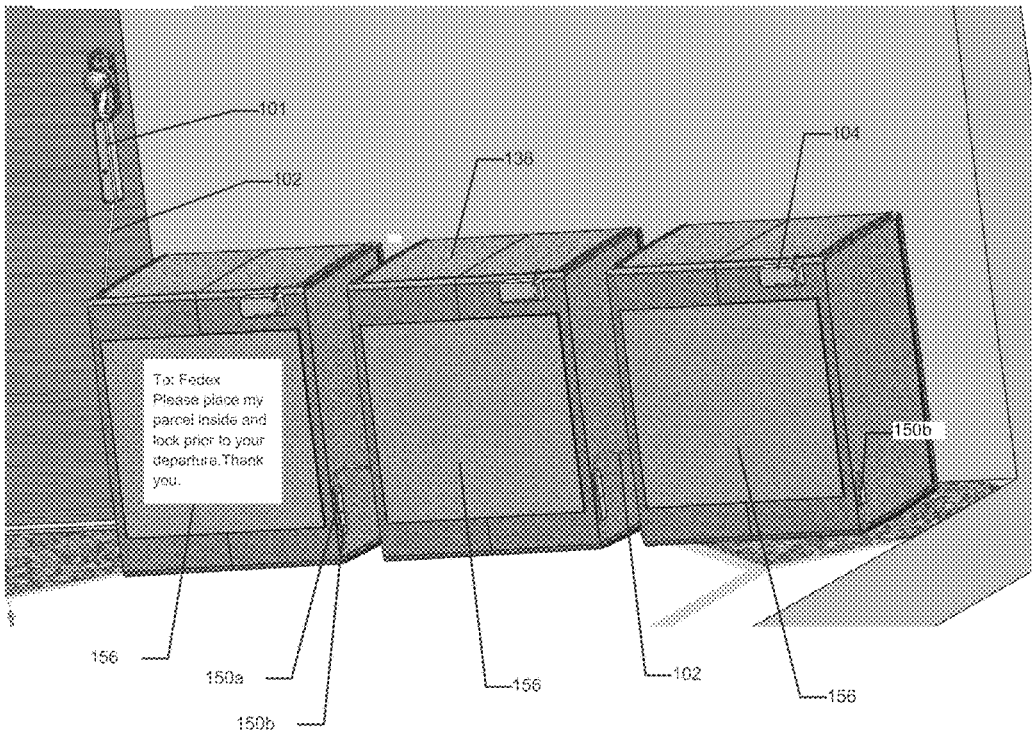
Figure 17C:
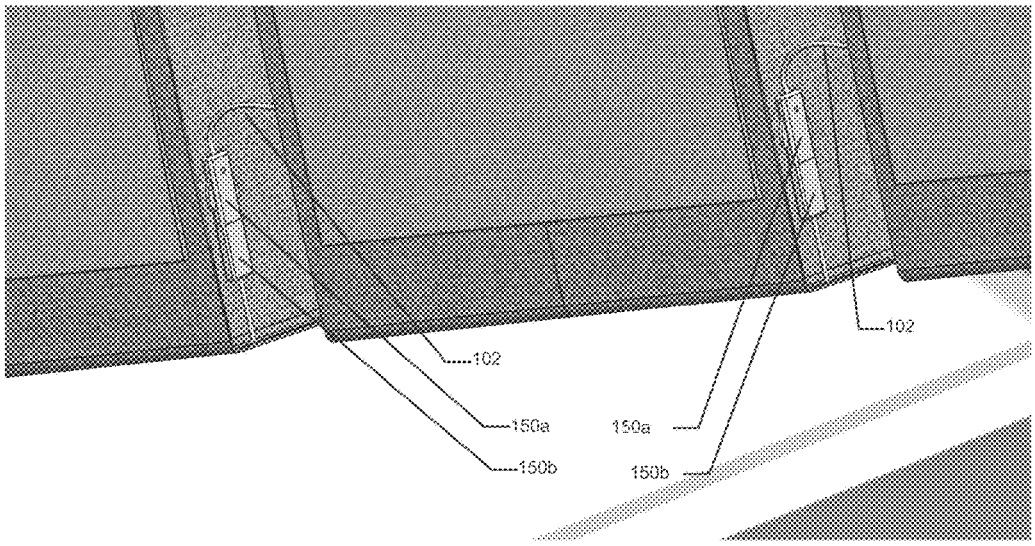

FIGS. 17A and 17B show and illustrate how multiple receptacles can potentially be connected to receive multiple deliveries from multiple carriers with our apparatus and system. Essentially, the cable detachment system described in FIGS. 11A and 11*b* can be used repeatedly to connect one parcel receptacle to another until one's need for multiple deliveries are fulfilled. This design can be used with varying sizes of parcel receptacles. All parcel receptacles can have a transparent message pouch that can be utilized to communicate specific delivery instruction to any mail carrier. In FIG. 17A, the parcel receptacles are arranged adjacent to each other horizontally, but they can also be configured to be placed vertically to reduce the footprint on the ground, and to offer various other benefits including convenience of not having to bend. In FIG. 17C, a closer and enlarged view of FIG. 17B is shown and pictorially illustrates how one parcel receptacle can be connected to another parcel receptacle. There are many ways to connect multiple parcel receptacles, and FIG. 17C shows one example by utilizing a simple lock and key based cable detachment system, which is further described in FIG. 11A.

It should be noted that all the parts and components of my security apparatus and parcel receptacle can be modified in a significant number of ways to fulfill the intended purposes of the invention without departing from the spirit and scope of the invention, and the design presented herein is a typical example to explain the features and functionality in a conceptual manner, and the designs shall not interpreted to limit the configurations or designs as shown only.

Embodiment 1—Typical Operation on a Circular Doorknob to Receive Parcels

An example of a typical use of an embodiment is described below to help in understanding the application of this invention. This scenario is to provide a general understanding of a typical application and operation. It should be noted, that any real-world applications of the various embodiments can be significantly broader, and should not be limited to the application or operation described in this section. In addition, there are features of various embodiments, some of which could be optional in nature, (for example an electronic solution involving technologies such as RFID, Bluetooth, Wi-Fi, mobile phone based applications, NFC and other wireless solutions), which could involve steps that are slightly different when compared to the steps of using a non-electronic or physical mechanism that involve a manual lock and key solution described herein. For the sake of brevity, and to avoid over complication of explanations by compounding all possible permutations and combinations of optional features, those optional features or procedures may not be explained or described adequately in this section. However, several electronic parts and components are shown in multiple figures, and for anyone familiar with the art, operation of those electronic or wireless components is fairly straight-forward and can be inferred by careful analysis and review of all parts and components mentioned or described in this document.

Use of a Circular Doorknob Security Apparatus [FIG. 2A Through FIG. 6E]:

There are 3 specific events that potentially take place while implementing the various embodiments to fulfill one's objective of receiving a parcel or delivery securely, and to eliminate or reduce the risk of losing one's parcel due to theft in front of one's front door. They are as follows:

1. Event 1A: Actions of a parcel recipient or owner associated with setting up a security apparatus and parcel receptacle in front of one's apartment or place of stay to enable the receipt of parcel.
2. Event 2A: Actions of a mail carrier while delivering, placing and securing the parcel inside the parcel receptacle at the time of delivery.
3. Event 3A: Actions of the parcel recipient or owner collecting the parcel upon his/her return to his/her residence or business or place of stay.

Event 1A: Setting Up the Parcel Receptacle to Enable Receipt of a Parcel

Figure 2A:
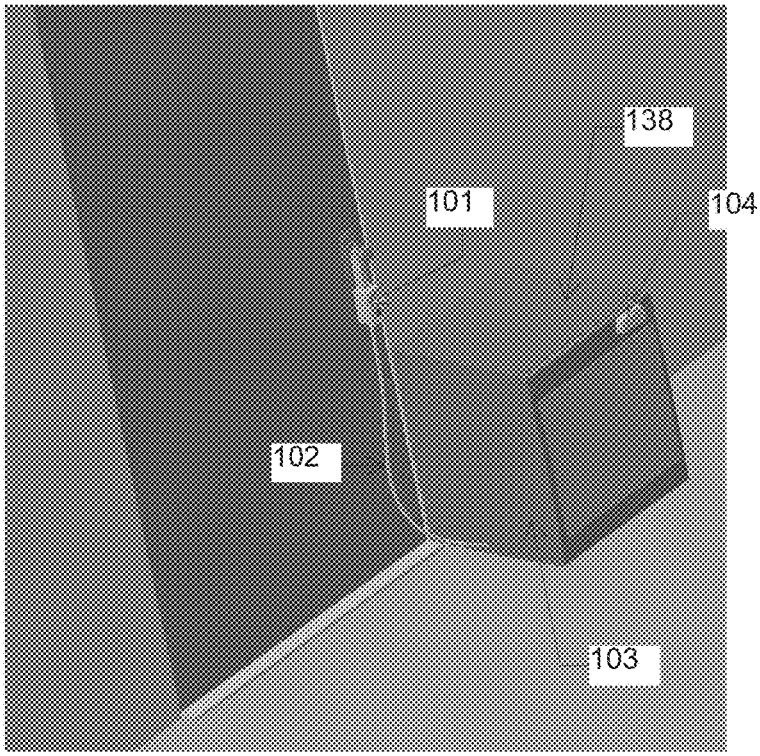
FIG. 2*a* illustrates a circular doorknob security apparatus and all the associated components at a high-level as it is connected to a circular doorknob.
Figure 2B:
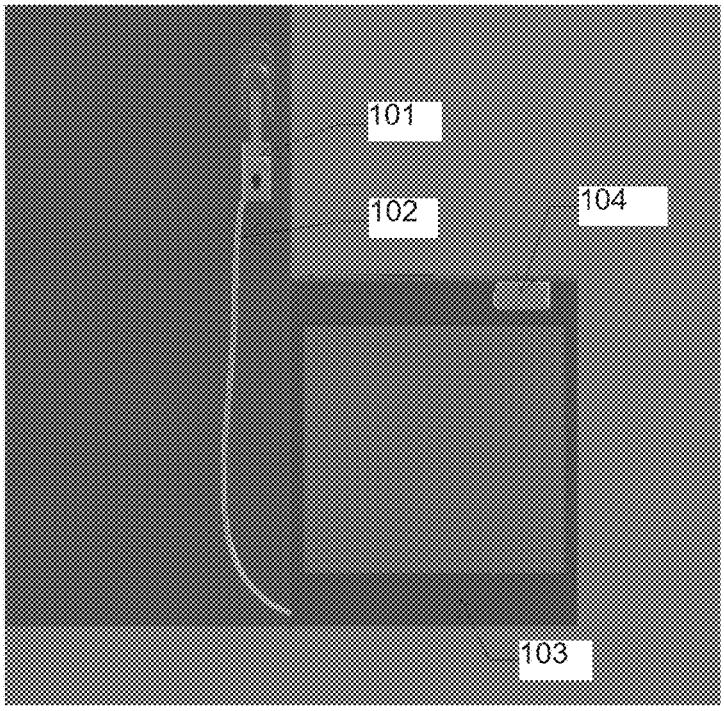
FIG. 2*b* shows an enlarged version of FIG. 2*a* from a front-view angle facing an entrance door. At a high-level.
Figure 3A:
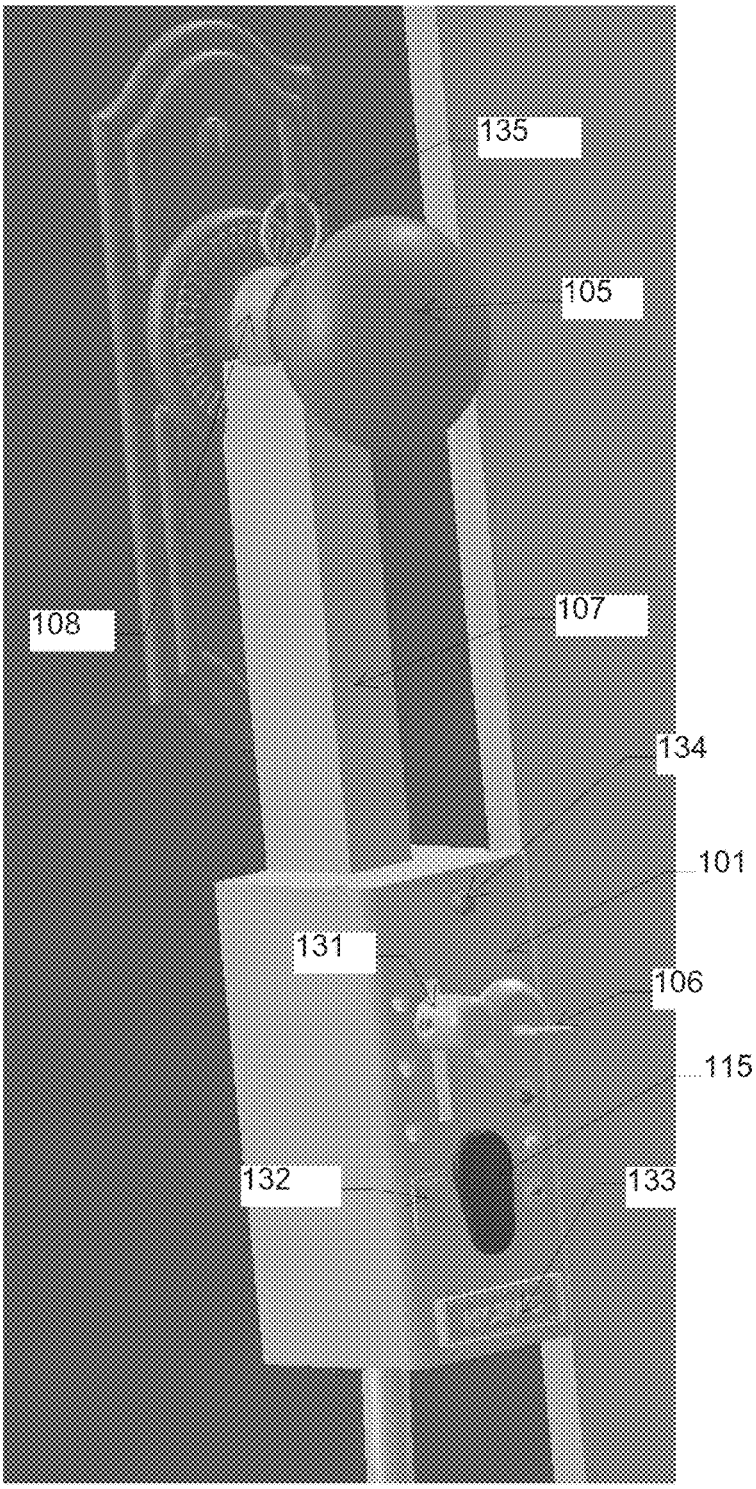
FIG. 3A and FIG. 3B shows an enlarged version of the circular doorknob security apparatus, specifically showing a side-angle view in order to show how the cable/rope/chain (108) is wrapped tightly around the neck of a circular doorknob.
Figure 3B:
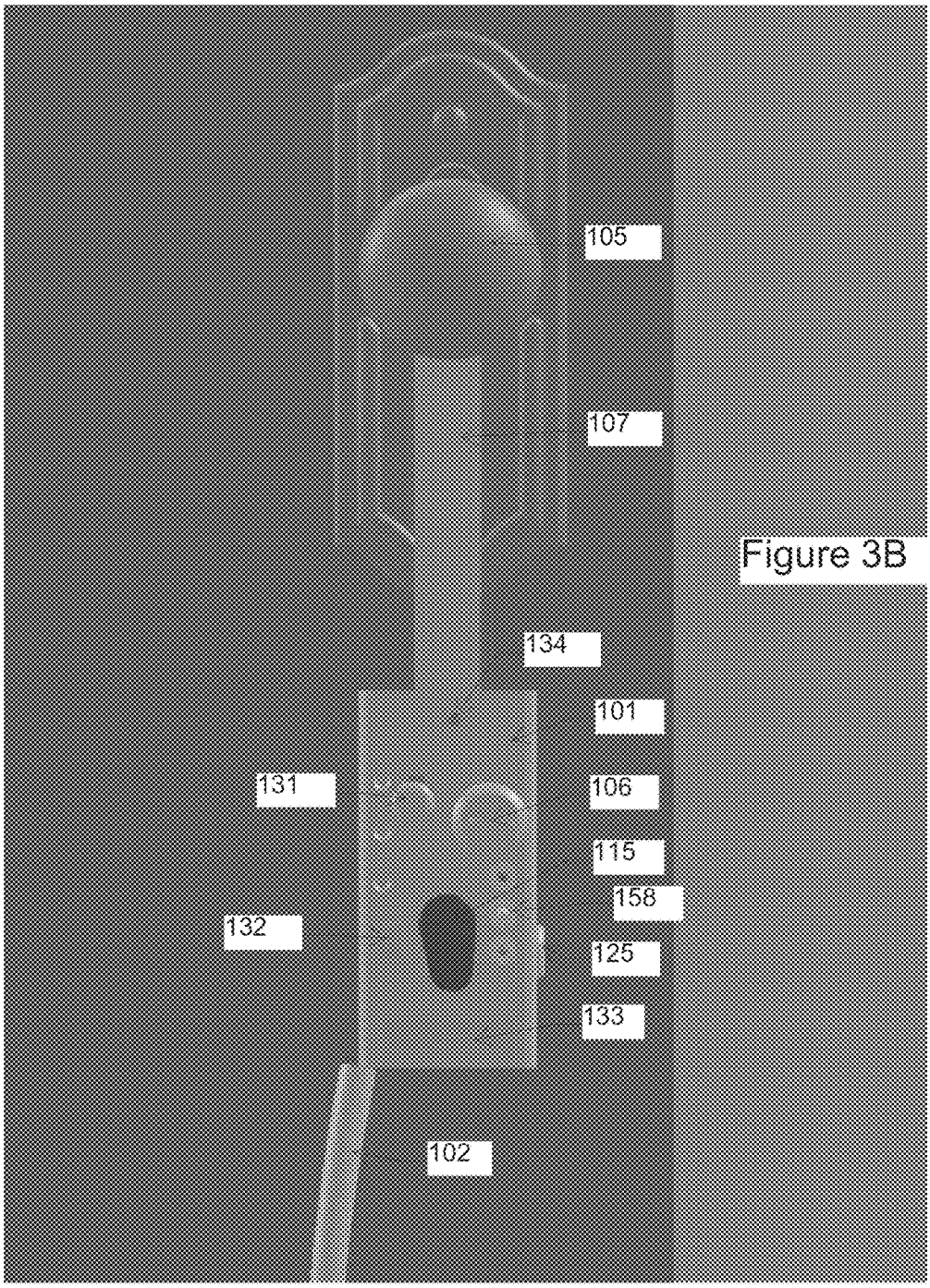

The following outlines a typical sequence of steps that are performed:

1. Take a circular doorknob security apparatus (example FIG. 2A Through FIG. 6E) for use.
2. Ensure the locking pin (FIG. 5A, 142) remains in an unlocked position as shown.
3. Hold the head (FIG. 5A, 145) of the coil spring rotation arresting lever (FIG. 5A, 131) and slide the coil spring rotation arresting lever (FIG. 5A, 131) upward or away from Coil Spring Containing Case (FIG. 5A, 143) along the locking lever slider (FIG. 4E, 141). This action should now allow the vertically-mounted fins (FIG. 5A, 170) to freely rotate.
4. Extend or pull the chain handle (FIG. 4C, 135) outward so that the cable/rope/chain (108) is pulled out and extended out of the stem (FIG. 4D, 107). The chain handle (135) can be pulled to a maximum distance until the cable connector (136) touches the cable stopper (165), which is designed to prevent any further pulling or extension of chain handle (135).
5. As the chain handle (135) is pulled, the cable (108) is extended, which in turn pulls the cable connector (136), which in turn pulls the cable that is wound around the coil spring containing case (143), which in turn rotates the coil spring (144) inside, which in turn gets wound inside and creates tension (the principle of coil spring retraction is similar to that of a measuring tape retraction that we use at home). This creates necessary tension to retract the cable (108) when the chain handle (135) is released.
6. When the chain handle (135) is completely extended out, using the space (FIG. 6A, 163) inside the cable (108), wrap or loop the cable (108) around the circular doorknob. Once the cable (108) is wrapped around the circular doorknob, release the chain handle (135), such that cable retracts completely to form a tight loop around the circular doorknob.
7. As the cable retracts, the cable connector (136) is expected to move from its position shown in FIG. 6B downward to its position shown in FIG. 6C.
8. Once the cable is fully retracted, hold the head (FIG. 5A, 145) and move it down such that the coil spring rotation arresting lever (FIG. 5A, 131) moves toward the Coil Spring Containing Case (FIG. 5A, 143). This action should prevent and arrest the free rotation of the vertically-mounted fins (170).
9. Once the coil spring rotation arresting lever (FIG. 5A, 131) arrests the free rotation of the vertically-mounted fins (170), turn the locking pin (FIG. 5A, 142) toward the coil spring rotation arresting lever (131), and lock the circular doorknob security apparatus.
10. The above steps will connect the circular doorknob security apparatus to the circular doorknob securely. As shown in FIG. 2B, a tamper proof cable is attached to the circular doorknob security apparatus (101) and is connected to a parcel receptacle (103).
11. Ensure the parcel receptacle security cover (FIG. 2A, 138) is unlocked (104).
12. Open the parcel receptacle security cover (FIG. 2A, 138) as shown in FIG. 14A. The parcel receptacle's zipper position (FIG. 14Aa, 139) shall remain unzipped and the parcel receptacle shall be open, and should allow the delivery personnel to place the parcel inside the parcel receptacle. Additionally, the parcel receptacle lock (104) will remain unlocked at this juncture, but the parcel receptacle shall be securely connected to the doorknob security apparatus via cable/rope/chain (102).

13. Leave the entire assembly unattended and walk away, and you are ready to receive the parcel, and wait for the next event to occur.

Event 2A: Receiving Parcel or Deliveries

When the delivery personnel arrive at the front-door, he/she puts the parcel inside the parcel receptacle (103), and moves the zipper 139 from its open position in FIG. 14A to its locked position shown in FIG. 14B. The zipper 139 is securely locks into lock (104) in such a way that the zipper cannot be opened again unless one has the key for the lock (104) or knows the numerical combination of the lock. The lock can be of numerical combination type as shown in FIG. 14*a* and FIG. 14*b*, or any other type. Once locked, even the mail personnel shall not be able to open and access the parcel unless the mail personnel have access to an unlocking code or an unlocking mechanism.

Event 3A: Retrieving Parcel or Package

Upon return to one's residence, business or place of stay, the parcel recipient can use a key (106 or its electronic or wireless equivalents) or any authorized unlocking mechanism to open the doorknob security apparatus such that the locking pin (FIG. 5A, 142) is rotated and releases the coil spring rotation arresting lever (131), which in turn allows free rotation of the vertically-mounted fins (170), which in turn allows chain handle (135) to extend outward to remove it from the circular doorknob. Once the entire doorknob security apparatus is removed from the doorknob, upon going inside one's residence or place of stay, one can unlock the parcel receptacle lock (104 or its electronic or wireless equivalents) and retrieve the contents of the parcel receptacle.

Embodiment 2—Typical Operation on a Straight Doorknob to Receive Parcels

An example of a typical use of an embodiment is described below to help in understanding the application of this invention. This scenario is to provide a general understanding of a typical application and operation. It should be noted, that any real-world applications of the various embodiments can be significantly broader, and should not limited to the application described in this section. In addition, there are features of various embodiments, some of which are optional in nature, and for sake of brevity, those optional features may not be explained or described in this section, however, those can be inferred by careful analysis and review of already presented operational procedures of various parts and components elsewhere in this document.

Use of a Straight Doorknob Security Apparatus [FIG. 7A Through FIG. 9D]:

Please refer to FIGS. 7A through 9C to understand and follow various descriptions in this section as to how a straight doorknob security apparatus functions. There are 3 specific events that potentially take place while implementing the various embodiments to fulfill one's objective of receiving a parcel or delivery securely, and to eliminate or reduce the risk of losing one's parcel due to theft in front of one's front door. They are as follows:

1. Event 1B: Actions of a parcel recipient or owner associated with setting up a security apparatus and parcel receptacle in front of one's apartment or place of stay to enable the receipt of parcel;
2. Event 2B: Actions of a mail carrier while delivering, placing and securing the parcel inside the parcel receptacle at the time of delivery; and
3. Event 3B: Actions of the parcel recipient or owner collecting the package upon his/her return to his/her residence or business or place of stay.

Event 1B: Setting Up the Parcel Receptacle to Enable Receipt of a Parcel

The following outlines a sequence of steps that can be performed:

1. Take a straight doorknob security apparatus (example FIG. 7A Through FIG. 9D) for use.
2. Press the pushable head (FIG. 8L, 168) down, and rotate the locking pin (FIG. 8L, 142) by unlocking and rotating the key (FIG. 8*i*, 106). The locking pin should now be in the unlocked position as shown in (FIG. 8L, 142) and turned away from the short lever (FIG. 8L, 120).
3. The short lever should now be in a released position as shown (FIG. 8H, 120), instead of being in a locked position as shown in FIG. 8*i*, 120.
4. Also, the tall lever should now be in a released position as shown in (FIG. 9B, 121), instead of being in a locked position as shown in (FIG. 8J, 121).
5. Pull the pulling lever (FIG. 8*i*, 166) up. This action should release the slidable wedge (FIG. 8*i*, 122) from its locked position as shown in (FIG. 8*i*, 122), to its open position as shown in (FIG. 8L, 122). The slidable wedge, when it is in locked position, would arrest the movement of the cable strap latch (FIG. 9A, 167). However, the slidable wedge, when it is unlocked position, would allow the cable strap lap to be released and to be pulled out as shown in (FIG. 8H, 167).
6. Once the cable strap latch (FIG. 8H, 167) is released, pull it outward, which in turn pulls the cable (108), which in turn pulls the cable that is wound around the coil spring containing case (FIG. 8L, 143), which in turn rotates the coil spring (FIG. 8G, 144) inside, which in turn gets wound inside and creates tension (the principle of tension creation and release in the described coil spring is similar to that of a measuring tape retraction that we use at home which extends when pulled and retracts when released.). This creates necessary tension to retract the cable (108) and the cable strap latch (167) when the cable strap latch is released.
7. Now, pull the cable strap latch (167) outward, which in turn pulls the cable (108), and wrap the cable around a straight doorknob, and insert the cable strap latch (167) back into the cable strap latch lever Sliding Groove (FIG. 8M,129). When sliding the Cable strap latch lever into the sliding groove (129), the slidable wedge (122) is moved up and compresses the spring (FIG. 8J, 127), and upon passing further down the groove, the slidable wedge (122) comes down again and locks itself into the cavity (FIG. 8H, 123) of the cable strap latch as shown in (FIG. 9B).
8. The space (FIG. 9C, 163) is where the straight doorknob will be positioned, and the doorknob itself is not shown in the figure to provide explanation of other features and operation.
9. Due to tension in the coil spring, the cable is expected to retract and form a tight loop around a straight doorknob. Once the slidable wedge (FIG. 9A, 122) is snapped into its shown position, we are ready to lock and arrest the movement and loosening of the cable (108).

10. Now, push down the pushable head (FIG. 9B, 168) such that the tall lever (FIG. 9B, 121) locks into the cable latch strap's cavity (FIG. 8H, 128) as shown in (FIG. 9D). At the same time, the short lever (FIG. 9D, 120) will lock into the horizontally-mounted fins (FIG. 9C, 169) so that the coil spring containing case (FIG. 9C, 143) cannot rotate any further.
11. Now, by pressing and holding the pushable head (FIG. 9B, 168) down, rotate the key (FIG. 9B, 106) such that the locking pin goes from the unlocked position shown in (FIG. 9A, 142) to the locked position shown in (FIG. 9D, 142 or FIG. 9C, 142).
12. By pressing the pushable head (FIG. 9B, 168), and rotating the key (FIG. 9B, 106), the short lever (FIG. 8L, 120) is arrested from moving up. When the short lever is down, and in its depressed position (FIG. 9D, 120), it arrests rotation of the horizontally-mounted fins (FIG. 9C, 169), which in turn arrests rotation of the coil spring containing case (FIG. 9C, 143), which in turn arrests extension of cable (FIG. 9D, 108), which in turn arrests the cable (108) coming loose around the straight doorknob (FIG. 9C, 163).
13. The above steps will ensure that the straight doorknob assembly is connected to the straight doorknob tightly and securely. As shown in FIG. 7A, a tamper proof cable (102) is attached to the straight doorknob assembly (101) and is connected to a parcel receptacle (103).
14. Ensure the parcel receptacle security cover (FIG. 7A, 138) is unlocked (104).
15. Open the parcel receptacle security cover (FIG. 7A, 138) as shown in FIG. 14A. The parcel receptacle's zipper position (FIG. 14Aa, 139) shall remain unzipped and the parcel receptacle shall be open, and should allow the delivery personnel to place the parcel inside the parcel receptacle. Additionally, the parcel receptacle lock (104) will remain unlocked at this juncture, but the parcel receptacle shall be securely connected to the doorknob security apparatus via cable/rope/chain (102).
16. And leave the entire assembly unattended and walk away, and you are ready to receive the parcel, and wait for the next event to occur.

Event 2B: Receiving Parcel or Deliveries

This event is very similar to that of Event 2A. Please see the steps described in Event 2A.

Event 3B: Retrieving Parcel or Package

Upon return to one's residence, business or place of stay, the parcel recipient can use a key (106 or its electronic, electrical or wireless equivalents) or any authorized unlocking mechanism to open the doorknob security apparatus such that the locking pin (FIG. 9D, 142) is rotated and goes to the unlocked position as shown in (FIG. 9A, 142), which releases the short lever to move up (FIG. 8L, 120), which in turn allows rotation of horizontally-mounted fins (FIG. 9C, 169), which in turn allows the rotation of the coil spring containing case (FIG. 9C, 143), which in turn allows extension of cable (FIG. 9D, 108), which in turn allows the cable (108) to become loose around the straight doorknob (FIG. 9C, 163), thereby allowing the release of the straight doorknob security apparatus from the straight doorknob. Once the entire doorknob security apparatus is removed from the doorknob, upon going inside one's residence or place of stay, one can unlock the parcel receptacle lock (104 or its electronic or wireless equivalents) and retrieve the contents of the parcel receptacle.

Embodiment 3—Typical Operation on a Door Handle to Receive Parcels

The typical installation and operation on a door handle to receive parcels is very similar to that of installation and operation of a straight doorknob security apparatus on a straight doorknob. For example, the tip of cable strap latch (FIG. 8H, 130), can be inserted into the space between the door handle (FIG. 1C, 112) and the surface of a door and the Cable strap latch lever tip (FIG. 8H, 130) can be slided back into the sliding groove (FIG. 8M, 129), and snapped into a locking position. All other details are very similar to that described in Event 1B, 2B and 3B, and please refer to those sections for a detailed description of the locking and unlocking mechanisms. In addition, operating on a door handle is fairly simplistic, and was described in my parent patent application of U.S. Pat. No. 9,364,112 which included additional embodiments.

Embodiment 4—Integrated Security Apparatus and Parcel Receptacle

The pictorial representation and display of figures described so far in these embodiments typically involve a first cable assembly that wraps around a typical doorknob, a security apparatus that is connected to the first cable assembly, a parcel receptacle, and a second cable assembly that connects the security apparatus to the parcel receptacle. The above list of components was convenient to draw pictorially, and was convenient to explain from an operational standpoint. However, it is very important to note, that an embodiment can easily be made wherein the first cable assembly can be integrated within the security apparatus so as to not become a separate component. Additionally, it is also straight forward to extend the geometry of the security apparatus and/or the geometry of the parcel receptacle so as to remove the second cable assembly. In other words, it is very straight forward to configure the security apparatus and parcel receptacle to integrate the purpose and function of the second cable assembly within and structure of the security apparatus and the parcel receptacle themselves, and not contain a second cable assembly separately. So, it is important to note that an embodiment can be made to fulfill the spirit and scope of this invention by use of a security apparatus and a parcel receptacle, without specifically calling out for first or second cable assembly, or for that matter, without requiring any other cables. It is very important to reflect and note these important distinction and points while creating, reviewing and acceptance of my claims.

Other Relevant Operations and Functions

Typical Operation of a Return of a Parcel

An example of a typical scenario during return of a parcel is described below to help in understanding the application of this invention. This scenario is to provide a general understanding of a typical application and operation. It should be noted, that any real-world applications of the various embodiments can be significantly broader, and should not limited to the application described in this section. In addition, there are features of various embodiments, some of which are optional in nature, and for sake of brevity, those optional features may not be explained or described in this section, however, those can be inferred by careful analysis and review of already presented operational procedures of various parts and components described elsewhere in this document.

The process of return of a parcel typically involves 2 steps, and they are described as events 1C and 2C below.

Event 1C: Setting Up the Parcel Receptacle to Enable Return of a Parcel

Connect the security apparatus to the doorknob as described in Event 1A or Event 2A described earlier. Place the parcel to be returned inside a parcel receptacle and lock the parcel receptacle. The parcel receptacle can be locked by a variety of ways depending on the specific embodiment and may involve technological or non-technological, physical solution. Once the parcel receptacle is locked, leave the entire assembly unattended and walk away, and you are ready to return the parcel, and wait for the next event to occur.

Event 2C: Returning a Parcel

The essential element in this process is to design and establish a way of authentication for the individual belonging to the mail carrier to whom an access to the parcel receptacle needs to be provided. The way of authentication can be of many types. The message pouch can be used as an instrument to communicate to the mail personnel as to how to authenticate themselves. For example, if the parcel receptacle lock is a combination lock, the message could state to enter the last "x" number of digits of the return material authorization (RMA) to allow access to the parcel receptacle. Another example could be to have the mail carrier scan against the camera, the barcode (UPC, QR code, etc.) that authorizes the return of the parcel, and if that is authenticated successfully, the LCD display (FIG. 4A, 132) could provide a code that could allow the mail carrier to enter and gain access to the parcel receptacle. And these are just two examples, and there are numerous other methods that can be employed to authenticate a mail carrier personnel. And once the mail carrier personnel is authenticated, access to the parcel is provided, and the parcel can be retrieved and returned to the appropriate place of its destination. When the owner of the parcel receptacle returns, he or she can remove the security apparatus and parcel receptacle from the doorknob or door handle, and put away for its next use.

Typical Operation of an Exchange of a Parcel

An exchange of a parcel essentially consists of the steps described in a parcel receipt combined with that of a parcel return. Scenarios and sequence of steps involved in a typical parcel receipt and parcel returns are both covered in great detail in those respective sections, and please refer to those sections for an understanding as to how a successful exchange of parcel could be implemented using my invention. Further, the message pouch can be used to communicate to the mail carrier personnel as to what they need to do when they arrive.

Interchangeability of Circular and Straight Doorknob Security Apparatus

In this patent application, FIG. 2A through FIG. 6E, describes the use of a circular doorknob security apparatus on a circular doorknob. Similarly, FIG. 7A through FIG. 9D, describes the use of a straight doorknob security apparatus on a straight doorknob. Circular doorknob security apparatus has both edges of the cable (108) joined and are inside the security apparatus as designed in this embodiment. In essence, the circular doorknob security apparatus described herein does not have an open-end. However, in the straight doorknob security apparatus, one end of the cable (108) is open and offers an ability to pull the cable strap latch out (FIG. 8H, 130) and slide into any tight spaces, including offering an opportunity to slip the tip inside a door handle. So, in essence, the narration in this patent application was done specifically to explain two types of doorknob security apparatus (cable open and cable closed) on two types of doorknob (circular and straight) and a typical door handle. It is very important to note that one can easily take the circular doorknob security apparatus and use it on a straight doorknob, and take the straight doorknob security apparatus and use it on a circular doorknob. In fact, in most cases of practical applications, these locking assemblies are highly inter-changeable. The use of these locking assemblies in specific types of doorknobs as described herein is to make the explanations and narrations simple without over complicating the steps.

It is very important to note that one can easily add a few extra parts or remove a few extra parts and still make this security apparatus functional, and the design and descriptions stated herein is in no way expected to constrain the design or limit the applications to the highly sequential nature of steps described and outlined in this patent application. The design of the present invention may be modified and operated in a variety of configurations without departing from the spirit and scope of the invention. For example, the present invention may be configured in a number of ways in regards to the size, shape, positioning, orientation or materials of the various elements of the invention, and the described design is just one way of fulfilling the objectives of the invention. It is very important to note that one can inject many deviations of the described design to fulfill the intended objectives of the invention, and it is not my intention to limit my application as described only.

Additional Features and Intended Functionalities of Embodiments and Components and their Usage References The typical operation of circular and straight doorknob security apparatus as illustrated earlier involved a very basic sequence of steps, and did not highlight many optional features that are expected to be added and integrated with the security apparatus and parcel receptacles. Here is an overview of many features that are to be integrated.

Doorknobs or Door handles or Door Knockers or Any Stationary Object: The various embodiments of the invention described so far involved utilizing doorknobs and/or door handles or door knockers or doors. However, it is important to note that any existing stationary object present at or near a typical front door, that is conducive to be utilized in a meaningful way with the mentioned security apparatus, is expected to be utilized for achieving the intended purposes of this invention. So, when a doorknob or door handle or door knockers or door is referenced, it is understood that any other object, which can potentially be utilized like a doorknob or door handle or door knockers or door, is automatically included for the purposes of this invention, although the words such as "any other object" may not be referenced explicitly each time.

Parcel Receptacles: The various embodiments of this invention involve utilization of a tamper-proof, weather-resistant, flexible or rigid or semi-rigid parcel receptacle. The parcel receptacle can be either a fixed size or a variable size to fulfill one's need to accommodate various scenarios associated with delivery, return or exchange of parcels. In addition, the parcel receptacles shall have one or more of locking and/or unlocking mechanisms described elsewhere in this application to identify authorized individuals and to facilitate access to the parcel receptacle. Also, in many practical implementations, multiple parcel receptacles may be necessary to receive multiple parcels and deliveries in a given day, and as such, every reference to a single parcel receptacle should automatically be interpreted as a reference to one or more parcel receptacles without requiring to be mentioned specifically as such. Additionally, in order to receive groceries and other goods that are perishable in nature, and that require cool temperature, parcel receptacles can be configured to be refrigerated by dry ice or other appropriate means in order to fulfill the intended use of the application.

Cable, Chain or Rope References: The word cable or chain or rope are referenced a number of times in this application. It is important to note that these words have meanings that are similar and inter-changeable in the context of this application, and these words are not meant to be used in any restrictive manner intentionally or unintentionally. In addition, reference of cable, chain or rope, in general, infer that they are flexible in nature. However, some portions of these cable, chain or rope in our embodiments, need to be configured to be rigid so as to fulfill the purpose of its application in specific designs. So, it is important to note that references to cable, chain or rope are not only meant to be interchangeable in nature, but could also mean to refer to a rigid, semi-rigid or flexible material in nature, and no restrictive meaning is intended to be inferred or derived from their usage or reference. In addition, the reference and use of a first cable to wrap around a doorknob, could also mean usage of a solid, contoured piece of a material to hold a security apparatus to a door knob securely and can actually mean to refer to a coupling assembly rather than a cable assembly. So, in essence, the word cable, chain or rope or their respective assemblies such as cable assemblies mean to infer a way of connection between one component and another component in the embodiments in the context of this invention, and shall not be inferred to be restrictive in their meanings intentionally or unintentionally. All these are cable/rope/chain comments are applicable even in the context of creating a connection mechanism to connect two different parts or components together securely.

Expandable Chain or Cable or Rope: FIGS. 12A through 13G show various designs and embodiments of spring-based chains. These figures illustrate how a technological or non-technological based locking and unlocking mechanism can be configured on a stand-alone basis to control the expansion mechanism on a typical chain. It is important to note that these locking and unlocking mechanisms in these expandable chains can be integrated with the locking and unlocking mechanisms of the circular and straight-shaped locking assemblies so as to simplify the overall design of embodiments in a comprehensive and convenient fashion, and that these locking and unlocking mechanisms need not be separate, repetitive and redundant. Additionally, instead of springs, there can be several other mechanisms that can be configured to expand these chains to increase overall effectiveness, and the design is not intended to limit or restrict the designs or embodiments only to utilization of springs or to perform the function of expansion as shown only. The goal is to form a tight loop to secure the security apparatus to an object.

Locking and Unlocking Mechanism: This is a very essential and important feature of this invention. There are a few places where locking mechanisms are utilized in this invention. First, close to the doorknob or door handle to which a cable or rope or chain mechanism of the security apparatus can be connected. Second, on the parcel receptacle to secure the parcel inside the parcel receptacle to ensure only authorized individuals have access to it. The locking and unlocking mechanism can be a) simple, conventional physical type involving combination locks or traditional locks or can optionally have other embodiments and utilize latest advancement in technologies such as b) RFID, c) Bluetooth d) mobile phone-based applications e) Fingerprint based activation, or f) any wireless based communication such as Near Field Communications (NFCs) protocols and other Wi-Fi and wireless technologies. In addition, the locking and unlocking mechanisms could involve electronically activated solutions such as a solenoid valve driven, electrically-activated locking and unlocking mechanisms. So, it is important to note that any reference to a locking or unlocking mechanism anywhere in this application automatically means the use of one or more of any of these solutions without requiring any specific mention or reference them.

Intrusion and Audible Alarm: The various embodiments can have an intrusion alarm system if the cable or rope or chain is pulled forcefully or if the parcel receptacle and/or lock(s) are attempted to be opened or tampered with. The sound alarm will last for a preset time interval so as to not drain a battery or any source of energy and at the same time deter unauthorized person from continuing their intrusion or tampering. This can be an embodiment where additional security is desired in certain locations or applications. An additional embodiment is also to have a feature where the decibel level of the sound and time duration of the alarm can be adjusted.

Motion Sensor, Camera and Video: To enhance usefulness of the product of our invention, a camera system can be configured to capture activities associated with various scenarios and events that occur while the system functions to fulfill its intended use. The camera system can be configured to capture pictures or videos of activities in and around its place of operation to enable monitoring and/or controlling and/or recording of activities. The camera system can be configured to be equipped with a motion sensor that is expected to trigger capturing of activities when there is any motion or tampering of the system, or when a record-worthy event occurs near the device. There are many record-worthy scenarios during which the camera and video recording can be configured to be used and not all scenarios can be adequately covered or explained in this application, but here are some common examples and scenarios during which the camera can capture activities. For example, the camera system can capture pictures or videos when a delivery personnel approach to deliver a parcel. The camera can capture when a customer or recipient intends to return a parcel and when a carrier personnel approach to retrieve the parcel from the parcel receptacle. The camera can capture when there is any movement near the vicinity of the security apparatus when such movement is expected, or unexpected or suspicious. The camera could also capture when there is any unexpected jerk or tampering of any of the components of the system/apparatus. The pictures and videos can be configured to be either stored, or communicated wirelessly or streamed instantaneously depending on the scenario.

In addition, camera can be configured to be used like a scanner to trigger various actions. For example, such actions could include monitoring or controlling of the locking and unlocking mechanisms of the security apparatus and/or parcel receptacle. For example, when a carrier scans the tracking number or order number, the camera can be configured to enable such scan, and if such parcel is expected or authenticated, allow unlocking of the parcel receptacle to enable placement of the parcel inside the parcel receptacle. In addition, integration of quick response (QR) codes or Universal Product Codes (UPCs), or other forms of barcodes with the camera scanning can be configured to monitor and control the locking and unlocking of the parcel receptacles. In appropriate cases, upon authentication, such actions can be configured to be integrated with the digital displays to communicate messages, alerts and codes.

Notifications, Communications and Alerts: The various embodiments can be configured to utilize one or more of technologies to offer features to notify, communicate or alert the owner or recipient of the system/apparatus during appropriate events. For example, when a parcel is delivered, it can communicate the status to the recipient that a parcel has been delivered. The parcel delivery event can be configured in one of many ways. For example, when there is a movement in the vicinity of the assembly followed by an action where the parcel receptacle is locked, it can be configured to accept those activities and associate them to an event of parcel receipt. Similarly, when there is a movement in the vicinity of the unit, followed by an unlocking of the parcel receptacle, it can be configured to associate and conclude that a parcel has been collected by carrier personnel to return a parcel by the recipient. Similarly, where there is any movement in the vicinity of the assembly and when there is any unexpected tampering, it can be configured to notify the recipient to alert such uncommon activities. By integrating the parts of the system with appropriate computer programs, one can write appropriate algorithms to detect and transmit any appropriate notifications or alerts via email, phone or instant messages.

Device Software and Mobile-Phone Applications: The various embodiments can be configured to utilize integration of appropriate mobile phone-based applications, commonly referred to as mobile phone app, or software installed on the device, to communicate various scenarios, events, statuses, notifications, alerts, pictures, videos, etc. to authorized individuals, so as to allow interaction with the security apparatus and parcel receptacle in a meaningful way. For example, locking and unlocking of the parcel receptacle or the security apparatus can be configured to be controlled wirelessly in many ways including control from a mobile-app or from an internet cloud-based software programs remotely.

Electronics and Computer Hardware: Any technological solution comprises of electrical or electronic parts and one or more of computer hardware. Our security apparatus and/or our parcel receptacle will house the necessary electrical and electronic parts and one or more of the necessary computer hardware including the necessary PCBs (printed circuit boards) to support and fulfil the features and functionalities described in this invention. For pictorial purposes, some of these are displayed in multiple figures, and it is shown for conceptual reasons only and their actual location may be different from what is shown in these figures.

Energy Sources and Supply: To power the electrical and/or electronic or computer hardware, the components need power or energy. Energy can be provided from a regular battery or a rechargeable battery, and can be housed either inside the security apparatus or optionally inside the parcel receptacle depending on its size and utilization. The displayed location of these energy sources is conceptual in nature, and their actual location may be altered depending on the design of a specific embodiment.

Data Storage & Transmission: Data is powerful and in fact very crucial these days. When camera and/or video is activated either due to motion around the device, or due to a configured event such as parcel opening or closure, or tampering, etc., data is generated. To store data, a storage device such as a hard drive or a flash drive may be used and can be housed either inside the security apparatus or inside the parcel receptacle. In addition, through a mobile app or through software or programs installed on the device, and with wireless connectivity, data can be stored or transmitted remotely or streamed instantaneously to one or more external devices including to an internet cloud platform. Working with other electronic or computer hardware that is present in the embodiments, such data can be transmitted to appropriate authenticated devices via commonly available data transmission protocols. In addition, when data is not necessary to be transmitted instantaneously at the time of data collection, a mechanism can be configured to be provided to retrieve the data by a wired or wireless mechanism on an as needed basis. In addition, all data associated with the device can be configured to be stored, transferred or transmitted to external sources including an internet cloud platform.

Digital Displays: As shown in many figures, part number 133 represents a digital text display mechanism that can be integrated into many embodiments, and can be configured to communicate several messages, codes, alerts, statuses, etc. in an interactive fashion to authorized individuals. From those displays and codes, locking and unlocking of locking assemblies and/or parcel receptacles can be configured and selective access to authenticated individuals can be provided.

Display Lights: As shown in many figures, part number 158 represents a few display signals of varying colors. This can be integrated into many embodiments, and can be configured to communicate various statuses such a battery levels, or armed/unarmed status of security apparatus and/or parcel receptacles.

Wireless Technologies and Wireless Transmission: In modern days, wireless technologies offer a great level of convenience. The data transmission, locking and unlocking mechanisms can all be operated either via physical means, or via wireless means. Wireless signals may fall into one or more categories such as RFID, Bluetooth, NFCs, Wi-Fi networks and technologies integrated with mobile-phone based apps. All these technologies are configured to be implemented with my invention so as to fulfill its intended use effectively even if these are not mentioned specifically each time for sake of brevity.

Fingerprint and Biometric Module: A finger print or biometric module can be integrated in the doorknob security apparatus and/or the parcel receptacle. This feature could be utilized to identify authorized individuals, and upon such authentication, these modules can be configured to activate privileges of operation and access to security apparatus and/or parcel receptacle to those authenticated individuals.

GPS Module: A global positioning system (GPS) module can be placed either in the doorknob security apparatus and/or the parcel receptacle. This feature could be activated if for any reason someone has tampered with the parcel receptacle and has managed to remove the parcel receptacle and walk away with it. By this GPS feature, one will be able to identify the current location of the parcel receptacle at any given point. For example, this feature exists in most of the smart phones these days to identify and locate a phone, and this feature can be integrated with the security apparatus and/or the parcel receptacle.

Cloud Platform Integration: Technology, software and storage are important elements that are essential for the success of my invention. Internet cloud provides an amazing platform as all three of these are abundantly present in a typical cloud platform. So, wherever possible and appropriate, the cloud platform can be tightly integrated with my device in every aspect of my invention. Specifically, the cloud platform can be configured to connect to my devices through a variety of technological means discussed elsewhere in this document, and can provide numerous benefits associated with data collection and data dissemination to authenticated users real-time instantaneously or on an as-needed basis. Among other options, wired or wireless internet connectivity to the device is expected to enable optimum and efficient use of cloud platform and implementation of many described features.

Integration with Online Retailers and Freight Companies: The main purpose of this invention is to facilitate online shopping, and to enable deliveries to occur securely and efficiently. So, integration of the locking and unlocking mechanisms of the parcel receptacle with both online retailers and freight carriers is an important feature. Integration of features such as order number, or tracking number and appropriate barcodes on the parcels can all be appropriately integrated with locking and unlocking mechanisms of the parcel receptacle. In addition, these features can be coordinated with online retailers and freight carriers to come up with a mechanism to authenticate delivery personnel and to provide appropriate access to lock or unlock the parcel receptacles. Such coordination can happen electronically including via emails from the online retailer or from the freight carrier and integration of those communications to trigger one or more actions on the security apparatus or parcel receptacle.

Placement Location of Parcel Receptacles: As an example, FIGS. 2A and 2B, and FIGS. 7A and 7B, show placement of parcel receptacles to the right side of the door, across the entrance and away from the hinge of the door. This is pictorially shown as indicated in order to keep the parcel receptacle in close proximity to the doorknob security apparatus for close-up views. In reality, for safety reasons, and to ensure that the cable between the security apparatus and parcel receptacle do not cross the entrance, or come in the way of exiting an office or apartment during an emergency, the parcel receptacle is generally expected to be placed close to the hinge-side of the door, and not across the entrance. It is always intended that all local building codes and safety codes will be followed, and all necessary alterations to the design of the embodiments will be made to reflect adherence to appropriate regulations. It is to be noted that if any figure infers to communicate otherwise, it shall be interpreted that such figures are presented to explain the features in a conceptual manner and is not intended to limit or restrict the design intentionally or unintentionally.

Table 1: Part Number and Description

The following table (Table 1) provides a list of referenced parts in many figures, and contains a brief description and illustration of the part where appropriate.

TABLE 1

Part Number and Its Description

| Part Number | Description |
|---|---|
| 101 | Security apparatus or security attachment or locking assembly. This is the part that can connect to an object to secure parcel. |
| 102 | Cut-resistant cable or rope or chain |
| 103 | Parcel receptacle (or Parcel bag or parcel box) |
| 104 | Parcel receptacle lock. Can be of numerical combination type, or traditional physical type, or any other lock. The intention is to enable locking of parcel receptacle to allow access to only authorized individuals. |
| 105 | A typical circular doorknob. |
| 106 | Security apparatus key |
| 107 | Security apparatus stem. This stem can have many types of geometry and shapes to fulfill the objective of providing a tight and secure mechanism to prevent tampering of cable/rope/chain and ease of installation and operation of security apparatus. The stem can be straight or bent or can have any geometry to increase the tightness and ease of locking in tight spaces. |
| 108 | Security apparatus cable/rope/chain. This chain can be utilized in any of the embodiments to form a tight loop around an object. |
| 109 | Tall spring holder |
| 110 | A typical front door |
| 111 | A typical straight-shaped doorknob |
| 112 | A typical door handle |
| 113 | Coil Spring Groove. One outer edge of coil spring is held by this groove. The other inner edge of coil spring is held by the groove in the center pin of coil spring (FIG. 8M, 160). By this design, when the coil spring containing case (143) is rotated, it causes the coil spring inside to get wound, thereby creating tension in the coil spring. When the coil spring containing case (143) is unlocked and released, this tension allows the coil spring containing case to rotate freely and retract and return to its original position. |
| 114 | Tall spring holder |
| 115 | Wireless sensor. This is shown mainly for pictorial representation only. This could be an RFID or other wireless technology based solution such as a Bluetooth or mobile-based software application. Depending on exact technology utilized in a particular embodiment, this could be placed outside or inside, or could be integrated into the PCB board and other internal mechanisms that are not explicitly displayed outside. This can either replace a doorknob lock, or can be optional additional feature of doorknob security apparatus as alternate embodiments. |
| 116 | Speaker. [When an audible alarm is triggered, loud sound is produced if there is any attempted tampering of the parcel receptacle or the security apparatus or any inter-connecting cables.] |
| 117 | Dangling arrestor. This is just to offset the bend in stem 107 so that the doorknob security apparatus 101 is not dangling because of uneven weight distribution of a bent stem 107. |

TABLE 1-continued

Part Number and Its Description

| Part Number | Description |
|---|---|
| 118 | Opening for charging internal batteries or other electronical components. This is shown for conceptual purposes only, and could be supplemented with a typical USB-based charging solution as well. |
| 119 | Energy source such as a battery. Could be rechargeable or regular types. |
| 120 | Short lever |
| 121 | Tall lever |
| 122 | Slidable wedge |
| 123 | Slot for wedge |
| 124 | Extendable parcel receptacle design. Scissor type design is shown as one typical example, and it can have other designs as well. |
| 125 | GPS module. Comprises of all necessary parts to transmit necessary signals to reveal its present location to authenticated individuals. |
| 126 | Tall lever spring |
| 127 | Wedge spring |
| 128 | Slot for tall lever locking position |
| 129 | Cable strap latch lever sliding groove |
| 130 | Tip of cable strap latch |
| 131 | Coil spring rotation arresting lever |
| 132 | Fingerprint or biometric reader |
| 133 | Display panel (Can be LCD, LED or any type) to communicate lock or unlock codes, or an interface to communicate any kind of messages such as alerts, notifications, etc. |
| 134 | Camera or video recording device. It can be mounted on the security apparatus or placed on the parcel receptacle in some embodiments, or along the chain in some other embodiments. |
| 135 | A chain handle to pull the chain or cable or rope that can be utilized to pull and to facilitate in forming a tight loop around a doorknob or any secure object. |
| 136 | Cable connector |
| 137 | Printed Circuit Board (PCB) to manage electronic and computer circuits, programs and signal transmission, interchange and communication of signals |
| 138 | Parcel receptacle security cover or lid. |
| 139 | Parcel receptacle zipper |
| 140 | Cut-resistant and tamper-resistant cable/rope/chain that is integrated into the parcel receptacle to enhance its structural strength against tampering and vandalism and to improve safety of parcels. |
| 141 | Locking lever slider |
| 142 | Locking pin |
| 143 | Coil spring containing case |
| 144 | Coil spring. These are typically present inside any typical measuring tapes found in hardware stores. When a cable (108) is pulled, the coil spring gets wounded, and creates tension, and helps in retracting the cable when released. |
| 145 | Head of coil spring rotation arresting lever (131) |
| 146 | Vertically adjustable telescopic columns. This can be of many types to increase or decrease the height of parcel receptacles to accommodate varying requirements for varying parcel sizes and parcel delivery needs. This is shown for conceptual purposes only, and the actual design to achieve its intended purposes could involve significantly different design. |
| 147 | Hard drive or any type of data storage device. A cloud platform can either supplement or replace this. |
| 148 | Passage opening for chain (108) elongation and contraction |
| 149 | Bottom case of security apparatus |
| 150a, b | Lock and key mechanism for cable detachment. This is provided so that customers can buy multiple sizes of parcel receptacles 103 such as extra-small, small, medium, large and extra-large and can use the same security apparatus for each one by disconnecting one size of parcel receptacle, and attaching and locking another size of parcel receptacle. For identification purposes, 150a represents the female portion of this lock, and 150b represents the male portion of the lock. |
| 151 | Vertically adjustable parcel receptacle |
| 152 | Wireless module for enabling locking and unlocking mechanism for spring-based chains. Wireless mechanisms can be of many types including RFID, Bluetooth, Wi-Fi, mobile applications-based technologies, NFCs, among other wireless applications. |
| 153 | Locking mechanism that prevents movement of lockable lever (157) once the security apparatus (154) is locked with a locking key (171). |

TABLE 1-continued

| Part Number and Its Description | |
|---|---|
| Part Number | Description |
| 154 | Spring-based chain security apparatus. |
| 155 | Spring-based chain component. The goal of this kind of chain component is that it expands itself as much as possible so that once locked in an expanded position after placing around a doorknob, no one can compress them subsequently upon locking. This can be very helpful especially in straight-doorknob situation to prevent easy removal of the chain from doorknobs, where a higher radius to turn is required to remove it from the doorknob. |
| 156 | A transparent message pouch. Can be used for any communication to a mail carrier. |
| 157 | Lockable lever for spring-based chain |
| 158 | This visual display of signals is shown for pictorial purposes only. This can be armed, disarmed, battery low indicator. A flashing status could also be used for timer-based and triggered mechanism, and could indicate when an wireless-activating device (example an RFID) is brought near to acknowledge receipt of a wireless signal, and display that control programs inside are working at a given time to perform an activity. |
| 159 a, b | Holes for connecting 2 edges of a compressed spring that keeps the lever (131) pushed toward the coil spring containing case (143) to arrest its rotation. In FIG. 5F, when head 145 is pushed toward 159A to release and unlock 143 so as to allow it rotate, this compressed spring will push it back once 145 is released. |
| 160 | Center pin of coil spring |
| 161 | Central drum around which cable/chain/rope are wound around |
| 162 | Flat circular plate on top of which coil spring (144) is placed for rotation |
| 163 | Space to fit doorknob or to place any tightly wrappable object |
| 164 | Parcel receptacle based wireless controller. Using wireless technologies, this controls both locking and unlocking mechanisms of parcel receptacles. Wireless technologies comprise of RFID, Bluetooth, NFCs, Wi-FI, and other mobile phone based applications and solutions that operate wirelessly. This controller also senses tampering and operatively triggers audible alarm and electronic communication of delivery, tampering, etc. to owner. |
| 165 | Cable stopper |
| 166 | Pulling lever |
| 167 | Cable strap latch |
| 168 | Pushable head for arresting rotation of coil spring case |
| 169 | Horizontally-mounted fins |
| 170 | Vertically-mounted fins |
| 171 | Locking key for spring-based doorknob chain. |
| 172 | Typical examples of door knockers. It can be in many geometrical shapes or patterns. |

In the drawings, descriptions and specifications discussed above, a few typical embodiments of the invention are disclosed. Although specific terms and elements are used in description, they are used in a descriptive sense only, and not for the purpose of limitation. It is apparent, however, that various modifications and changes can be made in the specifications, designs, elements to create a greater number of embodiments without departing from the spirit and scope of the invention. The method, device, system and apparatus is a utility product that can have several embodiments and each embodiment has one or more features to securely receive, return and exchange a parcel. The essential advantages of the various embodiments of the apparatus, method and mechanism are many, and should not be limited to the particular examples illustrated in this document only.

I claim:

1. A system for securely receiving, returning or exchanging a parcel, the system comprising:

an attachment device configured for attachment to a provided stationary object, the attachment device comprising:

a base having a first locking mechanism, and a coupling member slidably received within the base thereby forming an adjustable closed loop, said loop delimiting an aperture, said aperture being adjustable in size by extension and retraction of the coupling member relative to the base through sliding movement, wherein the coupling member is engaged by the locking mechanism in a locking position to prevent extension of the coupling member relative to the base via the sliding movement, wherein the attachment device is adapted to receive the stationary object in the aperture, and wherein retraction of the coupling member into the base operatively contracts the loop around the stationary object to a variable locking position, such that the attachment device cannot be removed from the stationary object;

a parcel receptacle configured to contain the parcel, the parcel receptacle having a second locking mechanism configured to permit and restrict opening of the parcel receptacle; and a tamper-proof cable securely attached to the parcel receptacle at one end of the cable and to the attachment device at the other end of the cable.

2. The system of claim 1, wherein an unlocking of the first locking mechanism permits extension of the coupling member relative to the base to allow removal of the attachment device from the stationary object.

3. The system of claim 1, wherein the locking position is adjustable in accordance with a shape of the stationary object such that at least one feature of the stationary object is prevented from passing through the aperture in the locking position.

4. The system of claim 1, wherein the stationary object includes at least one of a door knob, a door handle, a door knocker, and a pre-existing fixture proximate to a parcel address.

5. The system of claim 1, wherein locking and unlocking of each of the first locking mechanism and the second locking mechanism is actuated by at least one of a mechanical key action, an electronic interface, a combination code, and wireless communication.

6. The system of claim 1, wherein the first locking mechanism comprises at least one of a physical lock and key assembly, an electrically-powered lock, a combination lock, an RFID-based interface, a bluetooth-based interface, a Wi-Fi-based interface, a mobile-app based interface, and a NFC-based interface.

7. The system of claim 1, wherein the second locking mechanism comprises at least one of a physical lock and key assembly, an electrically-powered lock, a combination lock, an RFID-based interface, a bluetooth-based interface, a Wi-Fi-based interface, a mobile-app based interface, and a NFC-based interface.

8. The system of claim 1, wherein the second locking mechanism includes a numerical combination lock, wherein a numerical code for unlocking the second locking mechanism is provided to a parcel delivery service in advance of parcel delivery, return, or exchange.

9. The system of claim 1, further comprising an alarm mechanism responsive to tampering with at least one of the cable, the attachment device, and the parcel receptacle.

10. The system of claim 9, wherein at least one of the attachment device and the parcel receptacle includes a speaker connected to the alarm mechanism for sounding an audible alarm.

11. The system of claim 1, wherein the parcel receptacle is configured to expand or contract in size.

12. The system of claim 1, wherein the parcel receptacle further comprises a refrigeration mechanism to keep parcels inside cold.

13. The system of claim 1, wherein at least one of the attachment device and the parcel receptacle further comprises a GPS module, said GPS module configured to be activated remotely.

14. The system of claim 1, wherein at least one of the attachment device and the parcel receptacle further comprises a fingerprint reader to capture a fingerprint for authenticating an individual.

15. The system of claim 1, wherein at least one of the attachment device and the parcel receptacle further comprises a camera.

16. The system of claim 15, further comprising a wireless transceiver device, wherein the camera transmits image and video data via the wireless transceiver device.

17. The system of claim 15, further comprising a motion sensor, wherein the camera is activated by the motion sensor.

18. The system of claim 15, wherein said camera is configured to scan codes, said codes including at least one of QR codes, barcodes, and UPC codes.

19. The system of claim 1, wherein the coupling member comprises at least one of a cable, rope, and chain.

20. The system of claim 19, wherein at least a portion of the coupling member is constructed of a rigid material.

21. A method of securely receiving, returning or exchanging a parcel using a parcel security system, the parcel security system including an attachment device configured for attachment to a provided stationary object, the attachment device including a coupling member and a base having a first locking mechanism, said system further including a parcel receptacle configured to contain the parcel and having a second locking mechanism configured to permit and restrict opening of the parcel receptacle, and said system further including a tamper-proof cable securely attached to the parcel receptacle at one end of the cable and to the attachment device at the other end of the cable, the method comprising:

placing the attachment device around the stationary object;

retracting the coupling member into the base until securely fitted around the stationary object; and locking the attachment device, wherein the coupling member is slidably received within the base thereby forming an adjustable closed loop, said loop delimiting an aperture, said aperture being adjustable in size by extension and retraction of the coupling member relative to the base through sliding movement, wherein the coupling member is engaged by the locking mechanism in a locking position to prevent extension of the coupling member relative to the base via the sliding movement, wherein the attachment device is adapted to receive the stationary object in the aperture, and wherein retraction of the coupling member into the base operatively contracts the loop around the stationary object to a variable locking position, such that the attachment device cannot be removed from the stationary object.

22. The method of claim 21, further comprising retrieving the parcel from the parcel receptacle after delivery of the parcel.

23. The method of claim 21, further comprising placing the parcel in the receptacle for return or exchange of the parcel, and locking the parcel receptacle.

24. The method of claim 21, further comprising providing a security code to a parcel delivery service, wherein the second locking mechanism is unlocked using the code such that authorized access to the parcel receptacle is permitted.

25. The method of claim 21, further comprising arming an alarm mechanism in the system.

* * * * *